US009295871B2

(12) United States Patent
Luedeka

(10) Patent No.: US 9,295,871 B2
(45) Date of Patent: Mar. 29, 2016

(54) BODY WEIGHT TRAINER

(71) Applicant: David Luedeka, Crozet, VA (US)

(72) Inventor: David Luedeka, Crozet, VA (US)

( * ) Notice: Subject to any disclaimer, the term of this patent is extended or adjusted under 35 U.S.C. 154(b) by 236 days.

(21) Appl. No.: 14/028,362

(22) Filed: Sep. 16, 2013

(65) Prior Publication Data

US 2014/0087928 A1 Mar. 27, 2014

Related U.S. Application Data

(60) Provisional application No. 61/701,364, filed on Sep. 14, 2012.

(51) Int. Cl.

| | |
|---|---|
| ***A63B 21/055*** | (2006.01) |
| ***A63B 21/04*** | (2006.01) |
| ***A63B 21/068*** | (2006.01) |
| ***A63B 23/035*** | (2006.01) |
| ***A63B 21/00*** | (2006.01) |
| *A63B 23/02* | (2006.01) |
| *A63B 23/04* | (2006.01) |
| *A63B 23/12* | (2006.01) |

(52) U.S. Cl.

CPC ..... *A63B 21/0552* (2013.01); *A63B 21/00181* (2013.01); *A63B 21/0414* (2013.01); *A63B 21/068* (2013.01); *A63B 21/4023* (2015.10); *A63B 23/03508* (2013.01); *A63B 23/0458* (2013.01); *A63B 23/0227* (2013.01); *A63B 23/0405* (2013.01); *A63B 23/047* (2013.01); *A63B 23/1218* (2013.01); *A63B 23/1227* (2013.01); *A63B 23/1236* (2013.01)

(58) Field of Classification Search

CPC ..... A63B 21/0552; A63B 21/00818; A63B 21/0414; A63B 21/068; A63B 21/1446; A63B 21/00047; A63B 21/04; A63B 23/03508; A63B 23/0458; A63B 23/0227; A63B 23/0405; A63B 23/047; A63B 23/1218; A63B 23/1227; A63B 23/1236

USPC ..... 482/129, 130, 38; D21/691

See application file for complete search history.

(56) References Cited

U.S. PATENT DOCUMENTS

| | | | | |
|---|---|---|---|---|
| 3,614,097 | A * | 10/1971 | Blickman | 482/72 |
| 4,620,701 | A * | 11/1986 | Mojden | 482/41 |
| 5,997,448 | A * | 12/1999 | Duba | 482/121 |
| 6,547,704 | B2 * | 4/2003 | Parrillo | 482/94 |

(Continued)

OTHER PUBLICATIONS

Sep. 13, 2013; POWERSYSTEMS; weight bar strength bands; website pages.

(Continued)

*Primary Examiner* — Joshua Kennedy

(74) *Attorney, Agent, or Firm* — Zollinger & Burleson Ltd.

(57) ABSTRACT

A body weight trainer fitness device allows for the strengthening and normalization of functional movement patterns for those who are not otherwise able. The device accomplishes this with the use of resilient strength bands which are provided in the form of heavy duty rubber bands of varying widths. The bands are selectively attached to a frame via selectively-moveable band holders. The device may then be used to offload the user's weight and thus decrease resistance or it can be used to increase the resistance of an exercise. The bands can be oriented to offload the user's body weight allowing a user to exercise with proper form. Once normal functional movement can take place without the bands, the device may be configured to utilize the bands as resistance to improve these functional motion patterns.

19 Claims, 40 Drawing Sheets

(56) References Cited

U.S. PATENT DOCUMENTS

| | | | | |
|---|---|---|---|---|
| 8,808,151 | B1 * | 8/2014 | Whaley | 482/129 |
| 8,998,781 | B1 * | 4/2015 | Nelson | 482/129 |
| 2006/0003877 | A1 * | 1/2006 | Harmon | 482/142 |
| 2006/0199706 | A1 * | 9/2006 | Wehrell | 482/92 |
| 2013/0213917 | A1 * | 8/2013 | Rios Garcia Prieto | 211/182 |
| 2015/0014212 | A1 * | 1/2015 | Beaver et al. | 206/579 |

OTHER PUBLICATIONS

Apr. 2013, Orthopaedic Practice, Luedeka, The USe of a Modified Connective Tissue Adaptation Phase and Closed Chain PRE Program in the Treatment of a Patient with a Failed Rotator Cuff Repair: A Case Report.

* cited by examiner

BODY WEIGHT TRAINER

CROSS REFERENCE TO RELATED APPLICATIONS

This application claims the benefit of U.S. Provisional Patent Application Ser. No. 61/701,364 filed Sep. 14, 2012; the disclosures of which are incorporated herein by reference.

BACKGROUND OF THE DISCLOSURE

1. Technical Field

The present disclosure generally relates to the strength training fitness equipment field and, more particularly, to fitness equipment and methods that rely on the user's weight to provide the majority of the resistance during the exercise. The exercise equipment and methods described herein use a closed kinetic chain with resistance exercises which allows the user to perform movements closely associated with normal human function. For user's who are unable to manipulate their own body weight with proper form in this closed kinetic chain the device and methods described herein has the ability to offload body weight, and thus enabling functional exercise to take place.

2. Background Information

The American population is in the midst of a health crisis. The major portion of our society has an overly rich diet and engages in little or—frequently—inappropriate levels and types of exercise. Add the issues of aging over this landscape and it becomes a formula for creating a vast array of medical problems.

There is a vicious cycle to this situation. Being overweight, lacking exercise, and being subject to the wear and tear of aging leads directly to problems with the biomechanical machine that is the human body. Muscles and joints deteriorate, and the effort needed to sustain fitness and appropriate body weight becomes ever more painful and difficult. In turn people stop doing the exact things needed to improve health through exercise.

Even fitness devotees are often subject to these forces. When fitness entered the American consciousness in the 1970s there was little thought given to the formats for exercise. You ran or jumped up and down in classes to create cardiovascular fitness and you lifted free-weights—or used machines that mimic the free-weight movements—to create strength and muscle tone. These approaches served a young demographic quite well, but over time the misuse and even inappropriateness of many of the exercise formats could lead to problems. Many long-term "fit" people are now showing up at orthopedic physicians, chiropractors, and physical therapists with joint and back issues that are a direct result of their former exercise or sports activities.

We as a nation appear to be heading into a period where many of us—particularly those over 60—are sentenced to a life of discomfort and steady decline in our ability to joyfully interact with our physical world.

It does not have to be this way. An approach to living that emphasizes good diet and appropriate exercise can prevent both debilitating disease and injury and even restore an individual's health to where an active and pain-free life is a probable outcome.

Functionally based strength training exercises are those exercises performed in a likeness to how the body works in its normal gravitational environment or how our bodies have evolved to deal with theses gravitational forces. Most functional exercises take place in a closed kinetic chain. A kinetic chain is a motion that is sequential in nature, moving from one segment to the next. One such example occurs when dominos are lined up, stood on end, and one of them falls hitting the next. This sequence continues and the motion is transferred through the entire line of dominos. Closed kinetic chain motion occurs when that same domino attempts to fall forward, but is blocked by an immovable object. An opposing force, created by this immovable object, causes the domino to fall in the opposite direction. The dominos stacked behind the blocked domino begin the motion transfer in the reverse direction. Closed kinetic chain exercise takes place with either the upper extremity or lower extremity fixed on an immovable object. The associated muscles contract in an attempt to move this object. Unable to move the object, the muscle contraction causes motion in the opposite direction, moving the bodies' center of mass instead.

Closed chain motion affects the way our muscles work. Our muscles often function differently in a closed chain than they do in an open chain. This is easily seen in the lower extremity. The hamstring muscle in the back of the thigh bends the knee when contacted in an open chain, but assists in straightening the knee when contracted in a closed chain.

It does not make sense that most exercise machines train our bodies in an open chain. Makers of exercise machines are beginning to realize this and have introduced machines that train the body in a closed kinetic chain. However, for the most part these machines require a significant amount of lower extremity strength to be utilized appropriately and are limited in their closed chain force application to the upper extremity.

Gravity is the force of attraction between two objects. It is a fundamental force of nature that keeps one grounded and must be overcome with every step you make. Our lower extremity musculoskeletal system is designed with large bones and muscles, producing forces that enable us to overcome gravity. The way these muscles work against gravity is slightly different from what we are classically taught. Instead of one muscle flexing a joint and the other extending it, the same muscle is responsible for both actions. The muscles work in conjunction with other muscles in the kinetic chain eccentrically to control the bending caused by gravity and concentrically to overcome it. Since our lower extremities function primarily against closed chain forces, they need to be exercised in a manner that duplicates these forces and therefore improves their functional strength. As we age the maintenance of this closed chain functional strength is a key to preserving our quality of life.

At the other end of the body, the shoulder joint is anatomically unstable in an open chain. Even though we have evolved from using our upper extremities as legs, they are not designed to function solely in an open chain. They are designed to utilize the compressive forces of gravity to assist with joint stabilization. The shoulder has a cuff of musculature (the rotator cuff) to assist in this stabilization. When the compressive forces provided by gravity are utilized in closed chain exercise there is less need for the rotator cuff musculature to stabilize the shoulder joint. On the other hand, motion in an open chain, especially with load, places a great deal of stress on this rotator cuff musculature. Over time the rotator cuff wears out. As a result of this disruption the rotator cuff is a major cause of pain and disability in modern life.

Training the upper extremity musculature in a functional closed chain manner also helps to keep the joints of the upper extremity properly positioned. Most machines and barbell-based forms of exercise require the user to lie or sit on a bench. When this happens the motion of the shoulder blade is limited and even greater stress is placed on the rotator cuff, as the cuff has to stabilize the shoulder joint that is being asked to do too much. The shoulder joint is forced to increase its contribution to the overall motion of the shoulder girdle because the shoulder blade is less able to contribute due to its fixed position. Over time injury to the rotator cuff often occurs.

Lifting the arm overhead in an open chain decreases the need of the eccentric action of the lower rotator cuff and latissimus dorsi to pull the humeral head downward. Without this downward pull, the humeral head rides up in the shoulder joint causing rotator cuff tendon impingement. Closed chain upper extremity exercises—like pull ups in which the arm is moving overhead—utilize this eccentric contraction of the lower cuff and help to prevent impingement.

Training functionally improves strength and, like other forms of resistance training, causes muscle hypertrophy. However, functional training provides superior protection from injury, has a greater metabolic cost due to the multi-joint nature of most of the exercises, and thus tends to be more effective.

The importance of functional training cannot be overstated. Even sports training exercises frequently have little to do with the specific tasks associated with that sport, or do not train all the components of muscular performance. For example, athletes at most levels emphasize strength training in their programs but fail to train their neurological conduction speed. Power is improved by increasing neurological conduction speed. Training that ignores this means athletes are not doing everything they can do to improve their performance.

We need, first and foremost, to be functionally strong. Whether we are athletes, young adults, or retirees, functional training provides benefits to the human machine that are greater than other forms of better known exercise. Most exercise machines available to public apply resistance in an open chain. These machines support the user's weight and allow motion of the distal segment. As such these open chain resistance exercise machines do not provide musculoskeletal adaptation specifically related to how our bodies move in space against gravity.

SUMMARY OF THE DISCLOSURE

The disclosure provides a fitness device that allows for the strengthening and therefore normalization of these functional movement patterns for those who are not otherwise able. The device accomplishes this with the use of resilient strength bands which are provided in the form of heavy duty rubber bands of varying widths. The bands are selectively attached to the adjustable frame via the band holders. The device may then be used to offload the user's weight and thus decrease resistance or it can be used to increase the resistance of an exercise. The bands can be oriented to offload the user's body weight allowing a user to exercise with proper form. Once normal functional movement can take place without the bands, the device may be configured to utilize the bands as resistance to improve these functional motion patterns.

The disclosure generally includes a frame with an attached step and adjustable bars. The frame has holes that enable the attachment of band holders in a variety of locations. These band holders are designed to anchor the bands to the frame and allow for the bands to apply either assisted or resisted forces to the functional exercises that take place at least partially within the frame. The frame may be made from metal framing members or from a variety of other rigid materials such as wood, plastics, ceramics or a combination of materials.

A unique aspect of this device is that all essential functionally based exercises are able to be done at least partially within the frame. This along with the other features described herein make it unique to the market. With the use of the adjustable bars and the attached bands many assisted upper extremity functionally based exercises such as dips, pull ups, inverted rows and shrugs are able to take place. Utilizing the fixed step within this frame, the adjustable band holders, and the band the user is able to do such exercises as single leg squats, single leg stiff legged deadlifts, knee extensions, hip hikers and overhead shoulder presses. With the band holder attached to the front of the frame and the assistance band attached across the front of the frame exercises such as assisted push-ups, resisted closed chain hip extension and resisted closed chain hip adduction.

In one configuration, the disclosure provides an exercise device for functional exercises wherein the device includes a frame that defines an interior exercise area and an opening that provides a user access to enter and exit the interior exercise area; a step carried by the frame; the step having a first portion disposed within the interior exercise area and a second portion disposed outside the interior exercise area; a band holder carried by the frame; the location of the band holder being repositionable with respect to the frame; and an elastic exercise band selectively positionable on the band holder. The band holder may be positioned at a plurality of different locations on the frame higher than the step. The band holder may position the band within the interior exercise area or outside of the interior exercise area.

In one configuration, the disclosure provides an exercise device for functional exercises that includes a frame that defines an interior exercise area and an opening that provides a user access to enter and exit the interior exercise area; a pair of parallel arm bars carried by the frame; each parallel arm bar being carried by a pair of brackets that are selectively pivotably mounted to the frame to allow the position of the parallel arm bar to be adjusted with respect to the frame; each parallel arm bar being rotatable from a position inside the interior exercise area to a location outside the interior exercise area where the parallel arm bar may be used in a side exercise area; a band holder carried by the frame; the location of the band holder being repositionable with respect to the frame; and an elastic exercise band selectively positionable on the band holder.

In one configuration, the disclosure provides an exercise device for functional exercises wherein the device includes a frame that defines an interior exercise area and an opening that provides a user access to enter and exit the interior exercise area; an elongated band holder that is selectively positionable on the frame in a plurality of first positions wherein the elongated band holder is disposed within the interior exercise area and a plurality of second positions wherein the elongated band holder is disposed outside the interior exercise area; the elongated band holder including a bar having a first end and a second end that carries a pair of spaced flanges that define a circumferential slot between the flanges adapted to receive a portion of an elastic band; and an elastic exercise band selectively positionable on the elongated band holder.

The disclosure also provides an exercise device for functional exercises wherein the device includes a frame formed from a plurality of frame members that define a plurality of through holes that allow band holders to be positioned at different locations about the frame.

The disclosure also provides an exercise device for functional exercises wherein the device includes a frame having a height and a width; the width of the frame matching the unstretched length of an exercise band used with the frame.

The disclosure also provides a method for using an exercise device wherein a plurality of functional exercises are performed in conjunction with the frame with assistance and then resistance from elastic exercise bands connected to the frame.

BRIEF DESCRIPTION OF THE DRAWINGS

Similar numbers refer to similar parts throughout the specification.

DETAILED DESCRIPTION OF THE DISCLOSURE

Figure 1:
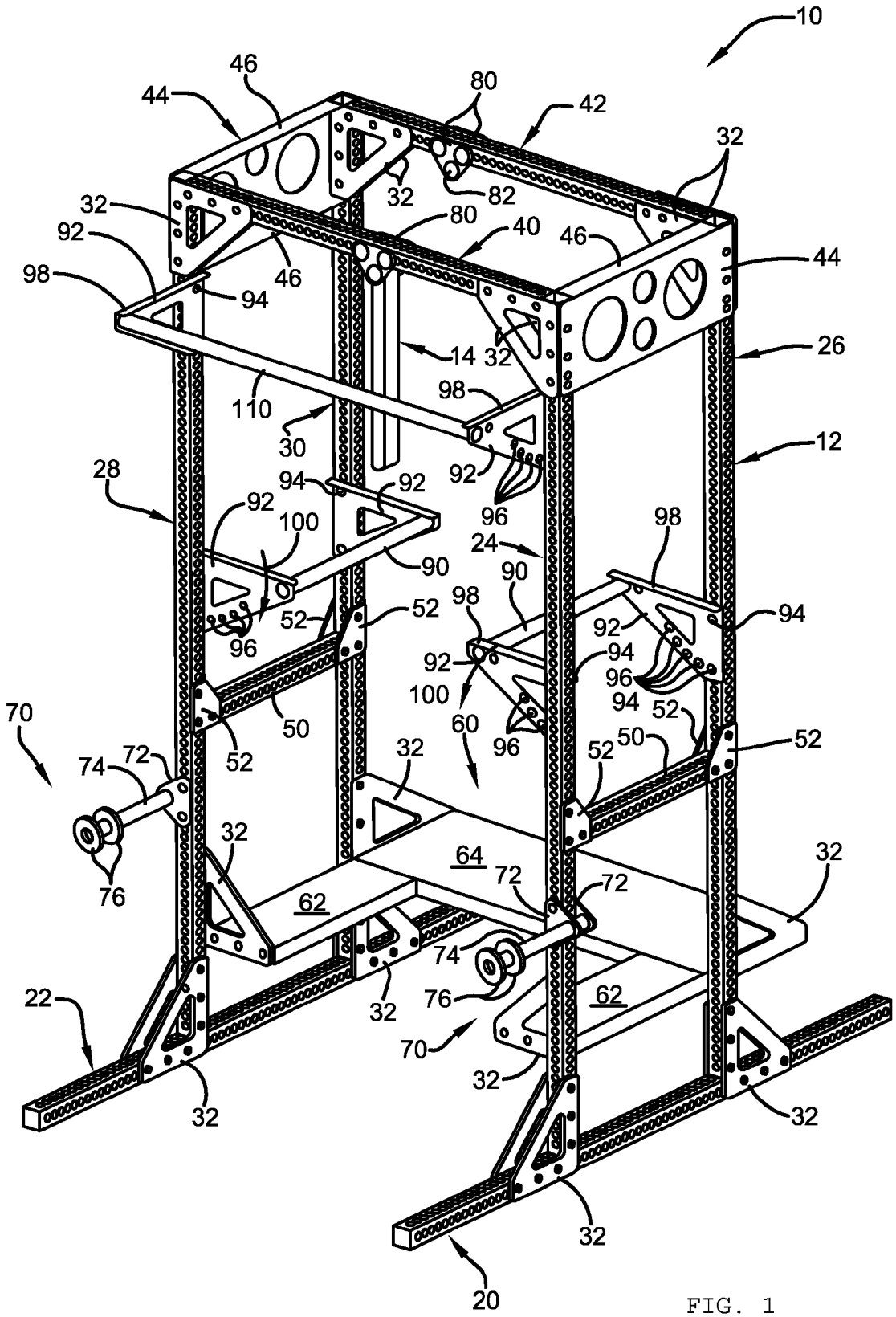
FIG. 1 is a front perspective view of the exercise device with a resilient strength band hanging from a band holder disposed on the front top frame.

A first configuration of the body weight trainer exercise device is indicated generally by the numeral 10 in the accompanying drawings. Device 10 generally includes a frame 12 and at least one resilient strength band 14 or a plurality of resilient strength bands 14. In the following description, the terms 'band' and 'bands' are used interchangeably with the intended meaning of 'band' to include a plurality of separate bands 14 being used together. Resilient strength band 14 may be provided in the form of a heavy duty rubber band configured to receive a few hundred pounds of force without breaking and without noticeable permanent elongation. Device 10 is used to perform a plurality of functional exercises with assistance, without assistance, or with resistance. Device 10 may be used to offload or support a portion of the user's weight and thus decrease resistance. Device 10 may be used with only the user's weight as the resistance or may be used to increase resistance to the functional exercise. Band 14 can be oriented to offload the user's body weight allowing a user to practice the proper functional movement when the user is unable to perform the movement independently. Once normal functional movement can take place without band 14, device 10 can be configured to utilize bands 14 as resistance to improve these functional motion patterns. Exemplary exercises and movements are described below.

Frame 12 has a top, a bottom, a front, a rear, and a right side (when viewed from the front) and a left side (when viewed from the front). Frame 12 generally defines an interior exercise area, a pair of side exercise areas, a front exercise area, and a rear exercise area. In the exemplary configuration, frame 12 is made from square metal tubing that defines a plurality of evenly-spaced through holes that allow the elements of device 10 to be mounted in a variety of locations and configurations. Frame 12 includes a base that allows frame 12 to be supported on essentially any flat sturdy surface inside or outside. The base includes a right base 20 and a left base 22. Four main uprights 24, 26, 28, and 30 rest on top of bases 20 and 22 and project up in parallel to the top of frame 12. Bases 20 and 22 extend beyond the main uprights forwardly of front uprights 24 and 28 as well as rearwardly of rear uprights 26 and 30 to provide stability to device 10. These extended portions of bases 20 and 22 provide spaces between which the user may perform exercises. The area defined by the four main uprights at the corners is the interior exercise area of device 10 and frame 12 defines an opening (between uprights 24 and 28 in this exemplary configuration) that provides a user access for entering and exiting the interior exercise area. The side exercise areas are to the right of main uprights 24 and 26 and to the left of main uprights 28 and 30. The front exercise area is in front of main uprights 24 and 28 within the boundary of bases 20 and 22 and the rear exercise area is behind main uprights 26 and 30 within the boundary of bases 20 and 22. These exercise areas extend from the floor surface upon which device 10 is supported to the top of device 10.

Brackets 32 are disposed on both the left and right sides of each connection between a main upright 24, 26, 28, and 30 and its base 20 or 22. Each connection thus includes a pair of brackets 32 with portions of an upright and a base disposed between brackets 32. Brackets 32 are secured with nut and bolt combinations that extend all the way through the three elements. At least three nut and bolt combinations may be used with each element such that at least six nut and bolt combinations are used with each joint. Washers or lock washers also may be used with the nut and bolt combinations.

The top of frame 12 includes a front top frame member 40, a back top frame member 42, and a pair of side top frame members 44. Front and back top frame members 40 and 42 are formed from the same material as the main uprights and, as such, define a plurality of evenly-spaced through holes. Brackets 32 secure top and back frame members 40 and 42 to the uprights in the manner described above wherein the abutment between the elements is sandwiched between a pair of brackets 32. Side top frame members 44 are plates that each has a length that extends between uprights 24/26 and 28/30 and a width substantially the same as the height of bracket 32. Each side top frame member 44 includes flanges 46 that are offset from the ends of side top frame 44 so that flanges 46 fit between the brackets on the opposed uprights. Each flange 46 has a depth that is less than the dimension of the upright so that the flange does not project beyond the perimeter of the upright. Each side top frame member 44 may define large openings to reduce weight and material usage or may define solid central areas that support logos and trademarks for the device.

Mid-frame cross braces or middle support frame members 50 are disposed between pairs of uprights across the sides of frame 12. Braces 50 are secured to the uprights with smaller solid brackets 52 that sandwich the elements in the manner described above with respect to brackets 32. Braces 52 are located at the lower half of the height of device 10. Mid-frame cross braces 52 have the same cross section as the uprights.

The above elements of frame 12 provide a sturdy structure for supporting the weight of an adult such that the adult can perform exercises without concern about the stability of frame 12. Exemplary exercises are described below.

A fixed step 60 having a flat upper surface and sidewalls is supported by at least two main uprights 24, 26, 28, and 30. Step 60 is disposed below braces 50 at the lower half of the height of device. In the exemplary configuration, fixed step 60 is supported by four brackets 32 with one bracket 32 connected to each of the main uprights 24, 26, 28, and 30. In this configuration, fixed step 60 is U-shaped formed from a pair of side steps 62 and a main back step 64. Main back step 64 is disposed between and rearward of main uprights 26 and 30. Each side step 62 has a lengthwise direction that is disposed parallel to bases 20 and 22 while main back step 64 has a lengthwise direction is disposed perpendicular to bases 20 and 22. To support this configuration, two of the brackets 32 are referred to as front step brackets and are disposed perpendicular to bases 20 and 22 while projecting inwardly from main uprights 24 and 28. These front step brackets are secured to the front ends of side steps 62. The rear ends of side steps are secured directly to the front sidewall of main step 64. Two of brackets 32 are disposed parallel to bases 20 and 22 and are referred to as rear step brackets. These two rear step brackets are connected to the ends of main step 64. The support arrangement provides support for main step 64 without brackets 32 protruding into the usable width of step 64. The support arrangement also allows step 64 to be accessed from both the front and the rear of step 64. The bracket configuration also allows the space under step 64 to be used without bracket or other support interference. Moving brackets 32 up or down along the main uprights by removing the brackets connectors and replacing them in other through holes allows the height of step 60 to be adjusted 60. The connectors that secure steps 62 and 64 to the uprights may be nut and bolt combinations. When the connectors are nut and bolt combinations, the connections between step 60 and the uprights may be tightened so that step 60 provides stability to frame 12. In other configurations, brackets 32 may be secured with removable pins to facilitate the adjustability of step 60. In the exemplary configuration, both side steps 62 are disposed within the interior exercise area with main step 64 being disposed mostly in the rear exercise area opposite the opening that defines the entrance and exit to the interior exercise area.

In the exemplary configuration of the device depicted in the drawings, brackets 32 that support steps 62 and 64 are the same size and configuration as brackets 32 that are used with the connections between uprights 24, 26, 28, and 30 with base members 20 and 22. In other configurations of device 10, these brackets may be smaller in height such as the example such at the ends of main step 64. In another configuration, side steps 62 are about one-third less wide than those depicted in the drawings (to widen the interior exercise space) such that the brackets only require two nut and bolt combinations to secure steps 62 to frame 12.

A pair elongated band holders 70 are depicted as projecting forwardly from the front main uprights 24 and 28. Each elongated band holder 70 includes a pair of spaced bases 72 that are to be disposed on opposite sides of a frame member with a pair of connectors (nut and bolt or readily-removable pin-type) extending through both bases 72 and the frame member to provide a secure, stable connection capable of supporting substantial forces that are imparted to holders 70 by bands 14. Each holder 70 includes a bar 74 that passes through and is secured to (by welding or connectors) both bases 72 outwardly of the frame member. This bar 74 spaces the frame anchoring location from the location on holder 70 that supports band 14. Spaced flanges 76 are disposed at the end of bar 74 opposite bases 72 and cooperate with the end of bar 74 to define a circumferential slot configured to receive one or more bands 14. The circumferential slot and the round bar allow the bands to smoothly move through a full range of motion about bar 74. Flanges 76 may be circular disks having a diameter of about three times the diameter of bar 74. The slots defined between flanges 76 allow bands 14 to be quickly and easily installed and quickly and easily removed while providing a secure anchor for bands 14 during use. The edges of flanges 76 are smooth so that they do not cut into bands 14 that may be pulled across the edges during the exercises.

The position of elongated band holders 70 may be changed along the uprights when desired by removing the connectors that connect bases 72 to the main uprights, moving bases 72, and securing them into place with the connectors. As discussed above, the connectors may be removable pins that provide for position adjustments without tools. These pins allow elongated band holders 70 to be connected to any main upright, front top frame member 40, back top frame member 42, either base 20, 22, or either mid-frame cross brace 50. The different positions are used for different exercises. For example, one or more elongated band holders 70 may be connected to back top frame member 42 above main step 64 so that bands 14 may be hung rearwardly of back top frame member 42.

Figure 2:
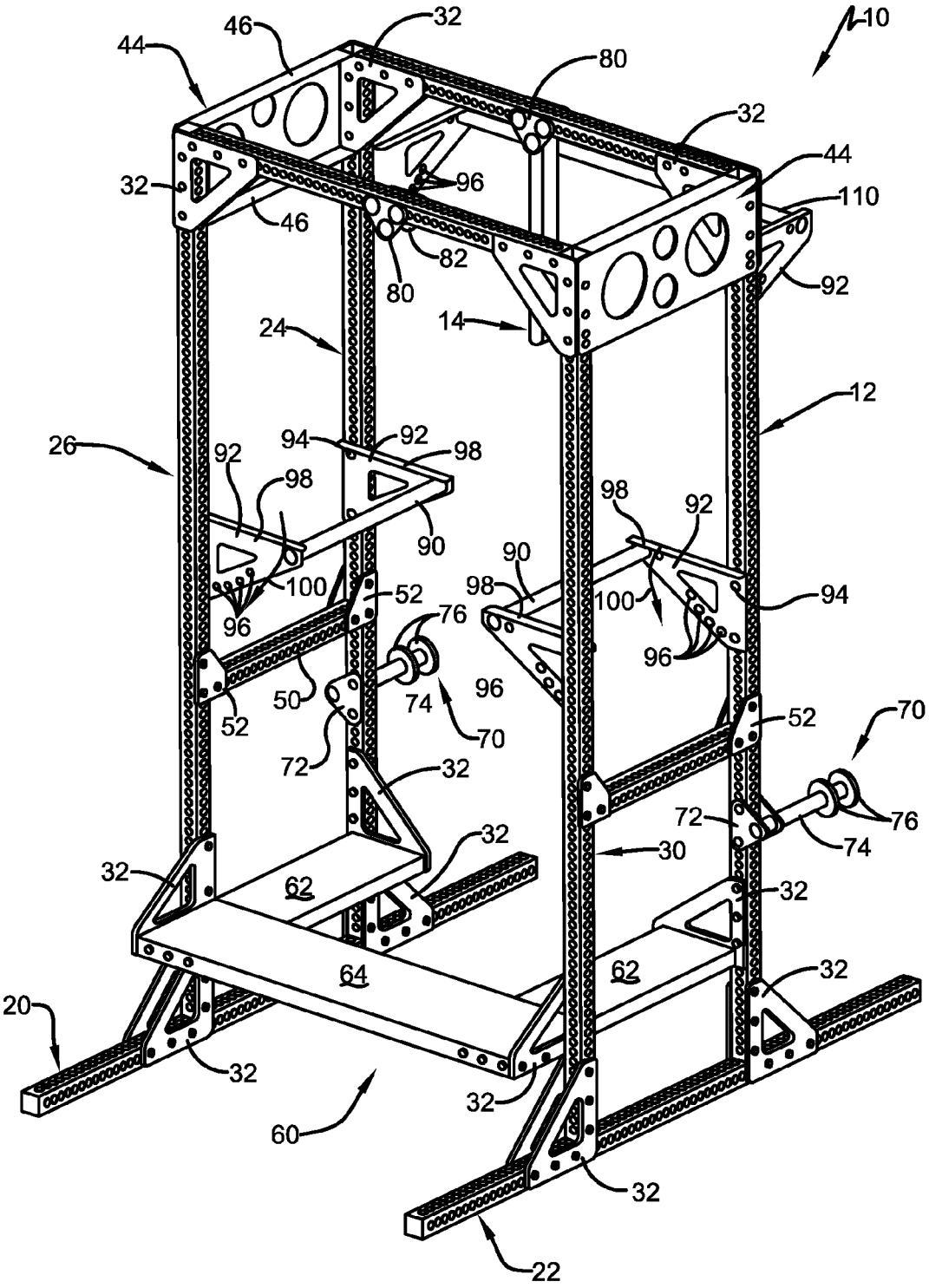
FIG. 2 is a rear perspective view of the exercise device with a resilient strength band hanging from a band holder disposed on the front top frame.

Device 10 also includes a pair of standard band holders 80 that use bases 72 with a short bar 82 that extends only between bases 72. A band 14 may be placed on standard band holder 80 by slip knotting the band over the holder or by removing the holder 80 from frame 12 and looping band 14 over bar 82 as shown in FIGS. 1 and 2. Standard band holders 80 may be connected to any main upright, front top frame member 40, back top frame member 42, either base 20, 22, or either mid-frame cross brace 50. The different positions are used for different exercises.

Device 10 includes a pair of parallel arm bars 90 that are adjustably connected to the main uprights. Each parallel arm bar 90 is supported on its pair of main uprights by a pair of elongated brackets 92 that each define a corner mounting hole for a pivot bolt 94 and a plurality of spaced openings 96 (disposed along an arc) that allow bracket 92 and bar 90 to be rotated (and then secured) through different positions with respect to the main uprights. Bar 90 and its brackets 92 may be rotated in the direction of reference arrow 100 to adjust the height and lateral position of bar 90 within frame 12. Rotation of bar 90 and brackets 92 in the direction of arrow 100 allows the user to align one of holes 96 with the holes in the main upright where bracket 92 may be pinned in place for use. Parallel arm bars 90 are fully upright and are in the position where they are closest together in FIGS. 1 and 2. Rotating parallel arm bars 90 down moves the bar farther apart. A pin is passed through one of holes 96 to secure the position of bracket 92 to frame 12. Brackets 92 also include at least one reinforcement flange 98 that strengthens bracket 92 while also eliminating a potentially sharp upper edge.

Each bar 90 and its brackets 92 may be rotated from its inner position (within the interior exercise area) depicted in FIGS. 1 and 2 to an outer position (within a side exercise area) wherein bar 90 is essentially rotated 180 degrees to a position outwardly of the main uprights so that bar 90 is out of the way for some exercises that are performed inside frame 12. This position is depicted in FIGS. 3-6.

Device 10 also includes an adjustable pull up bar 110 disposed across the top of the main uprights and disposed forwardly of the front main uprights at the upper portion of the front exercise area. Bar 110 is secured with a pair of elongated brackets 92 having pivot 94 and adjustment holes 96 as discussed above.

Device 10 described above may be used to perform the exercises described below which allows the user to perform movements more closely associated with normal human function.

Methods of Using Body Weight Trainer Device 10

The Components of Fitness

This system involves considerations of correct musculoskeletal movement in a manner that offsets the effect of gravity. It also involves determining which exercises to do, the level of load, the repetitions required for each one, and appropriate sequencing. Determining these parameters requires an understanding of fitness.

Device 10 and the method of using device 10 defines the components of fitness as muscle performance, joint health, and cardiovascular function. Muscle performance is composed of four sections: strength, functional muscle flexibility, balance, and neural conduction speed. Performing resistance training functionally improves your muscle performance. Improvement in your muscular performance enables you to manipulate your center of mass within your base of support in an appropriate manner. All of these make activities of daily living easier, lessen the chances of joint disease, and decrease the risk of falling as we age.

Muscle Performance

Strength—Described in simple terms, strength is defined as a muscle's ability to produce force and is measured by evaluating the amount of resistance this produced force can overcome.

Unfortunately, little objective data exists to compare your current muscular performance levels with age and gender-related averages. In other words, there is no valid and reliable measure with which to establish just how functionally strong you are. This is especially true about lower body strength.

Consequently, the assessment of functional lower extremity strength is difficult and multi-faceted. Most functional human lower extremity motion takes place with different kinetic chain activity on each limb. As an example, during walking we push off from one limb and accept load on the other. This differing force producing and force accepting sequence makes single limb evaluation of functional lower extremity strength critical. In this case muscle activity should be similar on each limb in motion. Unfortunately, most tests of lower extremity strength measure force production from both limbs simultaneously. Since we don't hop like rabbits, the tests are not valid or reliable to truly assess functional lower extremity strength as it relates to the normal human motion of walking.

Is there another way to evaluate functional lower extremity motion until proper normative data tables can be developed? For now it is best to evaluate lower extremity functional strength in terms of the actual capabilities in each of the sequenced exercises for those extremities. For example, can you squat with proper form on both limbs? Can you do a split squat with proper form? Can you do an unstable split squat with proper form? Finally, can you do a single leg squat with proper form? If in the evaluation process you determine that you are unable to do a bilateral squat with good form, then it can be assumed that you have poor functional lower extremity strength. Conversely, if you can perform a single leg squat with proper form it can be assumed that you have sufficient lower extremity functional strength. Proper form, in regard to the above mentioned lower extremity strength evaluation, will be discussed in the exercise descriptions.

There is some limited evaluative data available to compare your current functional upper body strength to other people your age. Data is most readily available for the push up, specifically from the Canadian Society for Exercise Physiology's publication Canadian physical activity, fitness and lifestyle approach: CSEP-health and fitness program's appraisal and counseling strategy, 3rd edition 2003. This data is available for men in the standard military style push up position and for women in the modified "knee push up position." With the information in this publication you can compare your upper body strength to others your age.

However, for the rest of the upper extremity functional strength exercises in this handbook, there are no comparative data tables available, and the same approach utilized to evaluate lower extremity functional strength should be undertaken. With proper form are you able to do the exercises as shown in the description of exercises section? If you are not able to do the exercises with proper form, then it is important to determine how much assistance you require to do the exercise correctly. This is your initial functional strength assessment. This method can be utilized to evaluate your push up strength as well. This data is important and will be used to design your muscle performance program.

There is data available to compare your core strength to age-related populations via the one-minute sit up test. The previously mentioned manuscript produced by the Canadian Society for Exercise Physiology is an often utilized source. It is also possible to evaluate functional core strength in the same manner as was done with the upper and lower extremity. We need functional core strength in order to maintain our center of mass position during most functional exercises. Please keep in mind functional core strength is not simply measured by your ability to do a sit up. While sit ups may be used to strengthen your core, as noted above, your core has to be functionally strong. If you are unable to do an exercise due to poor core strength, which manifests itself as an inability to hold a stable spine position, then it is necessary to increase your functional core strength as it relates to that position.

When you first start a functional resistance training program, you will see a great improvement in your functional strength. Not all of these gains are due to muscle hypertrophy (the muscles reacting to the stress of exercising by increasing their size and ability to produce force). Some of these gains are due to the learning curve and neuromuscular adaptation. After these initial gains the progress you attain will be due to improvements in your muscular performance. After years of functional training, even these gains will stabilize. You will then be close to your genetic potential which is determined by your body type, age, joint health, and environmental factors. Attaining your genetic potential should be the goal of your fitness program.

Functional Flexibility

Maintaining flexibility through the aging process ensures that proper functional motion can take place. Without normal muscle flexibility, associated joints are not able to move through their full range of motion, therefore contributing to joint dysfunction, derangement, and disease. Poor muscular flexibility increases the risk for muscle strains.

Functional flexibility is not the same thing as static flexibility (flexibility attained while doing static stretches). Static stretching takes place in isolation. Functional flexibility is a coordinated effort in which you need to have enough flexibility in one limb to allow proper motion in the other. Functional flexibility is attained by moving the body in patterns that dynamically lengthen the appropriate tissue to allow for normal functional motion. Specific functional flexibility exercises will be demonstrated in the section on exercise descriptions. Specific isolated static stretches are helpful when addressing a lack of flexibility in specific joints or muscles.

Balance Human balance is a complex dance between the neuromuscular system, the eyes, and the vestibular system. Balance is important to functional human motion. With an intact central nervous system, balance improves with increased functional strength and nerve conduction speed. Functional training takes place against the gravitational forces which our bodies experience in the activities of daily living. As we improve our body's functional ability to move, we also train and develop our balance. Machine-based exercises take place mostly in seated positions, eliminating the need for balance. They therefore do not provide the needed stimulus to improve balance.

Nerve Conduction Speed Physics can explain the need to train nerve conduction as a component of muscle performance. The nerve conduction process causes muscle contraction and the associated force production. The force a muscle produces after this conduction process is measured by the object's mass on which this force is exerted and how quickly the object therefore moves or changes direction. When we look more closely at muscle-produced force, we see it moves most joints through a fixed arc of motion. Because we know the distance an object moves after being exposed to the applied force, we can calculate the work done by the person producing the force. The same amount of work is done to move an object or your center of mass from point 'a' to point 'b' whether it happens quickly or slowly. Power tells us how fast this motion occurs and is defined as work divided by time. When a muscle can produce more force and contract faster, the time needed to move an object from point 'a' to point 'b' decreases and the neuromuscular unit becomes more powerful.

Power is important to the human body because we are constantly contracting muscles to accept loads and at the same time to produce motion. When our nerve conduction can no longer keep pace with this process, we stumble against gravitational forces. This exponentially increases our risk of falling. Nerve conduction speed, which can be trained, is an important part of muscle performance.

To improve neuromuscular conduction speeds, baselines need to be established. A metronome and stopwatch can be used to evaluate the maximal speed of functional motion. Research has shown that maximum power production occurs at around 50% of maximum muscle force production. This correlates to about the 20 rep max level of resistance for functional motion exercises. Measure the fastest pace in which you are able to accomplish an exercise for 20 reps; whether it is 50 beats per minute or 10 beats per minute is irrelevant. Establish your best speed to allow you to set your training intensity and incorporate this in your program design. Conditioning neuromuscular conduction speed involves effort, but over time you will improve that 20 rep max speed established during baseline testing.

Joint Health

Joint health is another important, yet over-looked, aspect of a properly designed fitness program. Joint problems are more easily dealt with when treated early. For example, if your feet over-pronate, your knees may be more susceptible to osteoarthritis and its painful disease progression. Get evaluated for orthotics to lessen the stress on the lateral compartment of your knee. If you have unequal leg length due to functional or anatomical discrepancy, get evaluated and treated to prevent spinal problems later in life. In general, it is a good idea to have your joints screened by a physical therapist prior to starting a functionally-based exercise program.

Some joint problems are caused by aberrant motion patterns established as we grow. Our hips and knees are designed to be our prime movers when it comes to lower body function, but as we age and become functionally weak, we begin to bend at our spines instead of our legs. The spinal joints are not designed for this kind of stress, and in time we are left with disc protrusions and osteoarthritis. Learn to bend your hips and knees while maintaining a stable spine and you can prevent future spinal problems. Proper functional exercise form is essential in this endeavor, and it takes time and practice to gain proper form.

Body mass and body composition are other aspects of our joint health. Obesity is a risk factor for many diseases, and its detrimental effect on joint health is well noted. Being overweight or obese increases the gravitational impact on our musculoskeletal system. Those with body mass indices between 25 kg/m2 and 30 kg/m2 are considered overweight and those over 30 kg/m2 are considered obese. There are many online references for evaluating your body mass index. The overweight or obese should seek the counsel of a licensed dietician to help with the weight loss process.

The body mass index gives us a general idea of the effects of gravity on our structure whether that mass is composed of muscle or fat. Your body fat percentage tells us of what your mass is made. In order to tolerate a higher body mass index for functional exercise, you must have a correspondingly low body fat percentage. Satisfactory body fat percentages for men are between 10 and 22 percent; for women the range is from 20 to 32 percent. Values much outside these normal ranges indicate an excessive body fat percentage. Excessive body fat is associated with increased risk for diabetes, heart disease, cancer, and stroke. There are special scales available that can give you an accurate measure of your body fat percentage through a process called bioimpedance. If you have a high body fat percentage, seek the counsel of a registered dietician. By changing your diet and starting an exercise program, you can decrease your body fat percentage and improve your health.

Cardiovascular Function

The importance of having a risk assessment by a medical professional prior to starting a cardiovascular fitness program cannot be overstated. The goal of the risk factor assessment is to determine if you require further medical testing and treatment prior to starting a cardiovascular exercise program. Your medical provider will be aware of all of the risk factors associated with cardiovascular disease and will inform you if it is safe for you to begin an exercise program.

Once cleared to participate in an exercise program, research has shown that physical activity clearly provides protection against the development or reoccurrence of cardiovascular disease. The benefit of cardiovascular exercise has been demonstrated in nearly all populations.

To properly implement a cardiovascular exercise program, either purchase a heart rate monitor or learn how to check your heart rate manually. Once you are able to monitor your heart rate, and you have determined your exercise heart rate zone by utilizing one of the formulas developed to help you calculate your target exercise heart rate, you are ready to begin. There are many formulas: one is provided below for your use. All formulas take a fixed number and subtract your age or a percentage of your age to give you a theoretical maximum heart rate. Once your maximum heart rate is known, you then take a percentage of your heart rate reserve and add it back to your resting heart rate in order to determine your exercise heart rate. You will need to maintain this heart rate for at least 30 minutes most days of the week.

When first starting an exercise program you will utilize a lower percentage of your Heart Rate Reserve (HHR) when formulating your training heart rate. As your fitness levels increase, you will be able to exercise safely at higher percentages. Commonly, 65% of your (HHR) is a good starting point, and once a reasonable level of cardiovascular fitness has been attained, exercising at intensities of 85 and 90% is common.

One of the more accurate formulas to determine maximum heart rate was published by Gellish et al. in the Journal of Medicine Science Sports and Exercise in 2007. It is as follows: Maximum Heart Rate (MHR)=207−(0.7×age). So a 50 year old person would have a MHR of approximately 172 beats per minute (207−(0.7×50)=172). Once you calculate your MHR you need to determine your resting heart rate (RHR) by taking your pulse in the morning prior to getting out of bed. Subtracting your RHR from your theoretical MHR will give you your heart rate reserve (HRR). You then take a percentage of this HRR and add it to your RHR to determine your training heart rate.

The same 50 year old with a RHR of 72 would have HRR of 100 beats per minute (172−72). For the initial training rate of 65% of HRR, you would multiply the HRR by 0.65, giving you 65 bpm, and then add this to the RHR of 72. This addition gives you an initial training rate goal of 137 (72+65).

Unfortunately, most people use a simplified formula, resulting in an exercise heart rate that is not optimal to improve cardiovascular function.

Device 10

Device 10 is a closed kinetic chain trainer. Its main purpose is to allow the user to offload his body weight, thus enabling the user to perform specific functional exercises that he would otherwise be unable to do. By improving his functional strength the user will see improvements in his sports performance, increased ease of his activities of daily living, improved health metrics, and a decreased risk of musculoskeletal injuries.

Device 10 utilizes rubber strength bands of varying widths attached to device 10 at different locations in order to offload body weight and allow for proper functional motion to take place. These strength bands are approximately 41 inches long which substantially matches the width of the frame. The width of the band determines the level of assistance it provides.

The table below shows an estimate of how much assistance each width of band provides. Keep in mind as the band ages its elasticity will change, and the actual assistance will slowly decline. However, knowing the exact level of assistance provided by the bands is not that important. Remember that the number of repetitions to be done in each overload phase dictates the load required. Use the band that allows the user to perform the appropriate number of repetitions. As a reference only, when these bands are stretched to approximately 2 times their resting length, the estimated level of assistance is given in pounds in the table.

In certain exercises the strength bands can also provide resistance to motion as well as off-loading your weight. This becomes more important in time as the user gets stronger and requires extra loading in the strength phase of your exercise routine.

Device 10 is a very adaptable piece of exercise equipment. The exercises that follow are important in the development of the user's functional strength. The frame and associated band attachment points allow for many more exercises to take place. The user may be creative, but should always remember the rules associated with proper program design.

| Band Size | Band Width | Estimated Assistance |
|---|---|---|
| Very Small | ¼ inch | @ 6 lbs |
| Small | ½ inch | @ 25 lbs |
| Average | 1 and ⅛ inch | @ 50 lbs |
| Large | 1 and ¾ inch | @ 85 lbs |
| Very Large | 2 and ½ inch | @ 100 lbs |

Developing a Properly Designed Exercise Program

The main tenets that should guide anyone in the implementation of an exercise program are specificity, overload, adaptation, rest, frequency, order, and duration. These factors are then configured around the broader concepts of circuit training and targeted training, both of which are discussed at the end of this section. Specificity The specificity principle states that exercises performed in a training routine should closely mimic the movements associated with the sport or activity you wish to improve. This is relevant for all forms of training including strength, flexibility, and cardiovascular endurance. When designing your exercise program, the type, sequence, and velocity of muscle contraction should be similar to what is required in the sport or activity you are attempting to improve. This is one of the main reasons that functional training is so relevant in modern program design.

Overload

The overload principle when applied to the musculoskeletal or cardiovascular system states that in order to have a positive effect on those systems a stimulus needs to be applied that is greater than what those systems are currently capable of handling. This may be accomplished by manipulating the frequency, intensity, or volume of exercise within the program design.

When performing any exercise, form dictates load. With any load, you will only be able to perform the exercise for so many reps with good form. To determine an appropriate training load you will first need to establish a baseline. This will tell you where you are in the continuum of the functional exercise progression. Once you determine how functionally strong you are in a particular movement, then you can establish a training load.

Training loads should be manipulated to allow for the desired adaptation. When first starting any resistance-training program, it is important to allow your connective tissue time to adapt to the stress (tendon adaptation phase). Tendons and ligaments need to have more time under low load tension to adapt to training stimulus; if this doesn't occur, the risk of sprain or strain increases.

To accomplish this tendon adaptation phase you should apply the needed assistance to do the baseline exercise for 15 to 20 repetitions. Assistance is provided by the use of the appropriate assistance strength bands, attached in various configurations, to device 10. Stay in this phase for a few months when you start the program, then slowly increase your load by lessening the assistance given for each exercise. In a given week only one of your workouts should approach maximal intensity. Each subsequent workout session in that week should be done with increased assistance to allow for appropriate recovery. As the level of assistance is increased, it is a good idea to work on your nerve conduction speed.

Once you have allowed for appropriate connective tissue adaptation, the next phase of your program is the hypertrophy phase. In this phase, the stimulus is increased and the muscle fibers begin to adapt to this stress by increasing their size and increasing their ability to produce force.

In the hypertrophy phase you should apply enough assistance to allow for 8 to 15 repetitions. In a given week, as in the connective tissue adaptation phase, only one of your workouts should approach maximal intensity. Each subsequent workout session in that week should be done with increased assistance to allow for appropriate recovery. As the level of assistance is increased, it is a good idea to work on your nerve conduction speed. You should stay in the hypertrophy phase for one month. It is in this phase that you will really start to see the changes in your muscle structure. When you are able to do more than the 15 reps at a given load over the course of successive exercise sessions, it is appropriate to increase the amount of resistance or decrease the amount of assistance in order to remain in the range of reps appropriate for the hypertrophy phase. This is a sign you are getting functionally stronger. The next phase in your program design is called the strength phase.

In the strength phase loads are increased over the hypertrophy phase and volume is decreased. In this phase you should only be able to perform between 4 and 8 repetitions. As in the other phases, only one workout per week should approach maximal intensity. Each subsequent workout should be done with increased assistance and a focus on nerve conduction velocity. When you are able to do more than the 8 reps at a given load over the course of successive exercise sessions, it is appropriate to increase the amount of resistance or decrease the amount of assistance in order to remain in the range of reps desirable for the strength phase. This is a sign you are getting functionally stronger. This phase should last approximately one month.

| Overload Phase | Approximate Load | Approximate # of Reps |
|---|---|---|
| Connective tissue phase | 55% to 65% of max load | 15 to 20 reps |
| Hypertrophy phase | 65% to 80% of max load | 8 to 15 reps |
| Strength phase | 80% to 90% of max load | 4 to 8 reps |

Adaptation

Your body adapts to the stimulus of a constant resistance. Over time, if the stimulus is not changed, your structure will no longer be influenced by that particular resistance. This can lead to overtraining injuries and/or boredom with your progressive resistance exercise program. In some cases a decrease in muscular performance can occur. Detrimental adaptation can be prevented through variation. You can vary a program by changing the load applied as mentioned in the overload section or by doing different exercises in each of the overload phases. For example, if you are in a hypertrophy phase and for the first workout of the week you do split squats, then for the second workout you may want to do step ups. However, changing the training stimulus by cycling through the various overload phases may be the best way to prevent lack of progress associated with limited variability in your program design.

Rest

Unfortunately if you stop exercising for an extended period there is a significant loss in gained adaptations. This loss begins after the first few weeks of stopping an exercise program, and within several months there is a complete loss of the positive adaptations from exercise.

If the frequency/duration of your training program has to decrease for any reason, the intensity of your program becomes the main influence on maintaining the gains you have made in your exercise program. Attempt to exercise at least once weekly at the intensity of the levels attained in your last strength phase. This does not mean that rest is not important. After you have cycled through the phases described in the overload section, it is important that you take 1 or 2 weeks off from your exercise program. This gives your body time to heal and grow. It prepares your body to begin the sequence again. It is all right to stay active in this rest period, but do not perform your resistance training routine.

The result of not taking enough rest in your exercise routine may be overtraining. With overtraining you will notice a decrease in your performance and you will become more susceptible to injuries and illness. The treatment of overtraining is a very long rest period. You will lose most of your gains but you must realize that rest is important in your program design. However, too much rest can lead to a reversal in your objective performance gains.

Frequency

The general guideline for participating in an exercise program is 3 to 5 times per week. This frequency is established based on the minimum exercise sessions required to improve cardio-respiratory function. Gains in muscular performance can be realized by training a minimum of 2 times per week and a maximum of 3 times per week. Thus, the 3 times a week minimum guideline is recommended when accounting for both cardio respiratory and muscular performance.

The frequency of performing a particular exercise within an exercise session is known as the number of sets of that exercise. Thus, depending on the overload phase you are in, 2 to 4 sets of each exercise are required. When starting out in a connective tissue adaptation phase, only 2 sets of an exercise are needed. However, in order to maintain muscle volume, a minimum of 3 sets is required in a hypertrophy phase and 4 sets are needed in a strength phase.

Order of Exercises

When designing your exercise program for a particular session, it is important to sequence your exercises properly. Complex multi-joint exercises should take place prior to simple single joint exercises. Also, if you are circuit training, it is better not to include exercises that work the same muscles in the same grouping. For example, do not include squats and step ups in the same grouping of exercises. In designing a circuit training program your first groupings of exercises should contain all of the complex multi joint movements. Later groupings can contain more simple single joint movements. For example, do not do knee extensions prior to squats.

Duration

Exercise sessions should last from a minimum of 20 minutes to an ultimate goal of 60 minutes. From a cardiovascular standpoint these sessions should be continuous, and your heart rate average after exercise should be close to your desired goal.

Targeted resistance training sessions should not last for more than 60 minutes to promote optimal hormonal response.

Circuit Training

Circuit training is a form of exercise in which resistance training and cardiovascular training are combined in the same workout session. In this form of training you will perform short intervals of cardiovascular exercise between groupings of resistance training exercises.

The goal of circuit training is to increase your heart rate to its training zone and maintain it in this zone for the duration of the exercise session. Circuit training is valuable to improve muscular performance and cardio respiratory function for those who are starting an exercise program or have limited time available to pursue multiple exercise formats in a single session.

When designing your circuit training program the number of exercises performed within each grouping will be determined by which overload phase you are in. When starting out in your connective tissue adaptation phase, the required rest period between exercises is only 30 seconds or less. Exercises like pushups and squats would be sufficient in a grouping, because by the time you've finished 20 pushups and 20 squats, 30 seconds have passed, and you would be able to do your push up exercise again.

In your hypertrophy phase the rest period between exercises is approximately 60 seconds. In a hypertrophy phase grouping, it may be necessary to have 3 exercises in order to allow for sufficient rest between exercises. As your program progresses and you enter your strength phase, the required length of time between doing the same exercise within a group is approximately 2 minutes. In this phase it may be necessary to have up to 5 exercises in a grouping to allow for appropriate recovery time prior to repeating an exercise.

In the strength phase the necessary extended rest period may make it difficult to maintain your heart rate in your training zone; therefore, circuit training may not be the best option when you progress to this phase. Targeted training may be a better option and will be explained next. The groupings of exercises should sequence from complex to simple. Multi joint exercises should be done prior to single joint exercises where applicable.

Targeted Training

Circuit training works best when you are in a progressive resistance exercise phase that requires a high level of volume.

These phases include the connective tissue adaptation and hypertrophy phases. Keep in mind that circuit training is not an optimal way to improve peak cardiovascular function or maximal strength. More focused training is needed if either of these are your goals.

If improving your functional strength is your main goal, then exercise in a focused manner on a particular motion at higher intensities with longer rest periods. However, these longer rest periods would be detrimental in maintaining your heart rate within its training zone. You can still group exercises together and alternate upper and lower body exercises. However, your pace will be slower with a focus on maximal effort and good form.

If improving your cardiovascular function is your main goal, then exercising at intensities approaching 90% of your training zone is required, and this is not easily accomplished by circuit training. You will need to separate your cardiovascular exercise from your functional strength work. Focus on cardiovascular exercise for the desired length of time in your training zone prior to starting progressive resistance exercises. Remember to functionally warm up prior to the start of your exercise program.

Part 1: The Functional Warm Up

Figure 3:
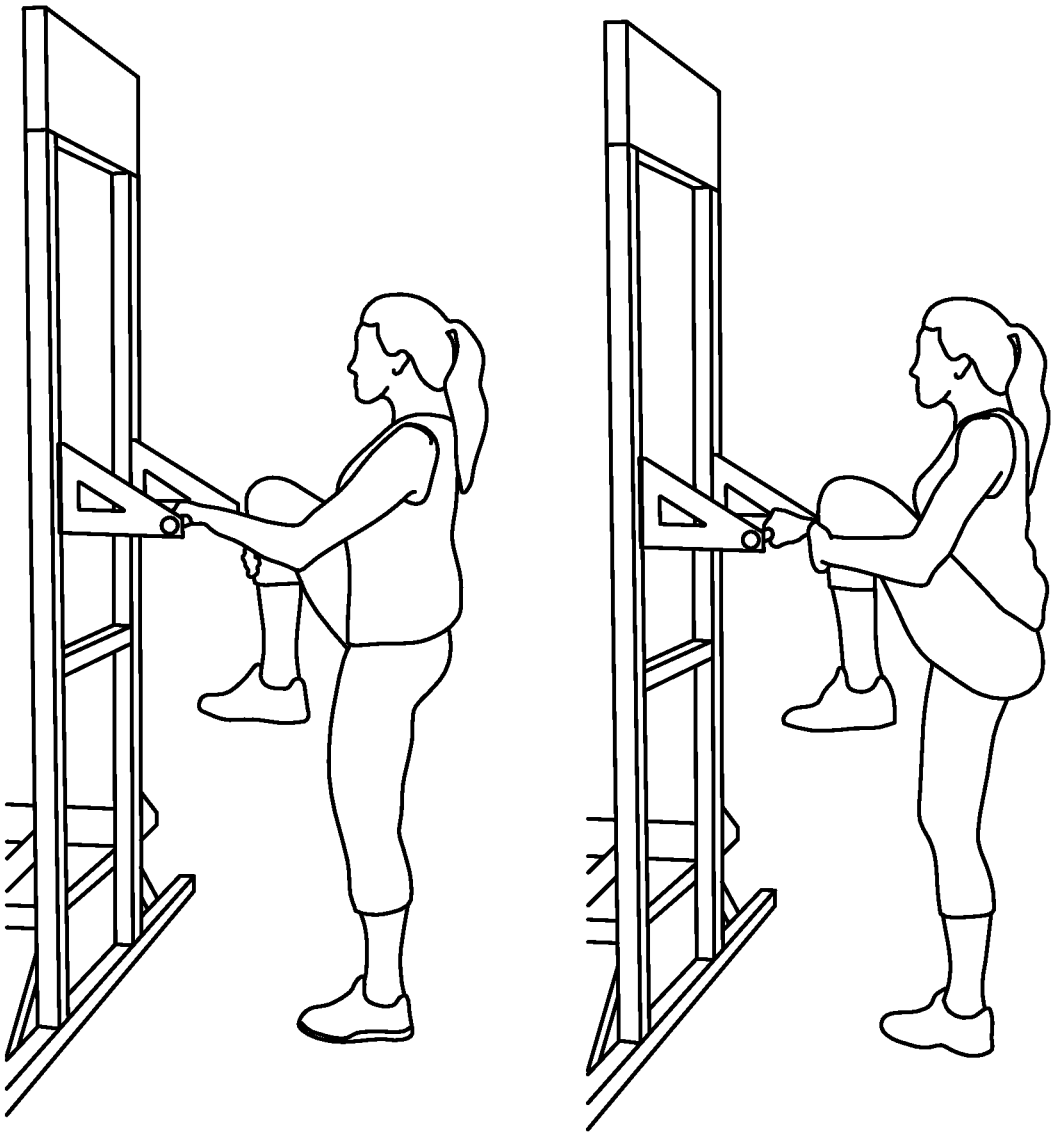
FIGS. 3-40 depict exemplary exercises that can be performed on the device.

High Knee Tuck—FIG. 3

1. Rotate one of the parallel arm bars out of the frame.
2. Face and hold the bar with one out-stretched arm for balance as pictured.
3. Flex the opposite hip with the knee bent, tucking the knee to your chest.
4. Assist the stretch with your non-supporting hand below the tucked knee as shown.
5. Alternate stretch and hand holds.
6. Repeat 5 times on each leg and hold for 30 seconds.
7. As your balance improves, attempt to do the warm up movements without a hand hold.
8. Keep your hand near the bar for balance assistance if needed.

Part 1: The Functional Warm Up

Figure 4:
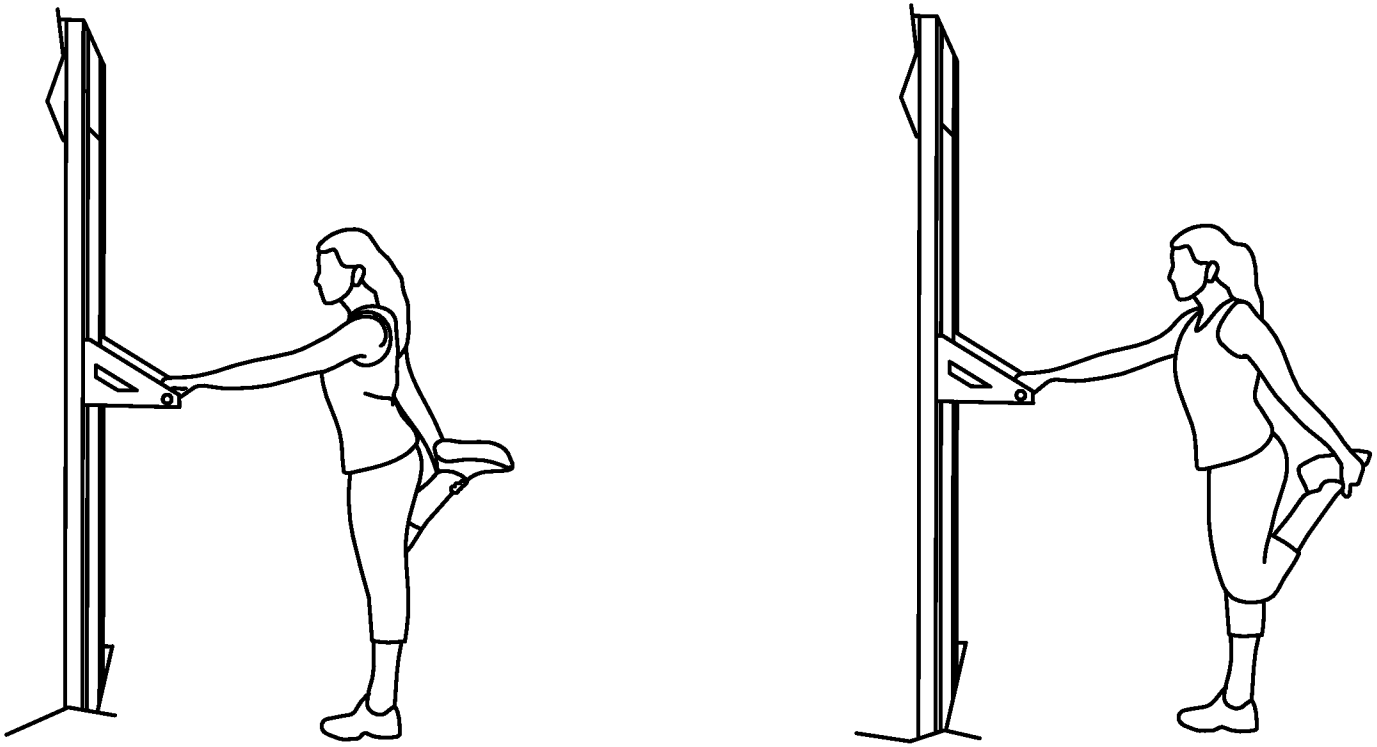

Heel Kicks—FIG. 4

1. Rotate one of the parallel arm bars out of the frame.
2. Face and hold the bar with one out-stretched arm for balance.
3. Actively contract the opposite hamstring bringing your heel to your buttock.
4. Use the non-supporting arm to assist the stretch of the front of the thigh.
5. Alternate stretch and hand holds.
6. Repeat 5 times on each side and hold for 30 seconds each.
7. As your balance improves, attempt to do the warm up movements without a hand hold.
8. Keep your hand near the bar for balance assist if needed.

Part 1: The Functional Warm Up

Figure 5:
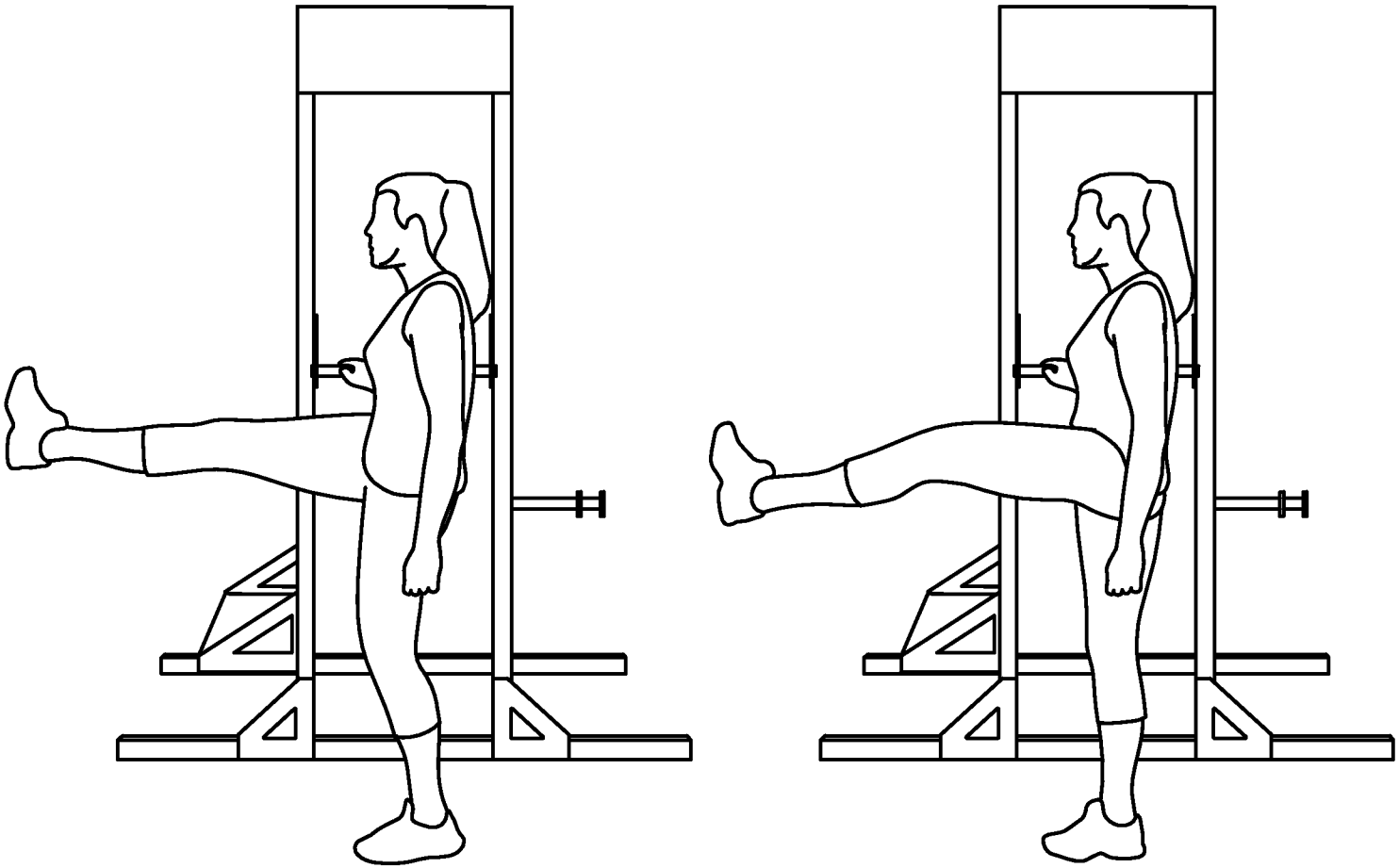

Straight Leg Kicks—FIG. 5

1. Rotate one of the parallel arm bars out of the frame.
2. Stand parallel to the bar holding on to the bar with the closest hand.
3. Balance on the stance leg, this will off load the kicking leg.
4. Keeping the knee as straight as possible, kick the non stance leg forward/up.
5. Repeat 5 kicks on each leg and hold in the up position for 5 seconds each.
6. As your balance improves, attempt to do the warm up movements without a hand hold.
7. Keep your hand near the bar for balance assistance if needed.

Part 1: The Functional Warm Up

Figure 6:
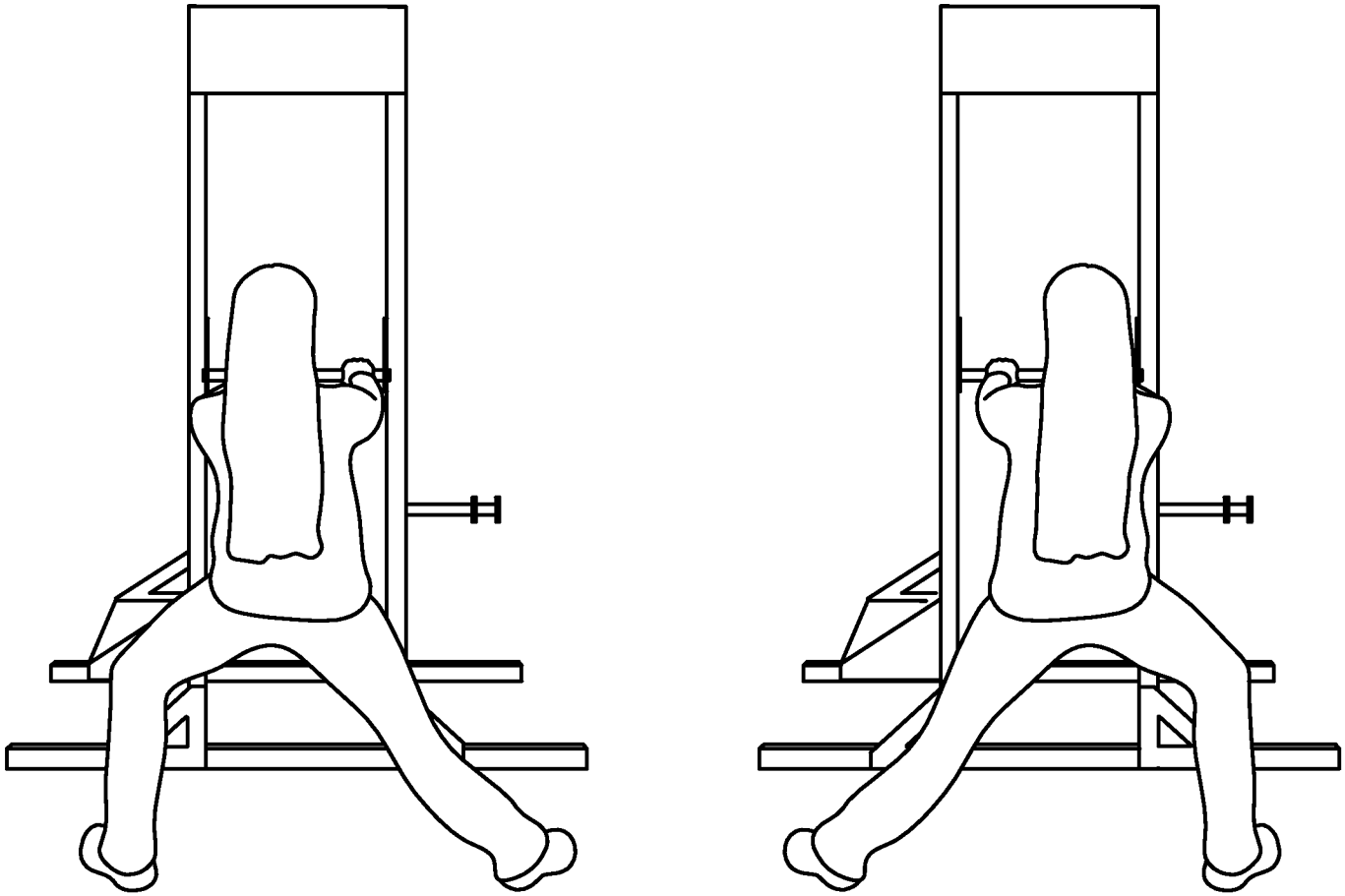

Lateral Squat—FIG. 6

1. Rotate one of the parallel arm bars out of the frame.
2. Face and hold the bar with both arms for balance.
3. Stand with your feet wide apart.
4. Lean and squat in one direction while keeping the opposite leg straight.
5. A stretch should be felt in the groin of the straight leg.
6. Shift weight to the other leg; squat and stretch the other groin.
7. Repeat the stretch 5 times in each direction and hold for 30 seconds each.
8. As your balance improves, attempt to do the warm up movements without a hand hold.
9. Keep your hand near the bar for balance assistance if needed.

Part 1: The Functional Warm Up

Figure 7:
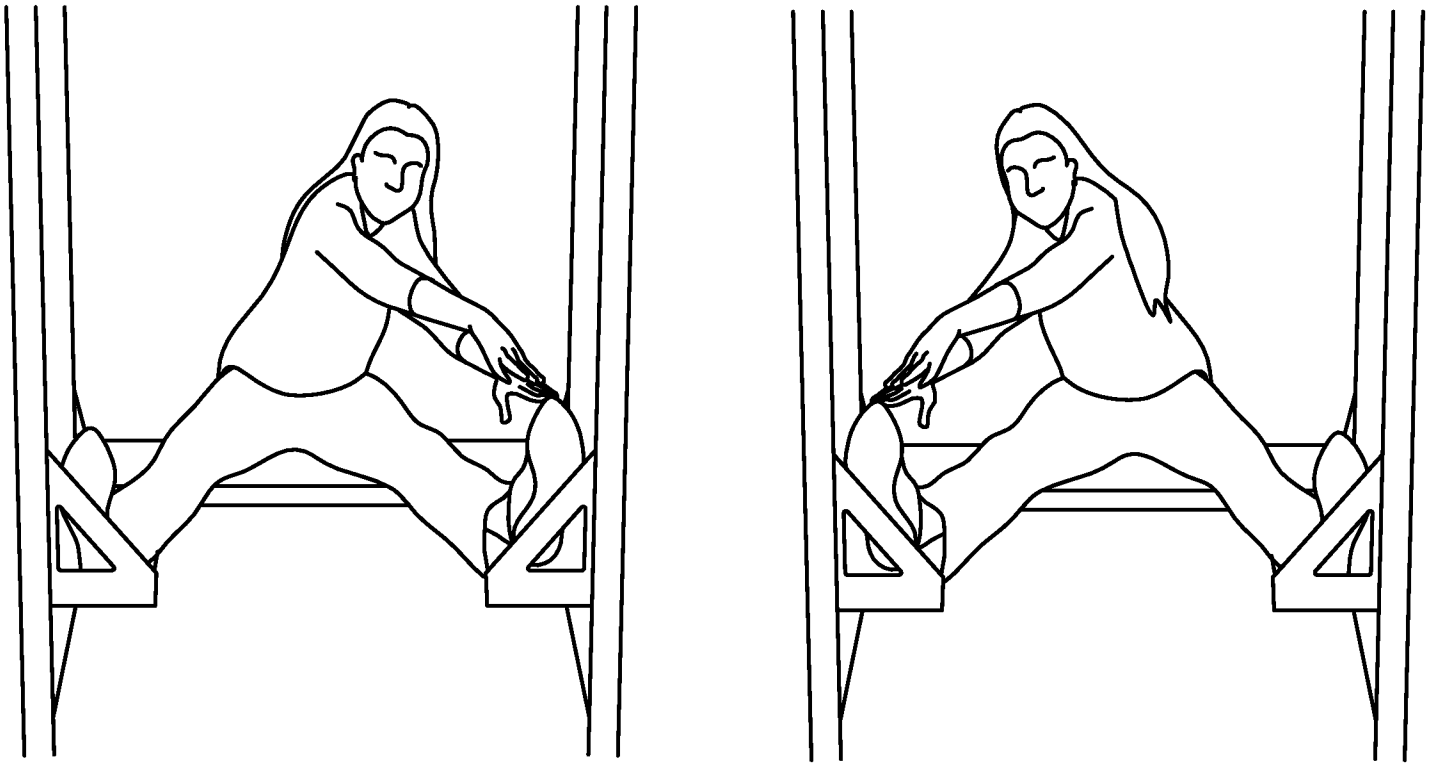

Spinal Bending and Rotation—FIG. 7

This is a good stretch for "opening up" your low back. Be careful with this stretch if you have been diagnosed with a lumbar disc herniation.

1. Sit on the back step with your legs straight and supported on each of the side steps.
2. By keeping your knees straight your hamstring muscles will tether your pelvis, thus focusing the stretch in your low back.
3. Alternate reaching your hands towards each foot.
4. Repeat the sequence 5 times on each foot holding the stretch for 30 seconds.
5. Finish the stretch by bending forward toward the floor.

Part 2: Lower Extremity Exercises

A Word About the Squat

Lower body functional strength training begins with the squat. Learning to squat properly is a difficult task. As our society has become more sedentary, our inability to squat properly has contributed to the excessive amounts of spinal and lower extremity joint disease.

Ask most people to squat, and you will observe excessive amounts of forward spinal bending. The spine should be held in a straight and stable position when squatting. Excessive spinal motion is caused by functional lower extremity muscle weakness and poor lower extremity joint control. This muscle weakness and poor joint control make it much easier to bend your spine forward in an attempt to lower your center of gravity within your base of support than it is to bend your hips and knees appropriately to allow the same motion without bending the spine. The tiny joints and muscles associated with our spinal column are not designed to be heavy lifters. In time the spinal joints and discs break down due to these excessive stresses, thus leading to disk and facet joint disease. What once seemed easy becomes impossible. Squatting with improper knee position can cause the knee cap to track abnormally, leading to patella femoral joint disease. This is common with females who are biomechanically challenged to maintain proper outward knee position with squatting due to their naturally wider hips. Excessive amounts of shear at the knee due to bending the knee too far forward during the squat places a great deal of stress on the knee ligaments, contributing to sprains.

Ask most people where their hips are, and they will touch the outside of their pelvis or lateral thighs. In reality your hip joint is within your groin. Becoming aware of your hip is the first step towards using it correctly. In our sedentary society this lack of hip use and awareness leads to disuse atrophy of the associated musculature. This causes excessive joint stresses to occur with the normal dissipation of ground reaction forces that occur with most activities of daily living. This excessive joint stress leads to joint disease and osteoarthritis.

It should be clear that learning to squat properly is extremely important. Learning to squat properly on both legs is important to manipulate stationary loads. However, learning to improve functional motion that takes place on one leg is another challenge. In the following description you will learn to use your lower extremities functionally and with proper form. Have fun and realize that with time and practice it will get easier. Do not progress to single leg multi joint motions until you have mastered the components of the bilateral squat. Many of the same components of the bilateral squat carryover to single leg versions.

Part 2: Lower Extremity Exercises

Figure 8:
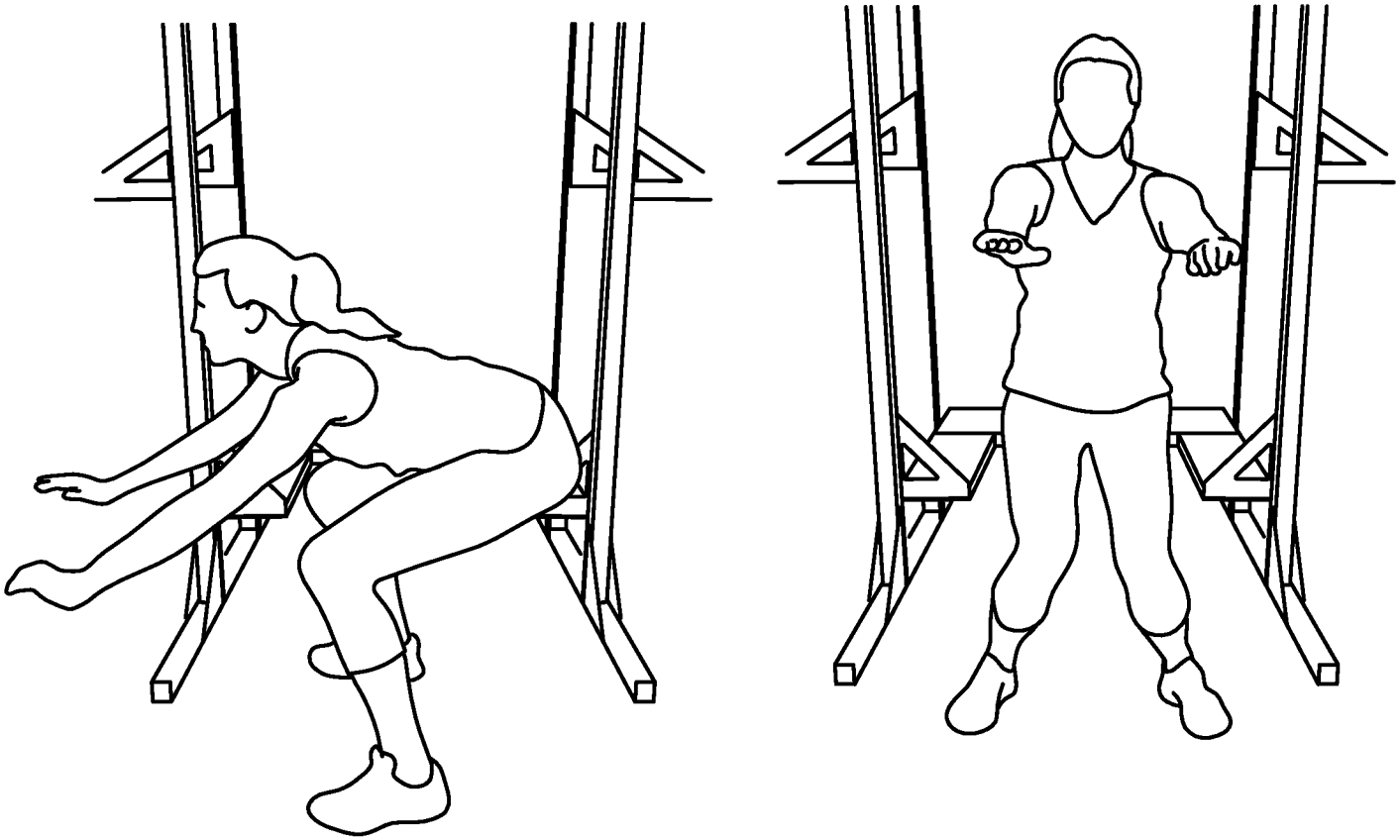

Example of poor squat form—FIG. 8 (left)—Knees are not Pushed Forward

Example of poor squat form—FIG. 8 (right)—Knees are not held over feet

Figure 9:
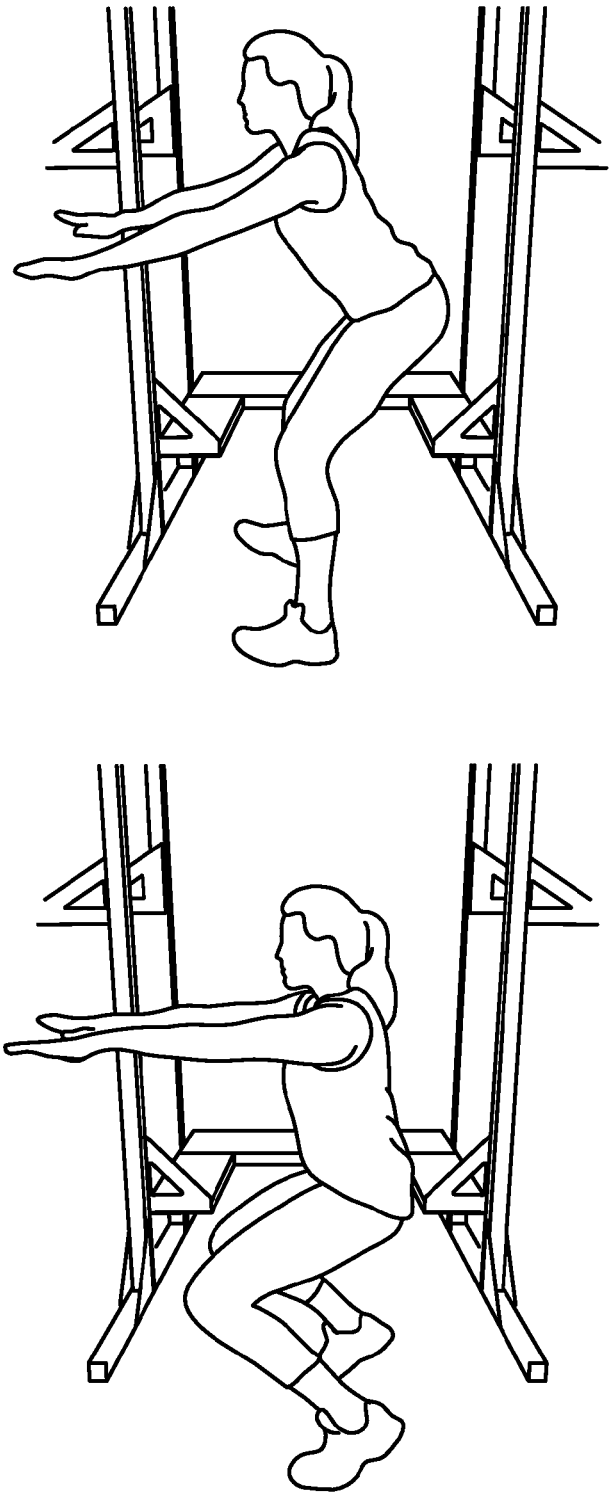

Examples of poor squat form—FIG. 9 (top)—Poor lower body strength/joint awareness 1. Lack of knee and hip bending causes toes to lift off the floor and the feeling of falling backward.

2. This causes an inability to squat as your center of mass is behind your base of support.

3. This form is indicative of hip and knee joint weakness.

Examples of poor squat form—FIG. 9 (bottom)—Knees pushed too far forward

1. Excessive knee bending in order to maintain your center of gravity within your base of support. (Notice, however, the proper spine position.)

2. This causes excessive wear on your knee ligaments as they are not designed to dissipate excessive shear forces.

3. This form is indicative of hip muscle weakness and poor joint position awareness.

Part 2: Lower Extremity Exercises

Figure 10:
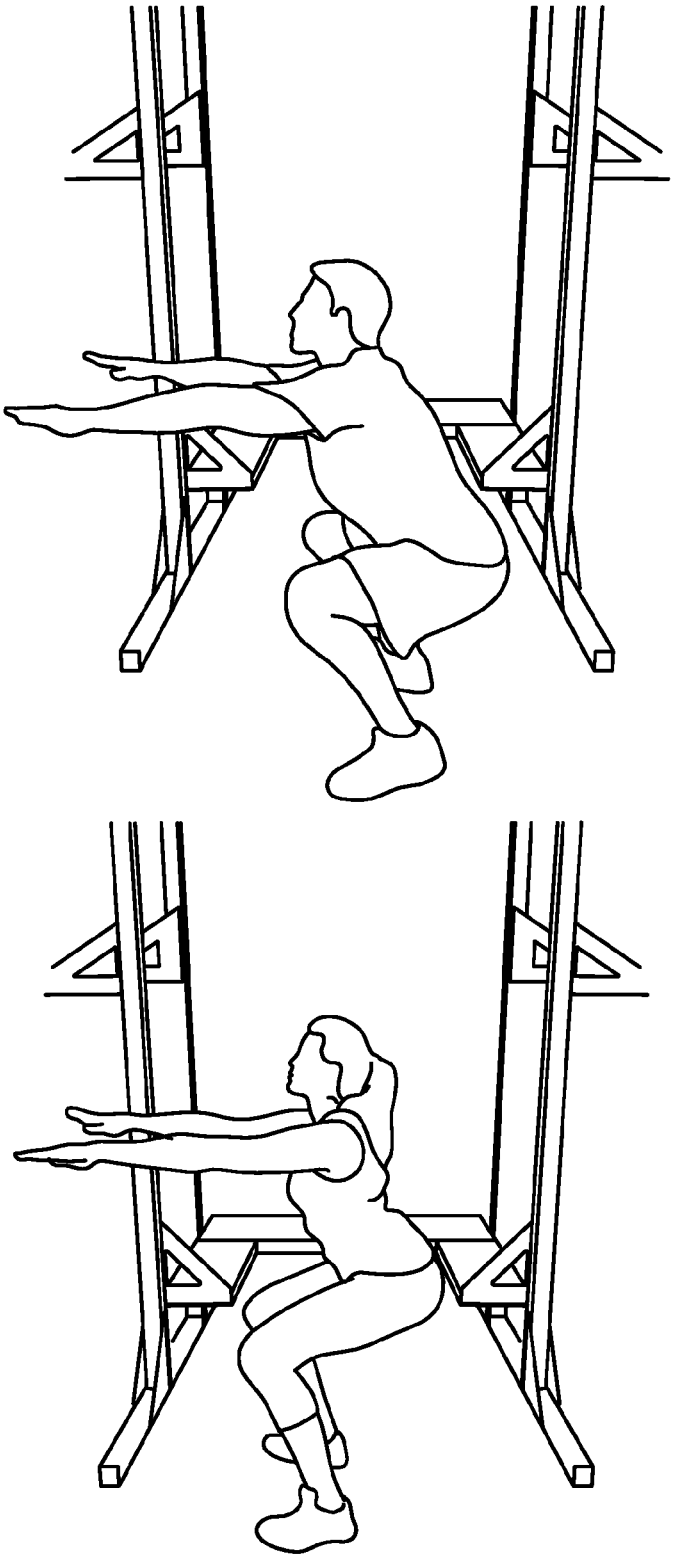

The Correct Squat Form—FIG. 10 (top)

1. The knees are pushed forward to the outside of the foot.

2. Knees and hips then bend simultaneously to allow your center of gravity to drop within your base of support.

3. The spine is kept straight, with a slight lean, and stabilized by contracting the core musculature.

4. The arms extend forward to counter-balance a posterior position of your center of gravity within your base of support.

5. If you are unable to get your body into this position, then you require assistance with this exercise.

The Unassisted Squat—FIG. 10 (bottom)

The Unassisted Body Weight Squat

This is a fundamental lower extremity exercise. It exercises the hamstrings, gluteus, quadriceps, and core stabilizers. It is important that you have normal calf and hamstring flexibility to do this exercise with good form.

1. Place your feet slightly wider than shoulder width apart for shorter users and even wider for longer-legged users. The wider your base of support, the less you have to drop your center of gravity within your base of support.

2. Breathe in to help stabilize your spine, and initiate the motion by pushing your knees forward over the outside of your feet until it feels like your heels are going to come off the floor.

3. Your knees should stay in this position during the squat. Next, begin to bend your knees and hips so your center of gravity is dropping straight down and slightly back. You should feel your weight shifting back towards your heels.

4. Keep your spine straight. Do not lean forward.

5. Continue to squat until your thighs are almost parallel to the floor. Taller users will have to adjust the width of their stance to attain this due to their lower extremity biomechanics.

6. While keeping your back muscles tight, ascend from the squat by driving your heels into the floor, causing your hips to rise up and forward. Exhale slowly.

7. Perform the desired number of repetitions as determined by the overload phase you are in.

Part 2: Lower Extremity Exercises

Figure 11:
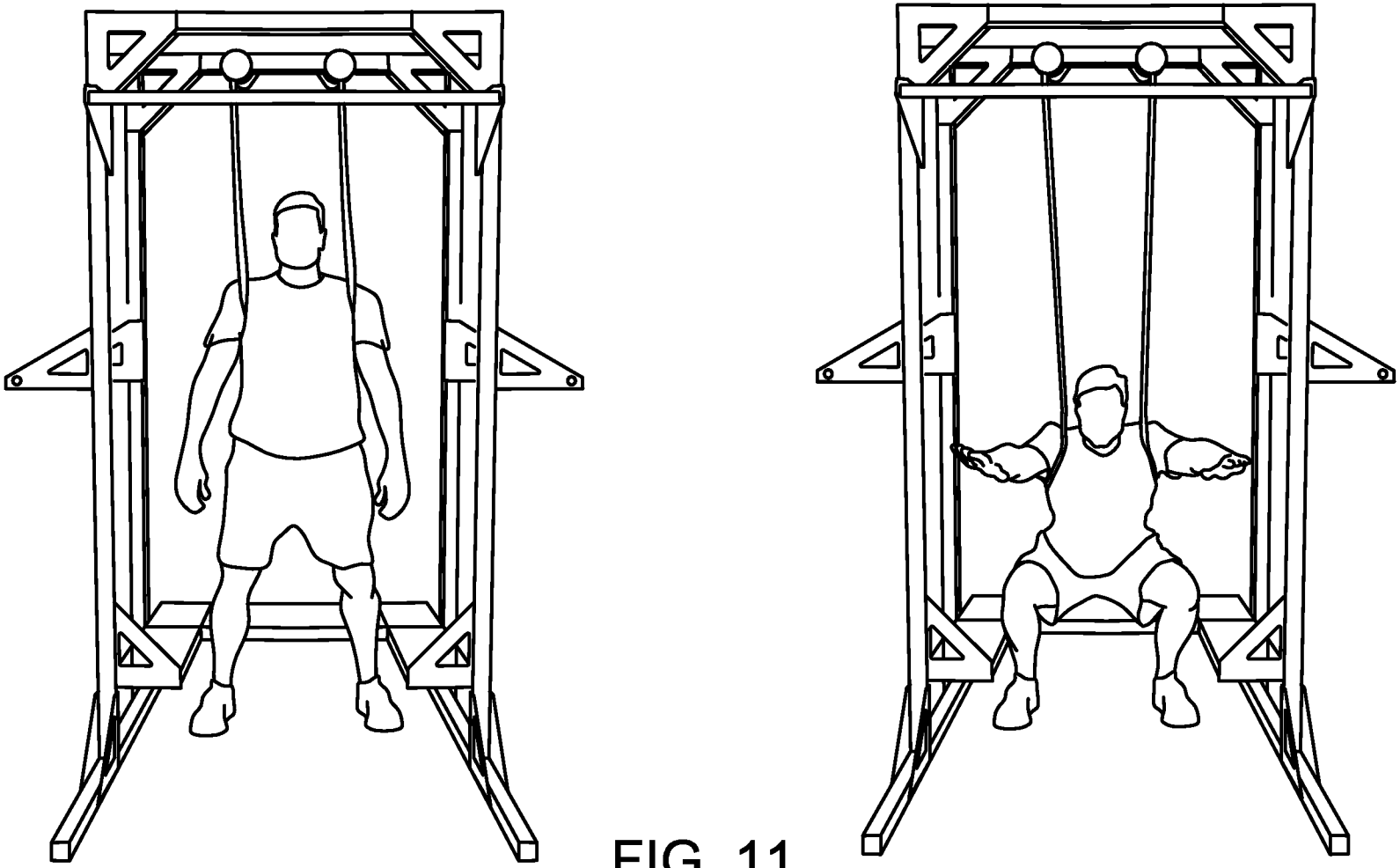

Assisted Bilateral Squat—FIG. 11

This exercise trains the same muscles as the unassisted version of the exercise, but offloads your body weight to allow you to squat with proper form.

1. Place the elongated band holders on the back upper horizontal frame facing forward, shoulder width apart as pictured.

2. Place the appropriate hanging band under your arms and around your back as shown. Optionally, some will find it easier to do the assisted squat if you loop the band around your chest and then under your arms. There is no correct way. Loop the band whichever way helps you maintain your balance and allows for proper form. To make this easier, you may first stand on the step to place the band; then step down.

3. Stand in the frame with your feet slightly wider than shoulder width apart for shorter users and even wider for longer legged users. The wider your base of support the less you have to drop your center of gravity within your base of support 4. Follow the directions for proper squat form as described above.

5. Perform the desired number of repetitions as determined by the overload phase you are in.

Part 2: Lower Extremity Exercises

Figure 12:
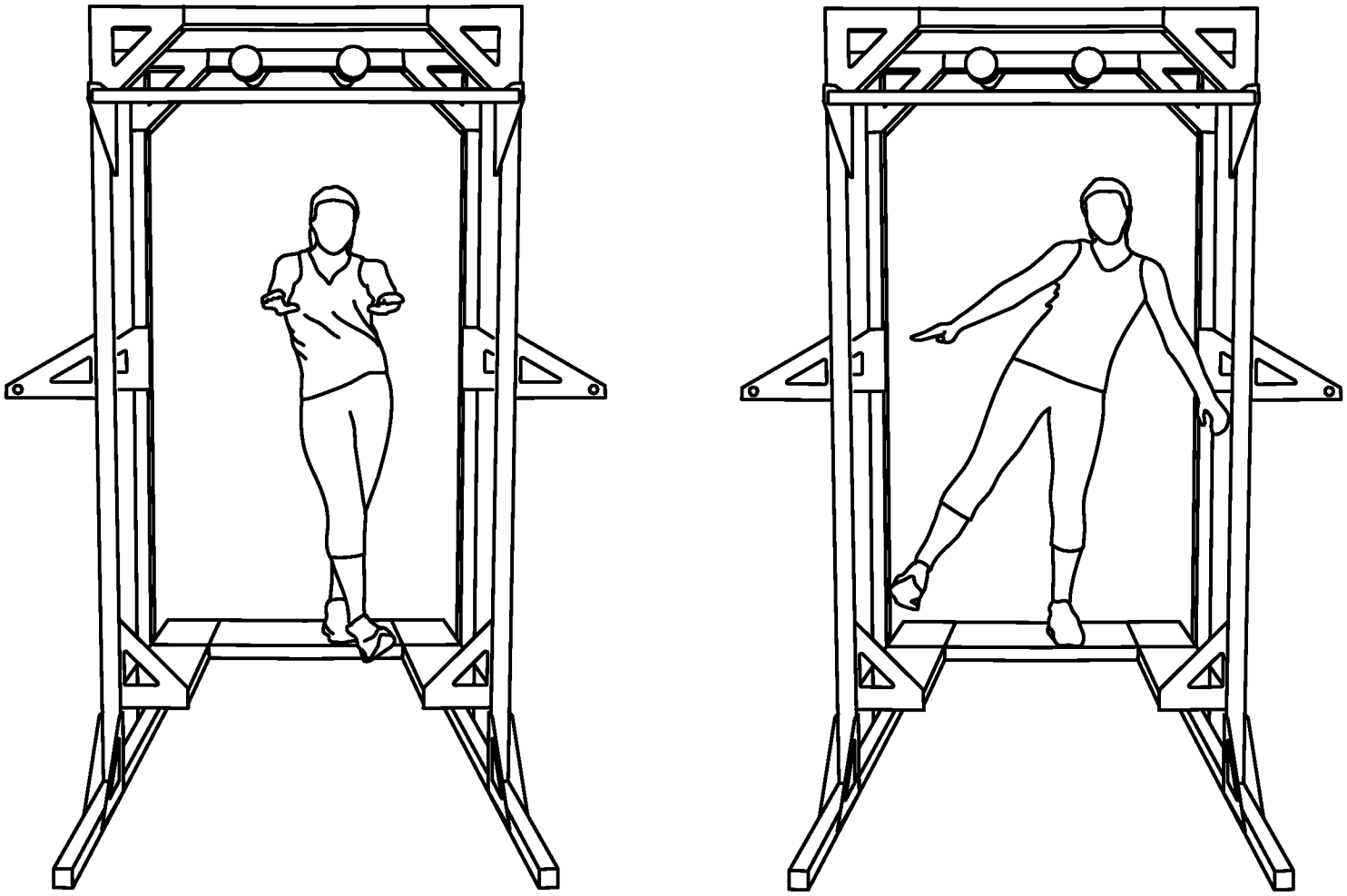

Developing Single Leg Strength—FIG. 12 Usual Faults—Pictured Left

The pelvis is held too high—Pictured Right—The pelvis is allowed to drop.

Both faults are a sign of gluteus weakness

Developing functional single leg strength is essential to improvement in most sports, balance, quality of life, and in injury prevention. A simple observation is the basis for this statement. How many activities do you perform in which both feet are in contact with the ground doing the same thing at the same time? The answer is very few. Most activities take place with one leg eccentrically absorbing load while the other is concentrically overcoming it. This functional dance that takes place between your lower extremities with motion is important to strengthen and refine.

We know through the principle of specificity that single leg strength is best developed through single leg progressive resisted exercise. Exercises done on both legs do not require the same muscle action in the hip and core muscles that is needed with single leg versions of the same exercise.

It is well known that deviations in normal functional alignment during single leg motion are a common cause of many lower extremity injuries. For this reason alone, developing single leg strength is critically important and is often ignored in mainstream strength training programs.

Pictured above are examples of common faults observed when standing on one leg. To stand on one leg and squat, you must first be able to maintain a level pelvis when standing on one leg. If unable to do so, then developing the strength in the hip and core muscles to sustain this position is critical. The hip hiker exercise and the lying hip extension exercise will help accomplish this.

Part 2: Lower Extremity Exercises

Figure 13:
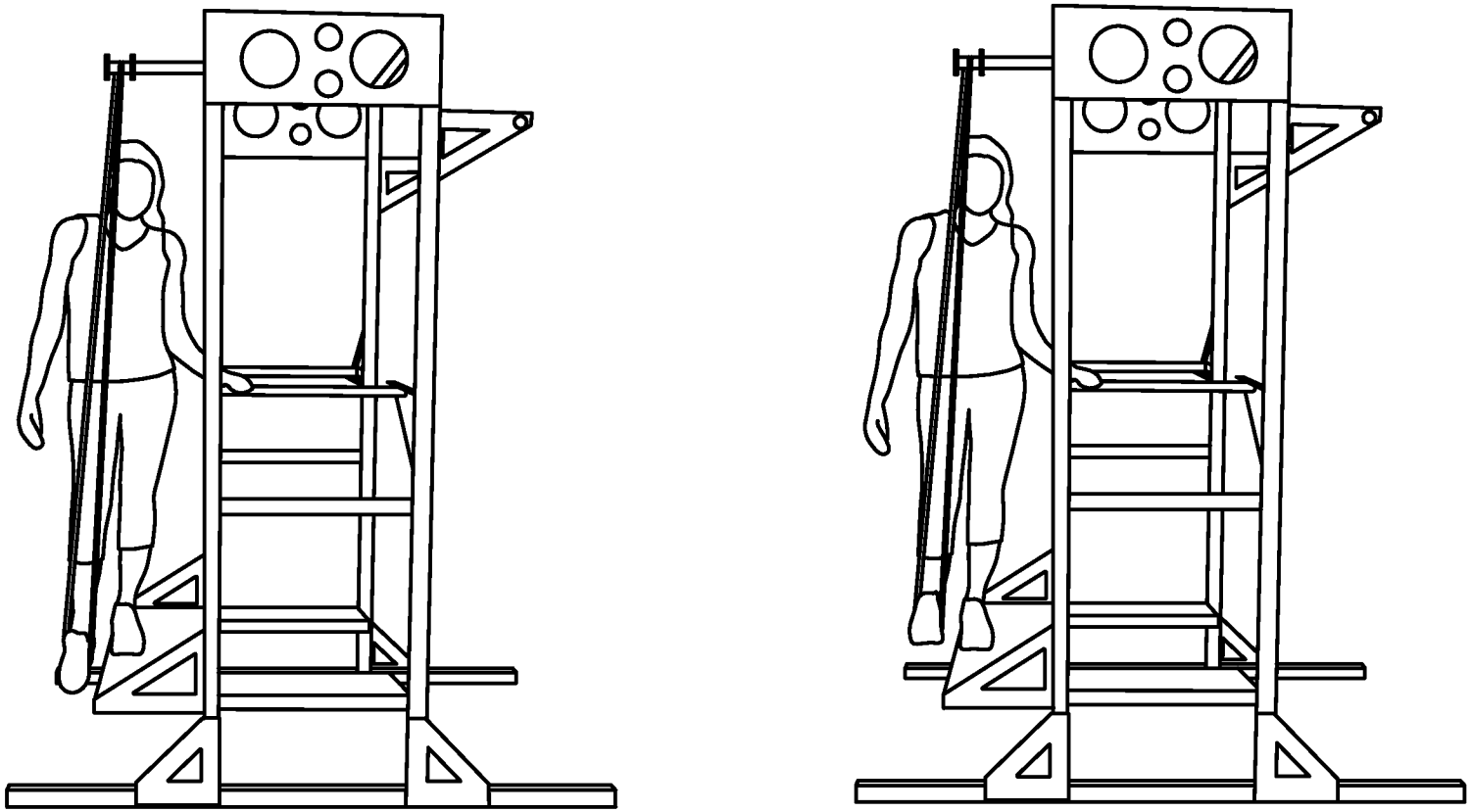

Hip Hiker—FIG. 13

This is an important exercise to develop medial gluteus strength. Medial gluteus strength is critical in the maintenance of a level pelvic table during most functional movement. The strength training progression is with assistance, body weight, and finally with resistance.

Assisted Hip Hiker

1. Stand with on leg on the back step and the other off as pictured.
2. Keep both knees straight during the exercise.
3. Place a elongated band holder facing backward on the back upper horizontal frame.
4. Hang a strength band around the holder and step into it with the leg off the step
5. Rotate the arm bars into the frame if needed for balance assist.
6. Let the non-stance leg's hip fall in a downward motion.
7. As the hip falls the band will stretch. It is a piston motion between the two legs.
8. Contract the stance side leg's gluteus musculature to lift the opposite pelvis.
9. The stretched band will assist the motion of lifting the pelvis.
10. Lift the pelvis until it is level.
11. Perform the desired number of repetitions as determined by the overload phase you are in.
12. Repeat the exercise on the opposite extremity as per above.

Part 2: Lower Extremity Exercises

Figure 14:
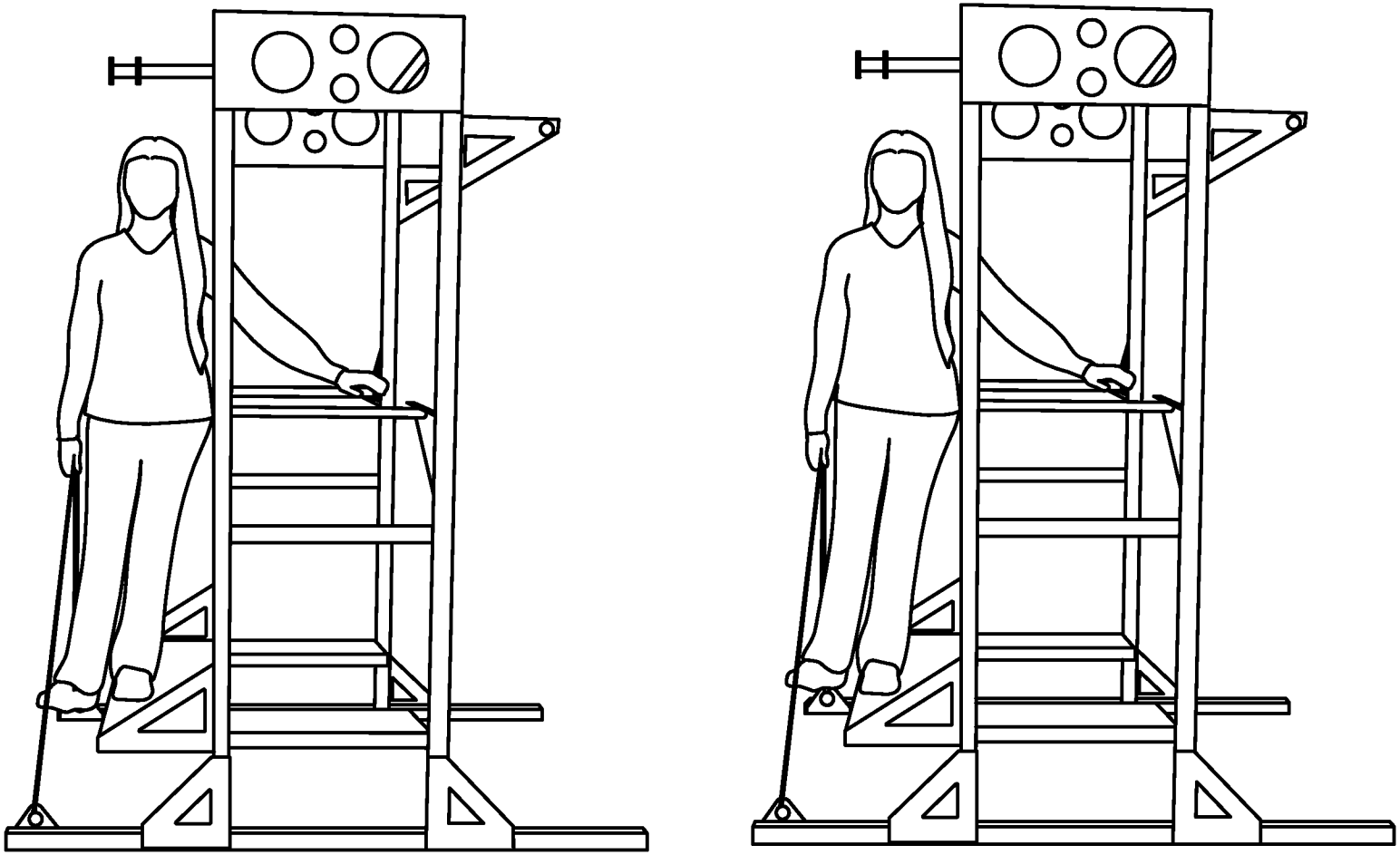

Body Weight and Resisted Hip Hiker—FIG. 14

Resisted Hip Hiker

1. Place the small band holders on the bottom posterior frame, Attach a strength band to these holders across the frame as pictured.
2. Position your body as in the assisted body weight hip hiker.
3. Hold the strength band in your hand on the side of the floating leg.
4. When lifting your pelvis by contracting the stance leg's gluteus, the band will provide resistance.
5. Remember to keep the legs straight. It is a piston-like motion through the pelvis.
6. Perform the desired number of repetitions as determined by the overload phase you are in.
7. Repeat the exercise on the opposite extremity as per above.

Body Weight Hip Hiker

1. The body weight hip hiker positioning is the same as the resistive version, but without the use of the strength band hold.
2. Perform the desired number of repetitions as determined by the overload phase you are in. Repeat the exercise on the opposite extremity.

Part 2: Lower Extremity Exercises

Figure 15:
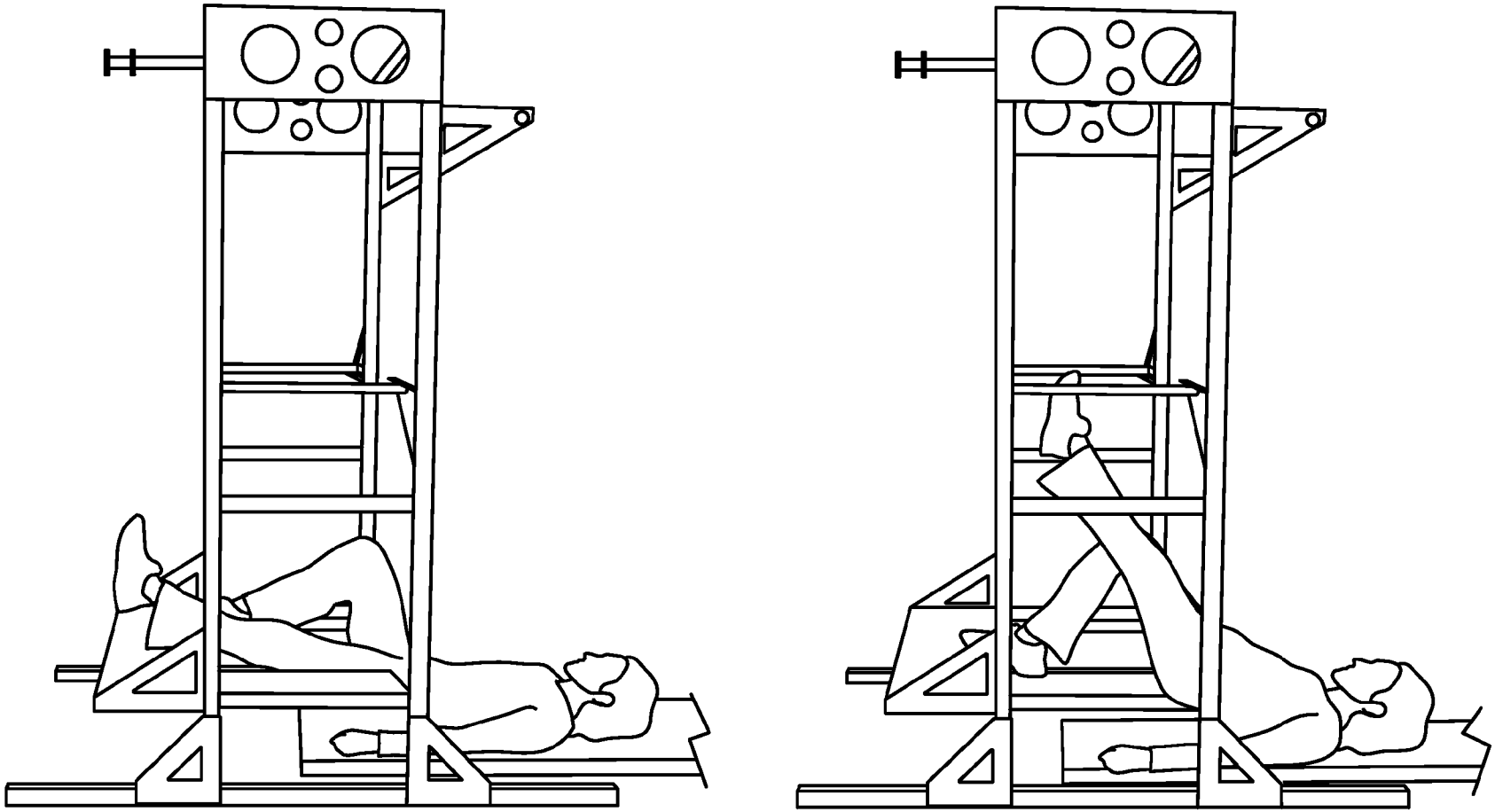

Lying Single Bent Knee Hip Extension—FIG. 15

Learning to bend your hips and not your knees when squatting is very difficult. This is a good exercise to begin the learning process. This exercise strengthens your gluteus.

Body Weight Lying Single bent Knee Hip Extension

1. Lie on your back inside the frame.
2. Place one foot on the back step by bending the knee as pictured above.
3. Hold the other leg straight and off the step as pictured.
4. Attempt to maintain a neutral spine by tightening your core muscles.
5. Lift your center of mass off the floor by driving your foot into the step.
6. As you lift your hips, focus on squeezing your buttock muscles.
7. Keep your pelvis level. Do not let it lean to the non-supported side.
8. Lift your hips until they are straight and level.
9. Perform the desired number of repetitions as determined by the overload phase you are in.
10. Repeat the exercise on the opposite extremity as per above.

Assisted Lying Single Bent Knee Hip Extensions

1. Position and sequence as per above, but place an assist band (hanging from the front upper horizontal frame) around your hips before lying down as pictured.

Part 2: Lower Extremity Exercises

The Step Up

As you are able to stand on one leg and maintain a level pelvis then progression into motions that require knee and hip bending with a level pelvis is recommended. The exercises start from the easiest (step up) and progress to hardest (single leg squat). This exercise strengthens your gluteus, hamstrings, and quadriceps.

Figure 16:
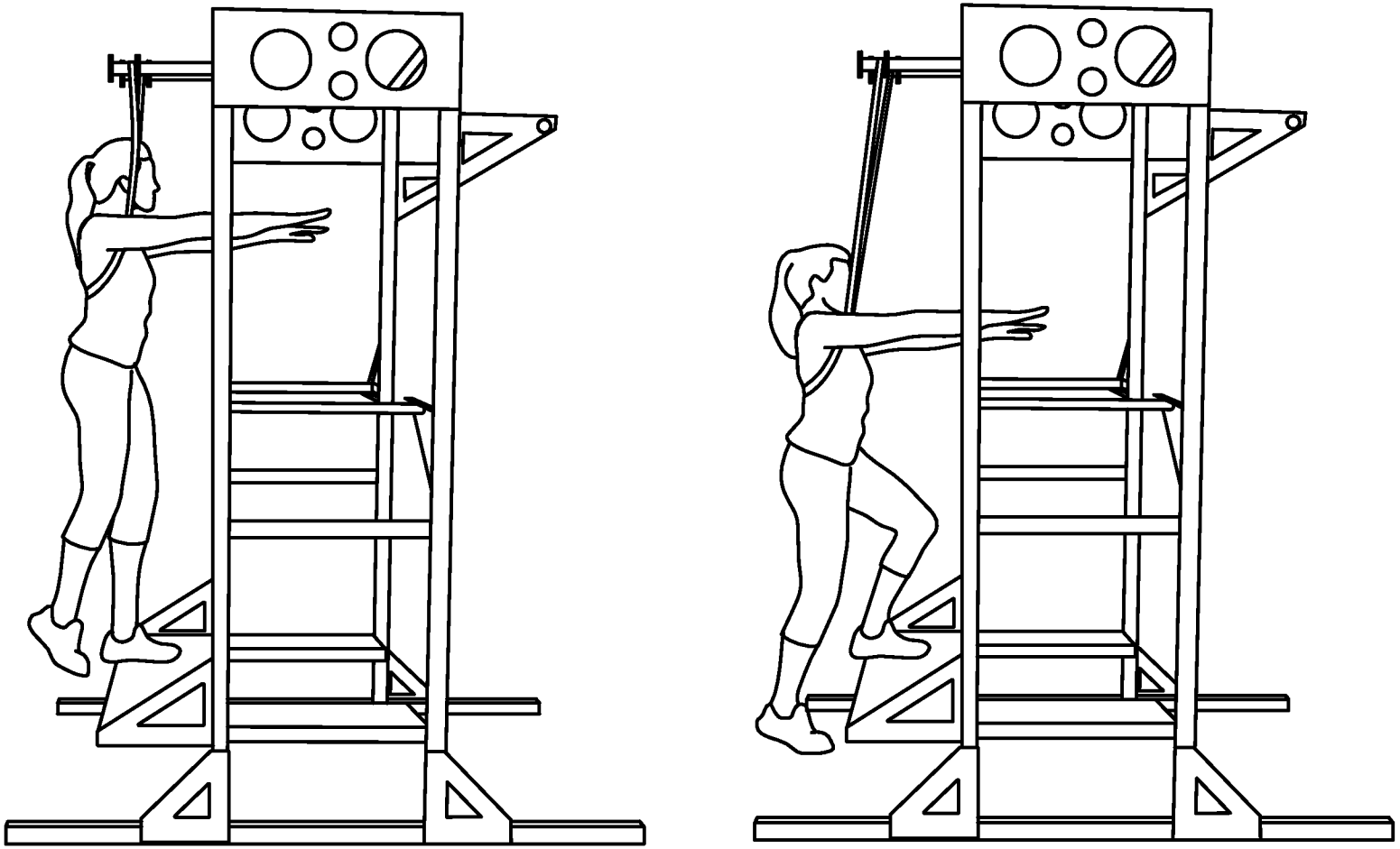

Step Ups—FIG. 16

Assisted Step Ups

1. Place the elongated band holders on the back upper horizontal frame facing backward shoulder width apart.
2. Place the hanging band under your arms and around your back. To make this easier, you may first stand on the step to place the band, and then step down.
3. Facing forward, place one foot on the step and keep the other one on the ground.
4. Begin as with the squat, pushing the knee forward and over the outside of the foot on the step until you feel as though your heel is going to lift up off the step.
5. Lift your arms straight out in front of you at shoulder height and inhale.
6. Keeping your head up and your chest out, push your foot into the step
7. Your weight will shift back towards your heel as your opposite foot comes off the ground. This is normal. Drive the heel into the step.
8. As the leg on the step is loaded, be careful to keep your knee over the outside of the foot. Do not let it migrate inward. Focus on keeping your hips level.
9. Finish the step up by completely straightening out the leg on the step. Do not place the opposite leg on the step. Balance on the support leg.
10. Lower yourself down slowly and with control to complete the repetition.
11. Perform the desired number of repetitions as determined by the overload phase you are in.
12. Repeat the exercise on the opposite extremity as per above.

Body Weight Step Up

1. Perform this exercise with the same positioning as the assisted version, but without the use of the assistive strength band.

Part 2: Lower Extremity Exercises

Figure 17:
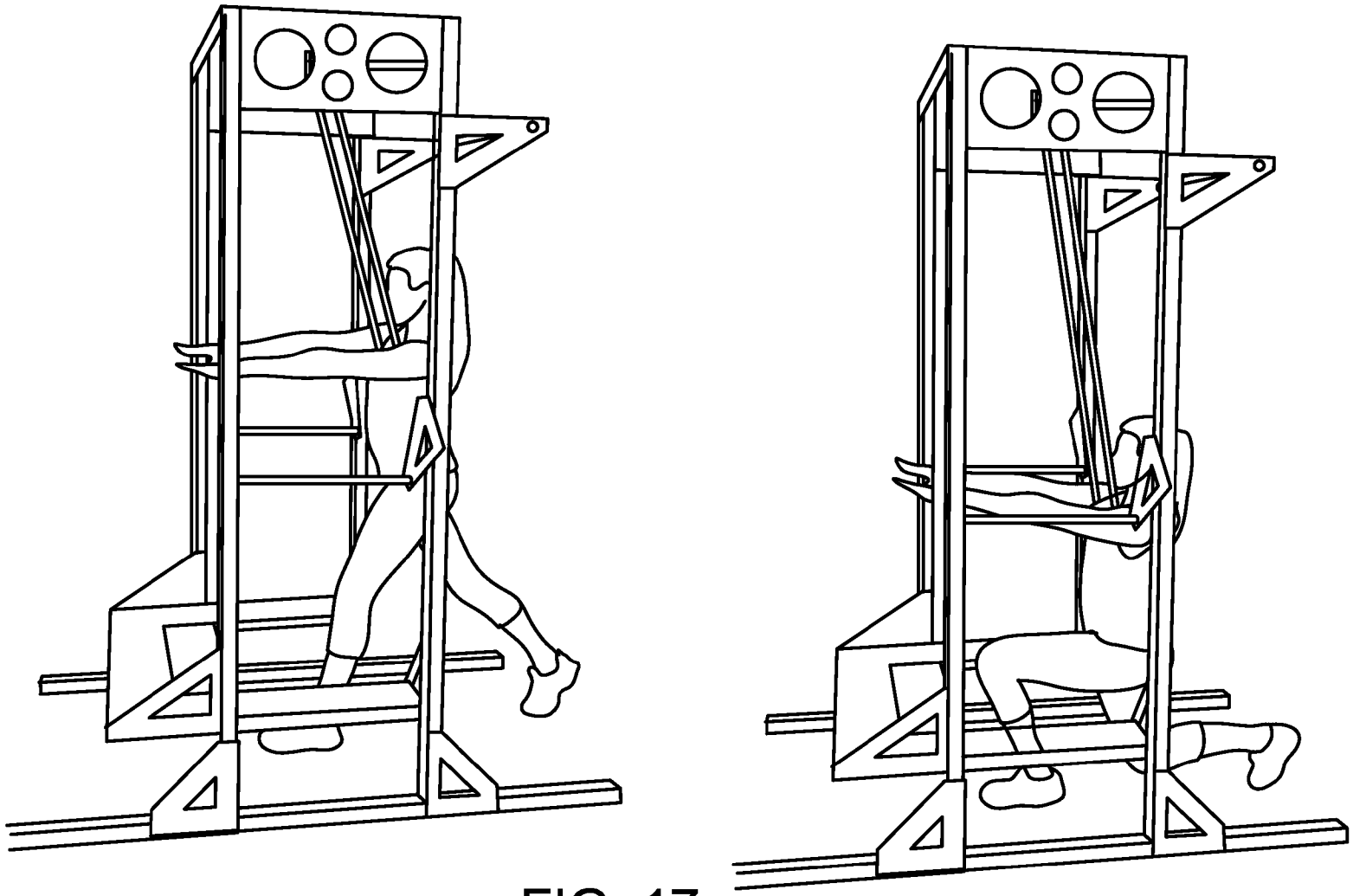

Split Squat—FIG. 17

Assisted Split Squat

1. Place the elongated band holders on the front upper horizontal frame facing backward, shoulder width apart.
2. Place the hanging band under your arms and around your back. To make this easier, you may first stand on the side steps to place the band, and then step down.
3. Stand with your feet apart as pictured above.

4. Breathe in and begin to lower your hips straight down. Keep your torso straight.

5. The forward leg's knee should stay over your ankle and not bend past the toes.

6. The back leg's knee should bend and lower slightly touching the floor.

7. Focus on maintaining a level pelvis. Keep the forward leg's knee over the lateral foot.

8. Once the back leg's knee touches the ground, you will feel a stretch in the quad: drive the forward leg's heel into the ground raising your center of mass.

9. Focus on bending the hips. Keep your back in a neutral position.

10. Perform the desired number of repetitions as determined by the overload phase you are in. Then repeat on the opposite leg.

Body Weight Split Squat

1. This exercise is performed in the same manner as the assisted version but without the use of the assist/strength band. It is important to be able to perform this exercise with proper form prior to progressing to the foot-elevated version.

Part 2: Lower Extremity Exercises

As you become competent in the split squat you will be able to transition into movements that will lessen the contribution of the back leg in providing balance. You will accomplish this by placing your back leg on the assistance band, which is unstable. Thus it will not provide as much support as having both legs on the ground at the same time. As the foot elevated split squat gets easier, lessen the assistance of the support band. This will increase the load on the front leg and prepare you for the single leg squat.

This exercise works the same muscles as the split squat, but with increased instability, placing more stress on the forward legs hip stabilizers.

Set up the exercise as pictured, noting the elongated band holders and strength band.

Figure 18:
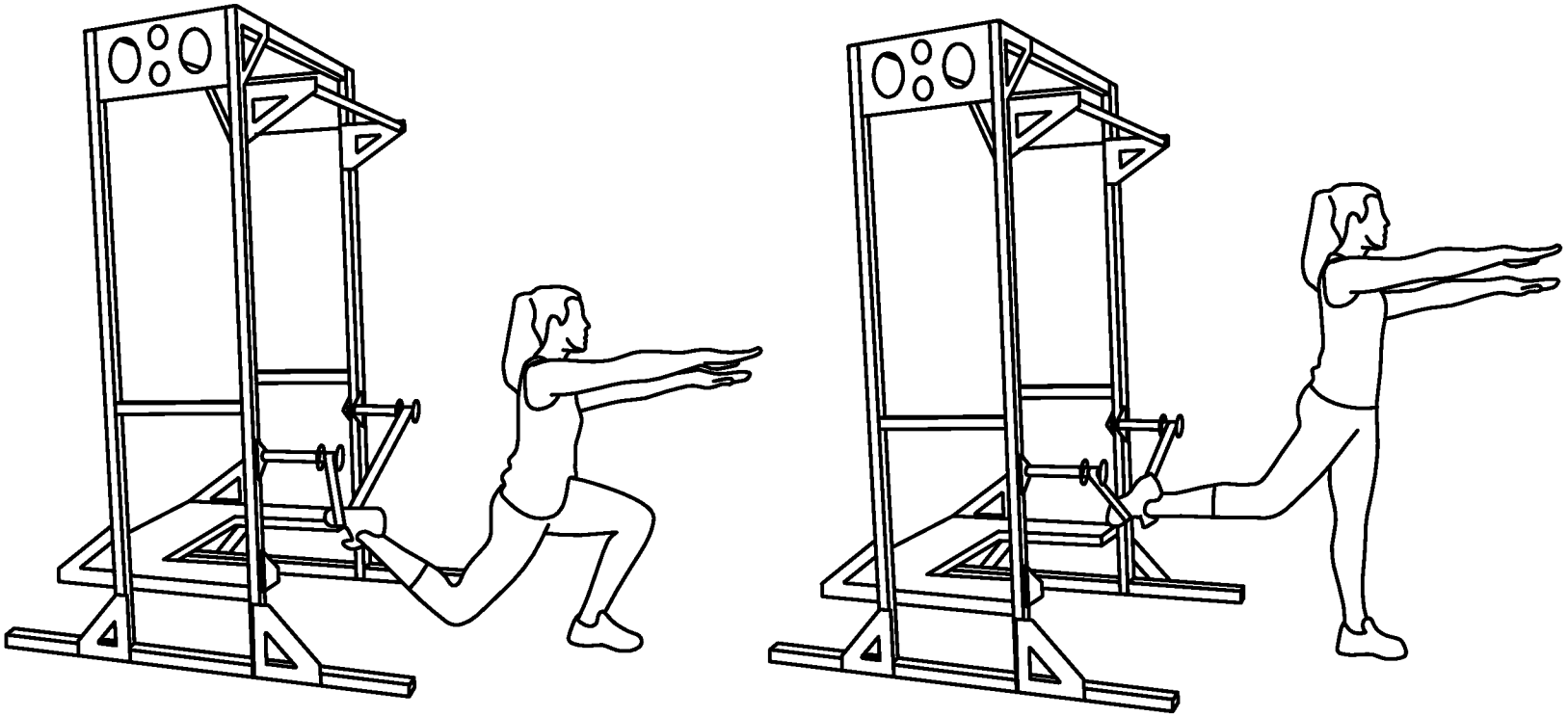

The Foot Elevated Split Squat—FIG. 18

1. Breathe in and begin to lower your hips straight down. Keep your torso straight.

2. The forward leg's knee should stay over your ankle and not bend past the toes.

3. The back leg's knee should bend but will not touch the floor.

4. Focus on maintaining a level pelvis. Keep the forward leg's knee over the lateral foot.

5. You should drop your hips until the forward knee is bent to a 90-degree angle.

6. At the bottom position, drive the forward leg's heel into the ground raising your center of mass.

7. Focus on bending the hips. Keep your back in a neutral position.

8. Perform the desired number of repetitions as determined by the overload phase you are in.

9. Repeat the exercise on the opposite extremity as per above.

Part 2: Lower Extremity Exercises

Figure 19:
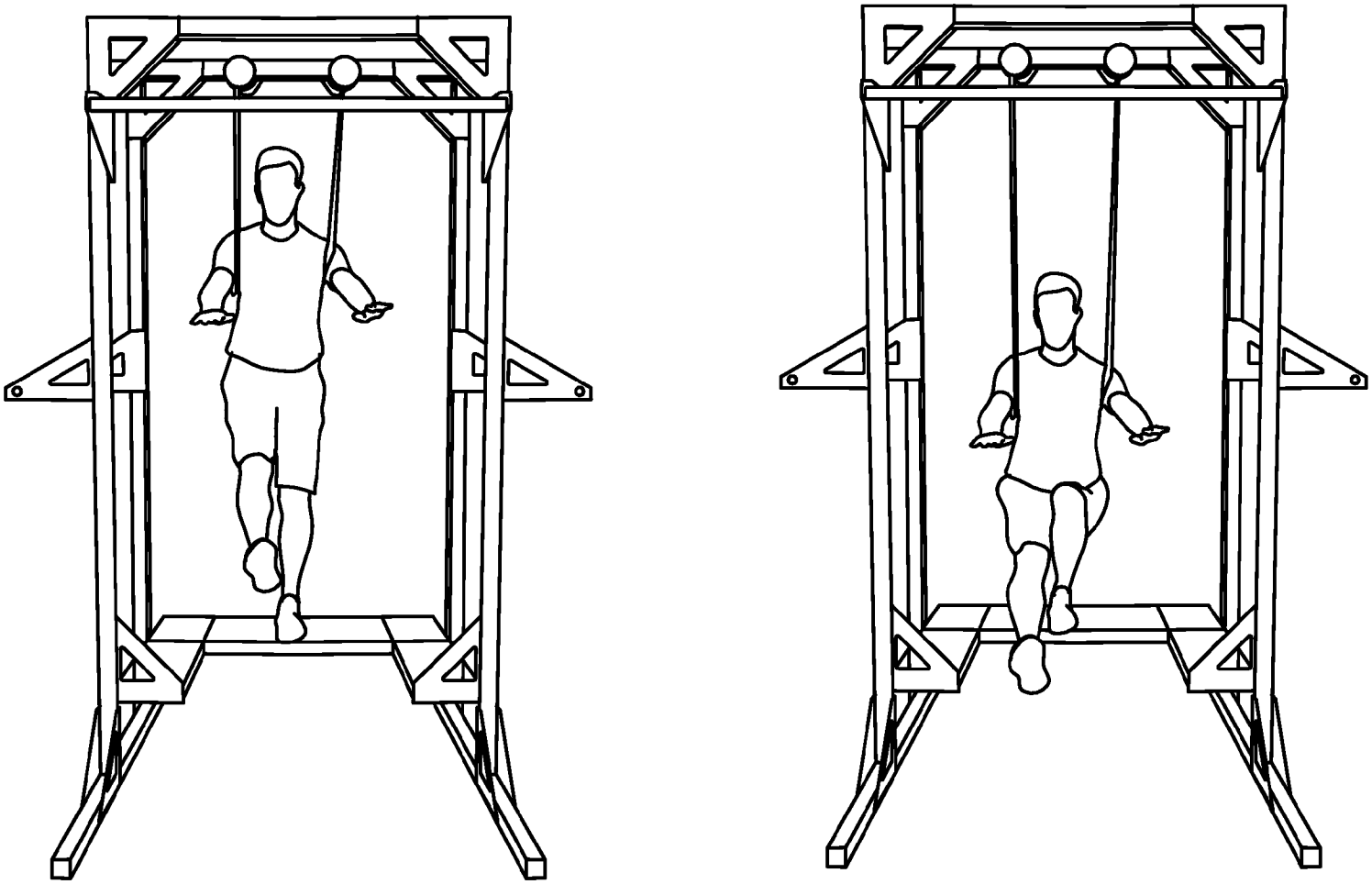

The One Legged Squat—FIG. 19

The one legged squat is the most functional and hardest of all the lower extremity exercises. It requires single limb balance, lateral hip muscle activation and core control unlike any other exercise. It will take practice to achieve good form with this motion, but it will reward you with levels of functional strength and injury prevention unattainable with any other leg exercise. The single leg squat is a great exercise to strengthen your hamstrings, gluteus, quads, and core stabilizers without the extra spinal compression and altered biomechanics associated with the standard barbell squat.

Attempt this exercise only after you have mastered the preceding lower extremity exercises. The movement pattern is similar to the double leg squat. When squatting on one leg, the pelvis should be kept level, the stance leg's knee should be pushed to the outside of the foot, the knee and hip should then bend simultaneously, and the spine should be kept straight. However, due to the amount of pelvic stabilization and balance required while manipulating your center of gravity within your base of support, this is a very difficult exercise.

The assisted one legged squat starting position. Note the lateral pull of the band.

1. Place the elongated band holders on the back upper horizontal frame facing forward.

2. Place the holders as far apart as possible on the back upper horizontal frame.

3. Standing on the back step, place the hanging band under your arms and around your torso.

4. Then, if you are exercising the left leg, take a step to the right. If you are exercising the right leg, step to your left.

5. Stand on the exercising leg by lifting the opposite leg up and off the front of the step. Keep the non-exercising leg straight and forward.

6. Lift your arms straight out in front of you at shoulder height and inhale.

Part 2: Lower Extremity Exercises

The One Legged Squat—FIG. 19

The down position of the assisted one legged squat. Note the knee over foot.

1. Maintain the normal curve in your low back and push your knee forward to just past the lateral toes.

2. Keep your hips level by contracting your gluteus musculature.

3. Maintain your knee in the forward position. Do not let it migrate backward as you bend your hips.

4. Drop your hips while maintaining a neutral spine. Your thigh should be parallel to the floor at the bottom of the movement.

5. Do not allow your knee to collapse inward.

6. Ascend from the squat by driving your heel into the step and extending your knee and hip.

7. Exhale as you ascend.

8. Note how the knee and hip are aligned.

1. Perform the desired number of repetitions as determined by the overload phase you are in.

2. Repeat the exercise on the opposite extremity as per above.

Part 2: Lower Extremity Exercises

Figure 20:
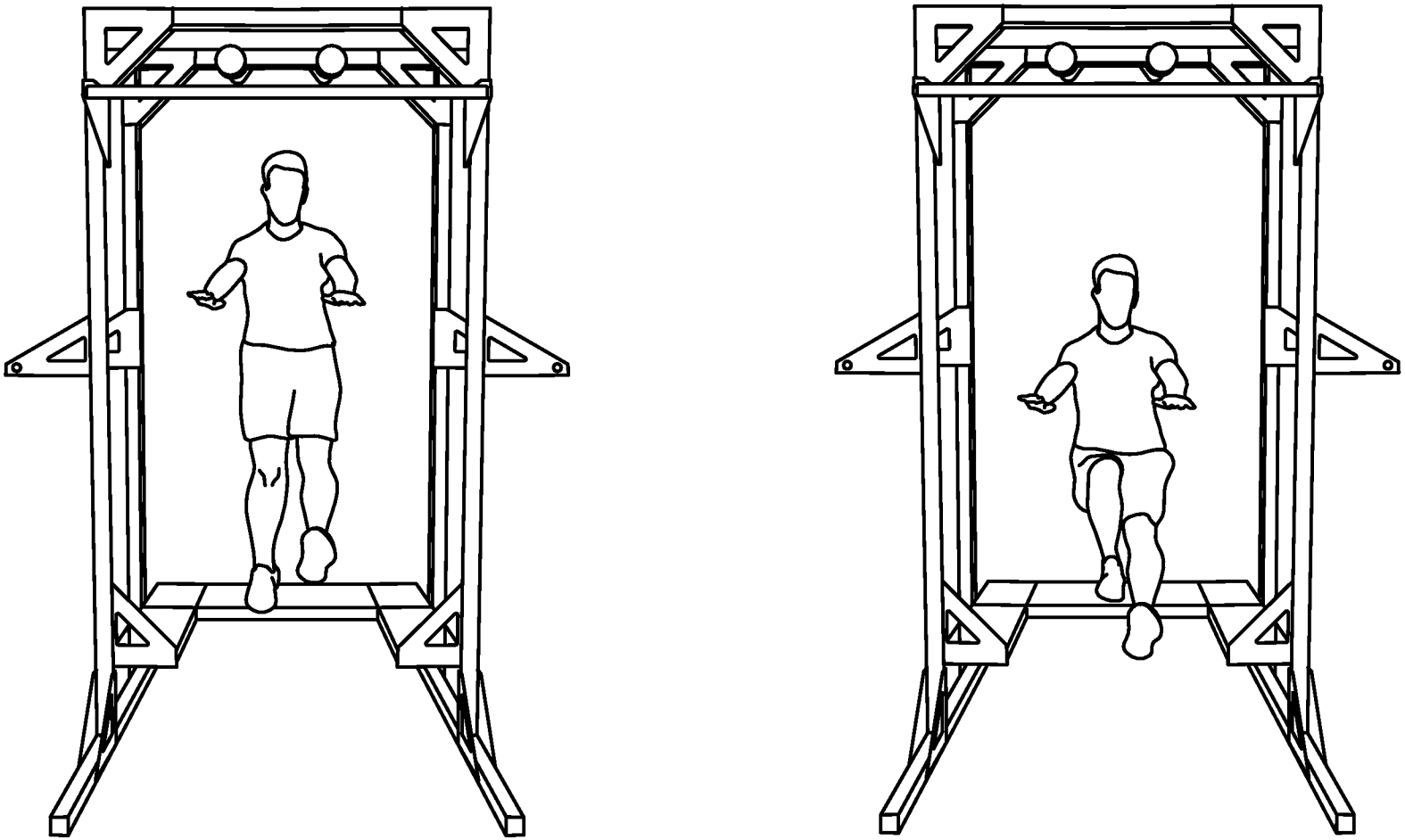

The One Legged Squat—FIG. 20

The Unassisted One Legged Squat

1. Once you require limited amounts of assistance in the single leg squat exercise, progress to attempt the unassisted version.

2. Standing on the back step, balance on one leg and keep your core and hips level.

3. While standing on the exercising leg, lift the opposite leg up and off the front of the step. Keep the forward non-exercising leg straight and forward.

4. Lift your arms straight out in front of you at shoulder height and inhale.

5. Keep your spine in a neutral position and begin the motion by bending the knee.

6. Bend the knee to just past the lateral toes. Focus on keeping your hips level.

7. Once the knee is forward, hold it in that position and begin to drop your hips.

8. Bending at the hips and not the spine, continue to squat until your thigh is parallel to the floor. Watch your knee position. Do not let it collapse inward.

9. While keeping your back muscles tight, ascend from the squat by driving your heels into the floor causing your hips to rise up and forward. Exhale slowly.

10. Perform the desired number of repetitions as determined by the overload phase you are in.

11. Repeat the exercise on the opposite extremity as per above.

Note the knee position relative to the hip in the down picture; it is starting to collapse inward, indicating weakness in the right gluteus medius and the need to continue the exercise with assistance.

Part 2: Lower Extremity Exercises

Figure 21:
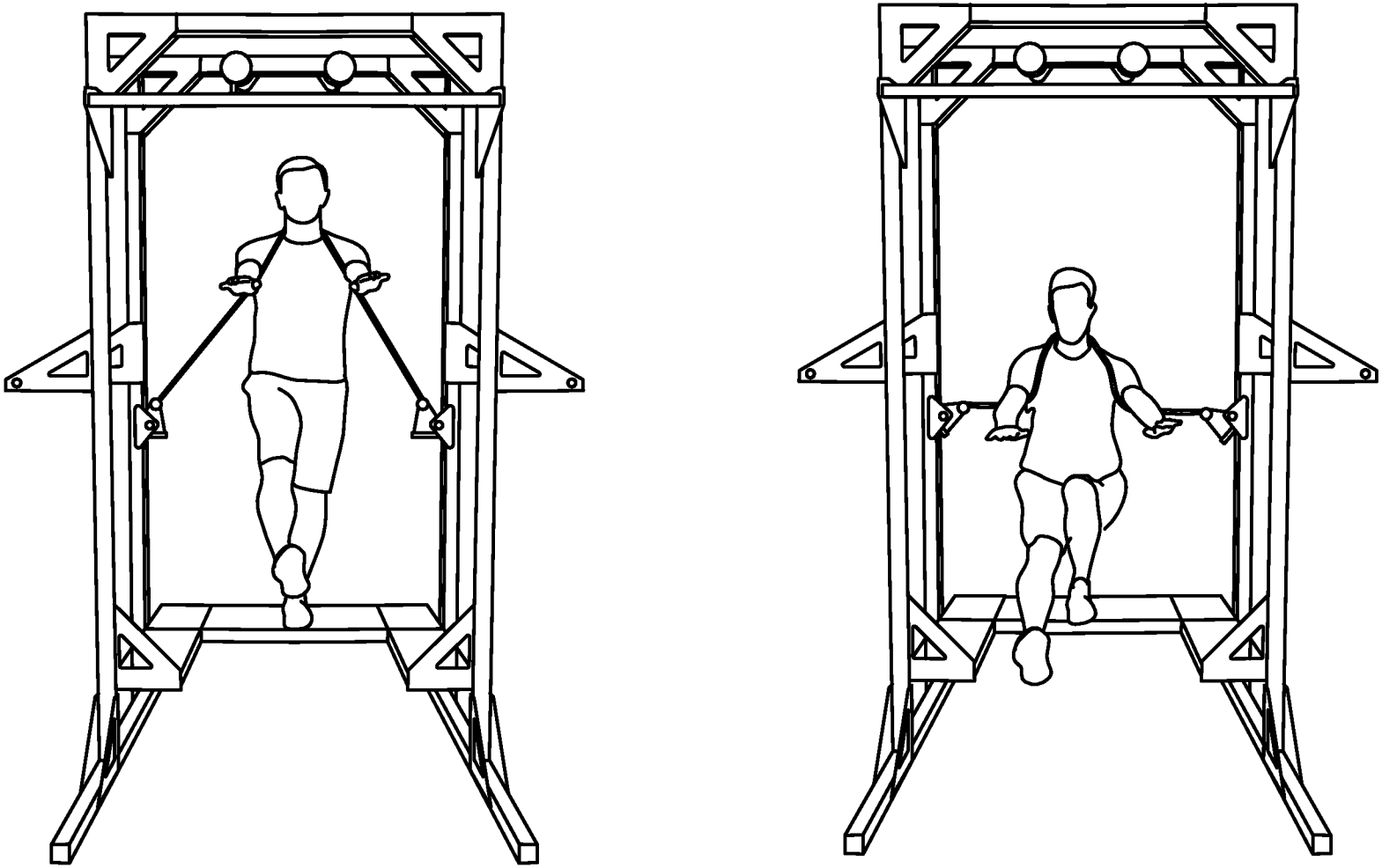

The One Legged Squat—FIG. 21

The Resisted One Legged Squat

1. Progress to this exercise only after you are able to perform 10 body weight single leg squats with proper form.

2. Place a strength band across the width of the frame at waist height on the back vertical frame as pictured with the small band holders.

3. Stand on the back step facing forward. If needed place a towel around the back of your neck for comfort, then the band around your neck as pictured.

4. While standing on the exercising leg, lift the opposite leg up and off the front of the step. Keep the forward non-exercising leg straight and forward.

5. Lift your arms straight out in front of you at shoulder height and inhale.

6. Keep your spine in a neutral position and begin the motion by bending the knee.

7. Bend the knee to just past the lateral toes. Focus on keeping your hips level.

8. Once the knee is forward hold it in that position and begin to drop your hips.

9. Bending at the hips and not the spine, continue to squat until your thigh is parallel to the floor. Watch your knee position. Do not let it collapse inward.

10. While keeping your back muscles tight, ascend from the squat by driving your heels into the floor causing your hips to rise up and forward. Exhale slowly.

11. The band will provide resistance as it is stretched out.

12. Perform the desired number of repetitions as determined by the overload phase you are in. Repeat the exercise on the opposite extremity.

Part 2: Lower Extremity Exercises

Figure 22:
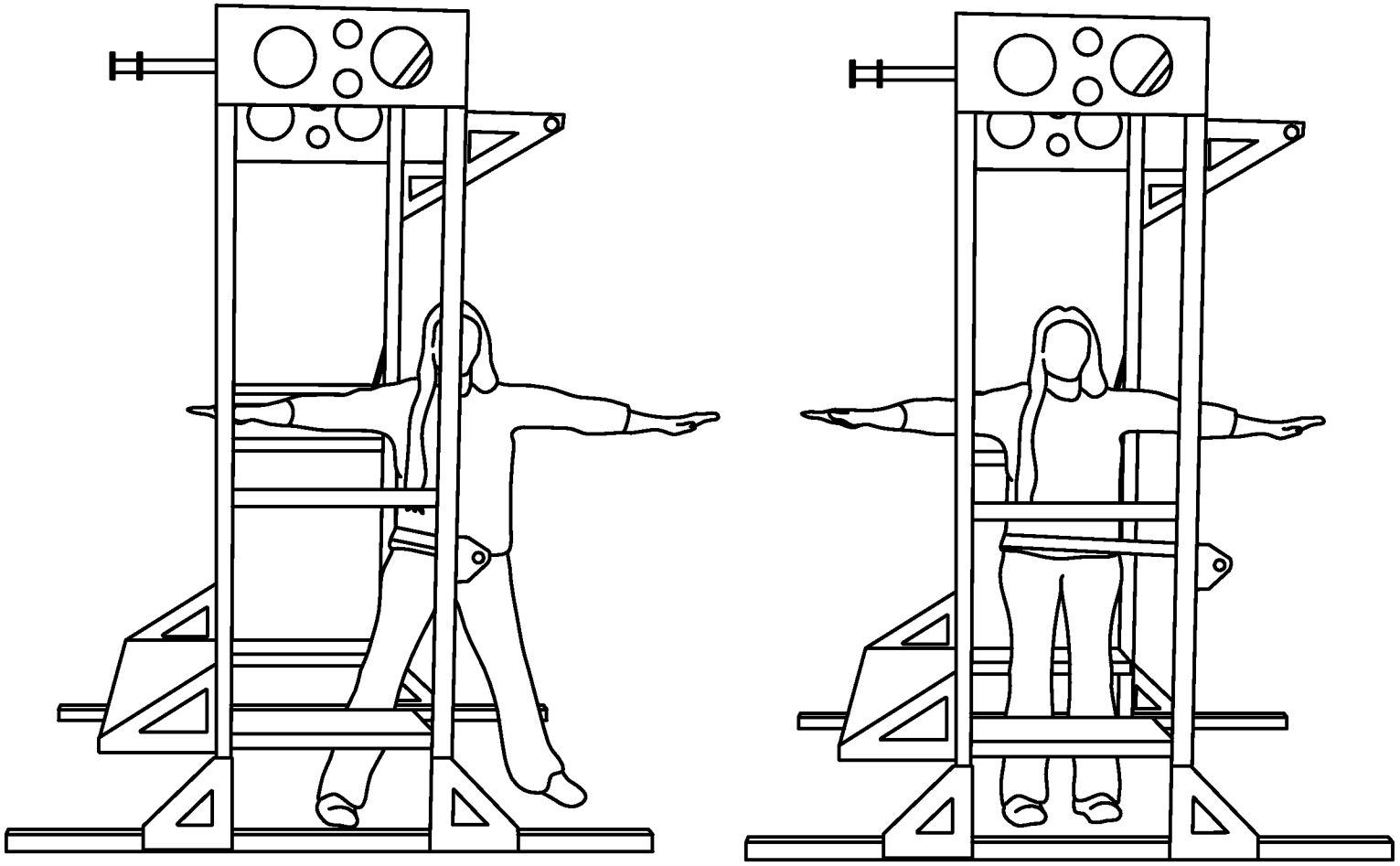

Resisted Hip Adduction—FIG. 22

Developing the adductor musculature of your lower extremities will assist you in functional motions that require changing directions during gait.

1. Place the small band holders on the middle support frames toward the front of the frame or on the front vertical side supports waist high as pictured.

2. Stretch a strength band between the holders.

3. Stand facing sideways in or out of the frame and step into the band.

4. Keeping stable the foot that has stepped into the band, step out with the other foot as far as comfortably possible.

5. From this lateral step position, pull your center of mass back toward the leg in contact with the band by contracting your groin muscles.

6. The band will provide resistance to this lateral motion.

7. Perform the desired number of repetitions as determined by the overload phase you are in.

8. Repeat the exercise on the opposite extremity as per above.

Notice in the picture on the right that the user's left foot is off of the ground; the right leg has pulled her center of mass into the band which is providing resistance to the motion.

Part 2: Lower Extremity Exercises

Figure 23:
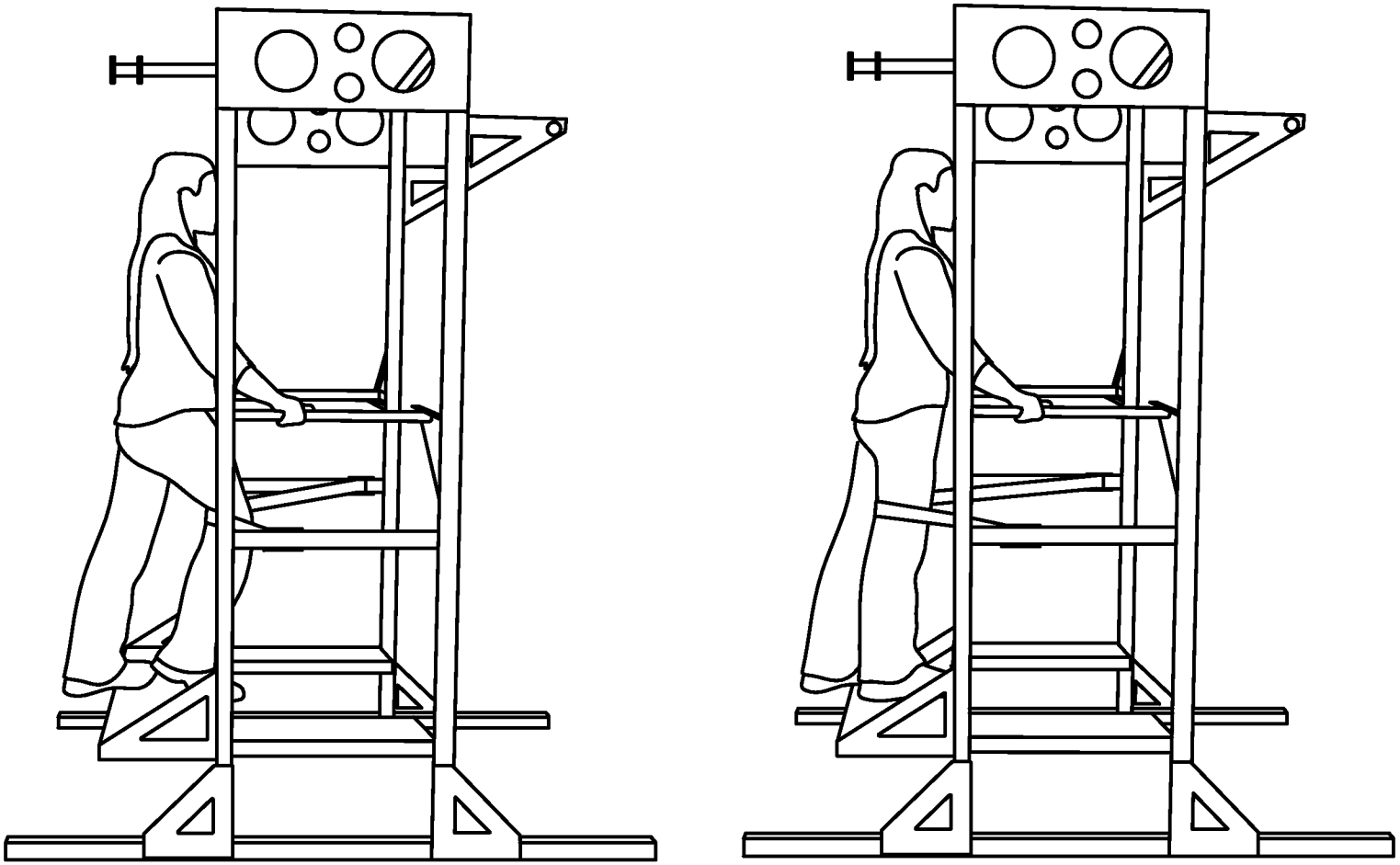

Resisted Knee Extension—FIG. 23

The closed chain knee extension exercise is a great exercise to strengthen your quads without the knee cap grinding or ligament stress associated with the machine version of the exercise.

1. Place the small band holders forward on the middle frame as pictured.

2. Stretch a strength band between the holders.

3. Rotate the arm bars into the frame for balance if needed.

4. Stand facing the band on the back step and place the band around one leg.

5. Let the leg with the band around it bend forward at the knee, shifting your weight toward the toes as pictured.

6. Keep the other leg slightly behind the banded leg as shown.

7. Straighten the leg with the band around it by shifting the weight back toward the heel. It is a rolling type motion. You will tighten your quads to do this.

8. Be sure to hold your hips stable. Remember: this is a knee exercise.

9. Slowly return to the bent knee position and repeat the exercise.

10. Perform the desired number of repetitions as determined by the overload phase you are in.

11. Repeat the exercise on the opposite extremity as per above.

At the end of a repetition, as pictured on the right, hold the position for a few seconds to really stress the quadriceps muscle.

Part 2: Lower Extremity Exercises

Figure 24:
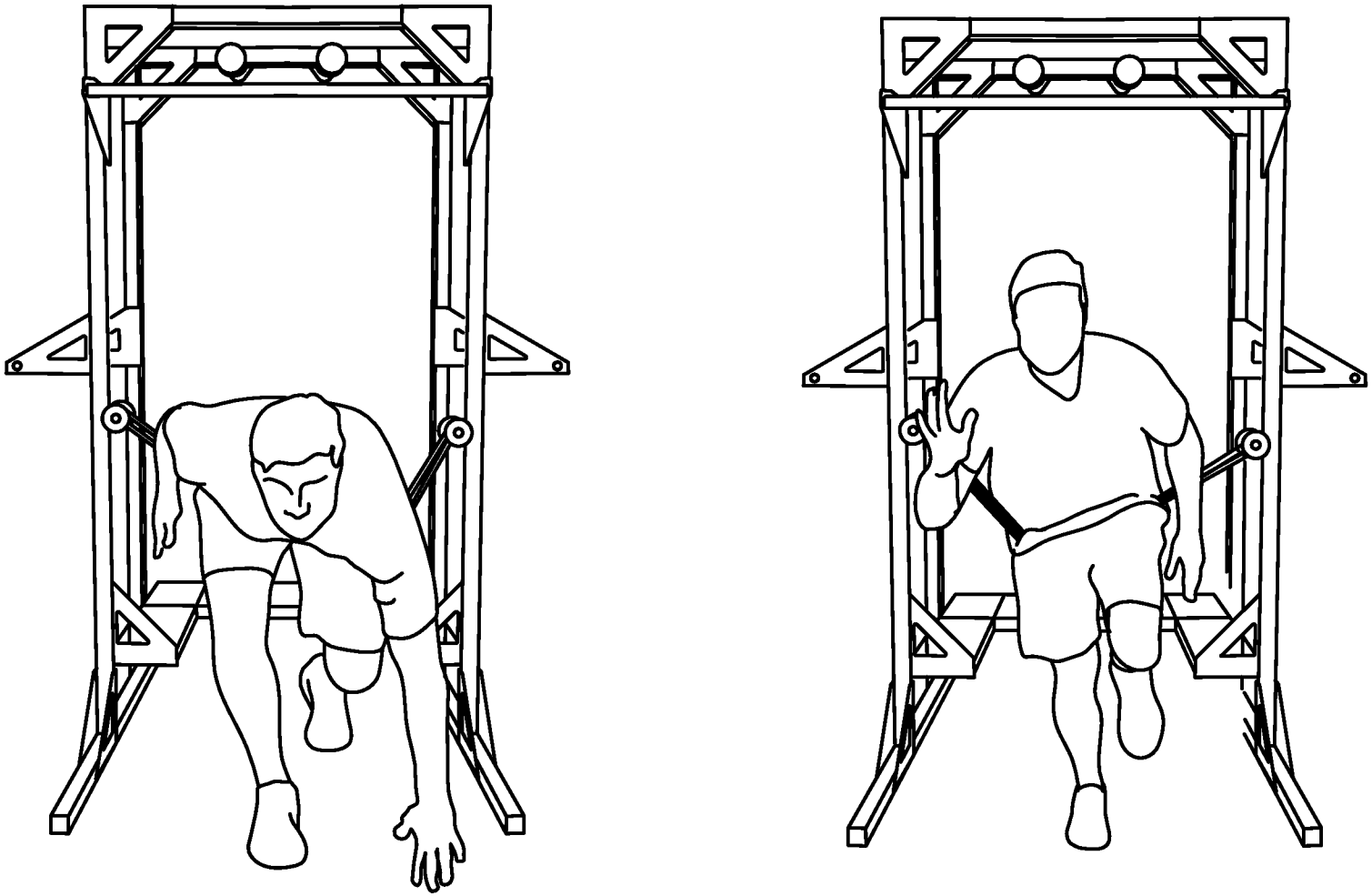

Closed Chain Hip Extension—FIG. 24

This is an exercise that is again designed to teach you to move your hips around a stable knee and spine. Done correctly it is a valuable exercise to strengthen your gluteus musculature.

1. Place the elongated band holders on the front vertical frame near waist height as pictured. You may have to rotate the parallel arm bars out of the frame.

2. Stretch a strength band between the holders.

3. Step and lean into the band while attaining a "sprinter" like position as pictured.

4. Maintain a neutral spine and a slightly bent knee on the forward leg. Bend the hip allowing the opposite arm to touch the ground as pictured.

5. The back leg should be bent at the knee and ready for push off as pictured.

6. The arm on the side of the forward leg should be held in an extended position at the start of the motion to help generate momentum.

7. Start the movement by pushing off with the back leg, pulling with the straight forward leg, and quickly generating momentum by violently bringing the forward leg's side arm into flexion as pictured.

8. As you come to the standing position at the end of the motion shift your hips forward. Step back and repeat the motion.

9. Perform the desired number of repetitions as determined by the overload phase you are in.

10. Repeat the exercise on the opposite extremity as per above.

Part 3: Upper Extremity Exercises

Feet Elevated Push Up

The feet elevated push up is a great and safe way to strengthen your pectorals and triceps. Doing a standard push up, you only overcome approximately 75% of your body weight. When the feet are elevated, it shifts more weight to your arms and the resistance provided is closer to 100% of your body weight.

Assisted Feet Elevated Push Up

1. Place a single small band holder in the middle of the front upper horizontal frame.

2. Hang a strength band from the holder.

3. Standing on the side steps facing forward, place the band around your chest.

4. Step down to the floor and assume the standard push up position and then place your feet on the back step.

5. Keep your core tight, bend your arms, and lower your chest to the floor stretching the band.

6. Push up by straightening your arms in the standard push up sequence.

7. The band will assist your push up.

8. Make sure you keep your body aligned when pushing up. Your shoulders and hips should move together and be in the same plane.

9. Perform the desired number of repetitions as determined by the overload phase you are in.

Body Weight Feet Elevated Push Up

This exercise is performed in the same manner as the assisted version but without the use of the assist/strength band. It is important to be able to perform this exercise with proper form prior to progressing to the resisted version.

Part 3: Upper Extremity Exercises

Figure 25:
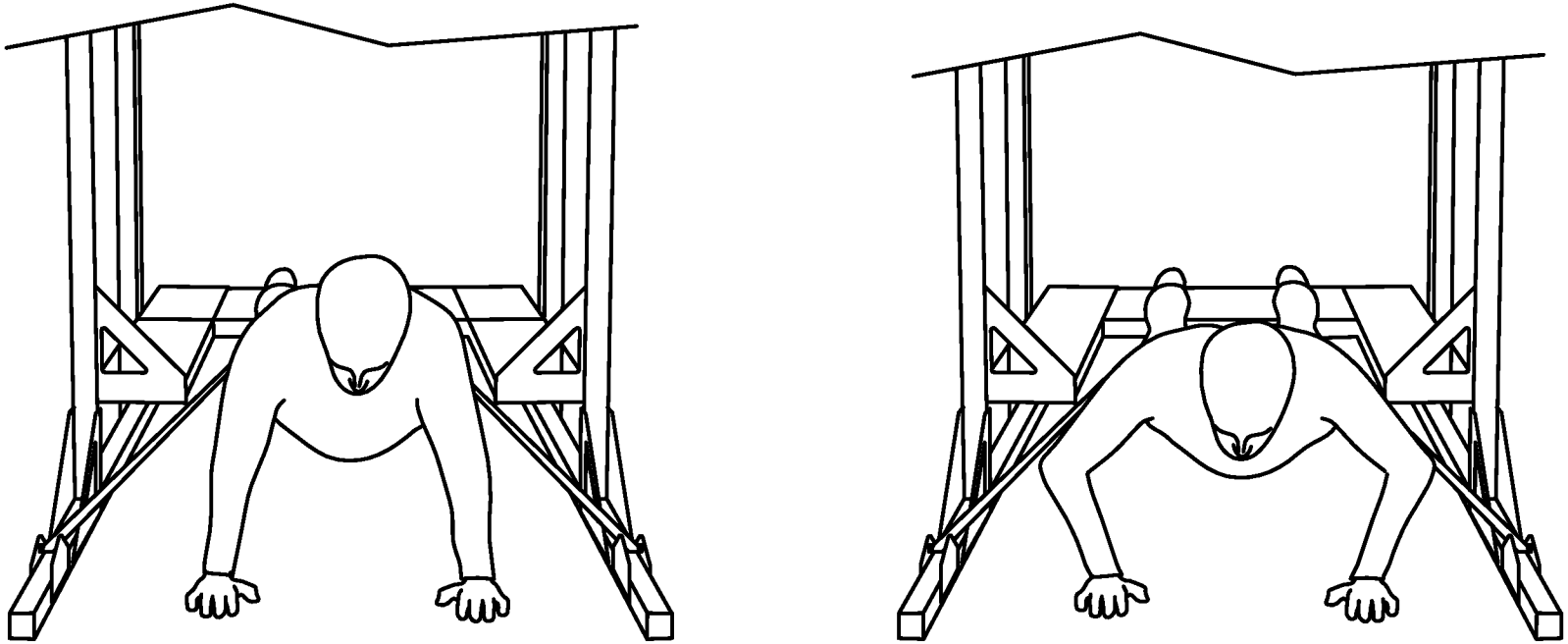

Feet Elevated Push Up—FIG. 25

Resisted Feet Elevated Push Up

1. Place the small band holders on the bottom front frame with the appropriate strength band attached as pictured.

2. Kneel down in front of the out stretched band and pull it up over your buttock.

3. Then assume the standard feet elevated push up position. The band will be stretched around your waist as pictured.

4. Complete the push up exercise as described earlier. The band will now provide resistance to the push up motion.

5. Perform the desired number of repetitions as determined by the overload phase you are in.

Part 3: Upper Extremity Exercises

Figure 26:
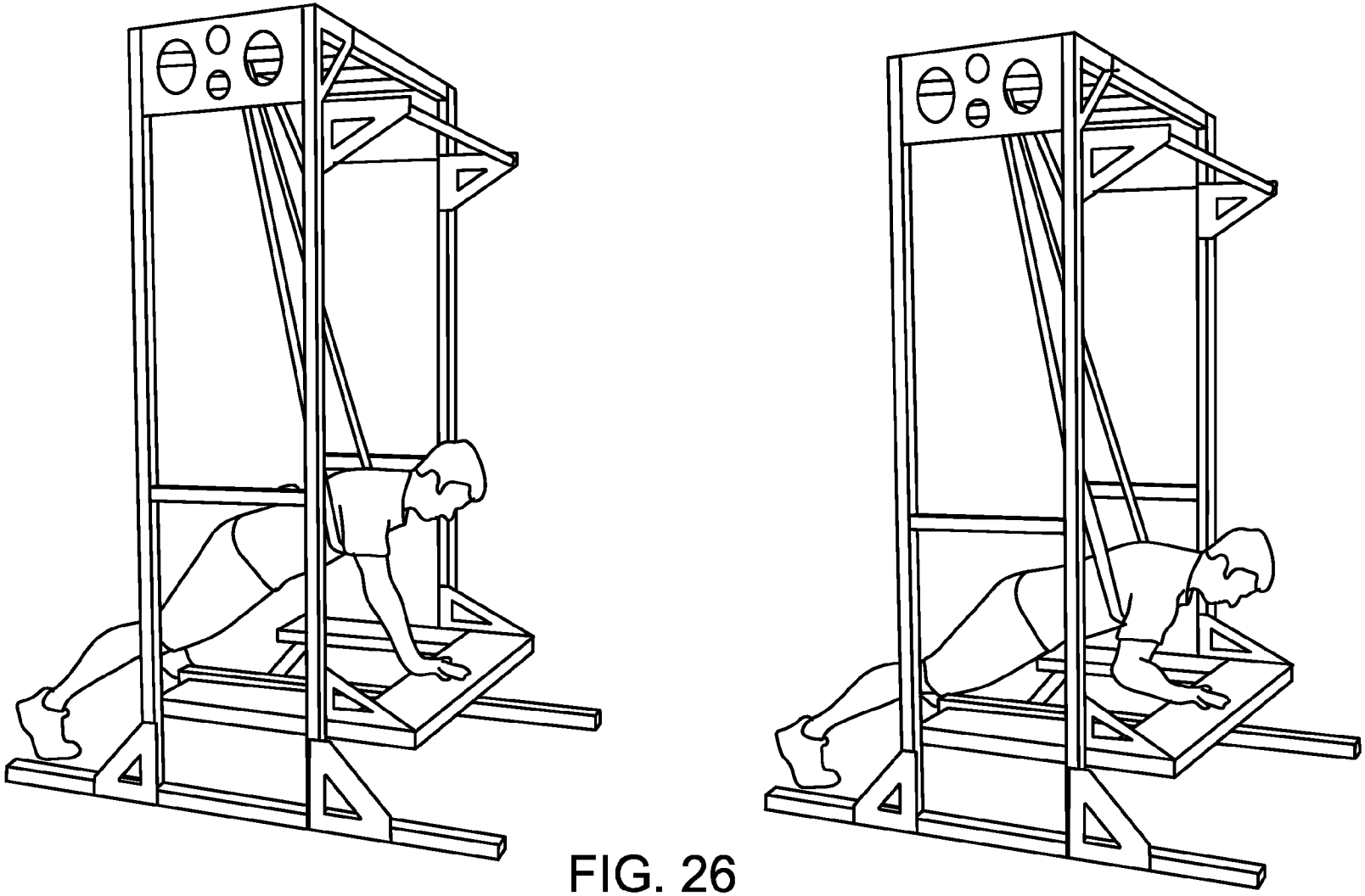

One Arm Assisted Push Up—FIG. 26

This exercise is utilized if there is a discrepancy in strength between your arms because of injury or dysfunction. It is effective at strengthening your chest and triceps, and requires significant core stabilization.

1. Place a single small band holder in the middle of the front upper horizontal frame.

2. Hang a strength band from the holder as pictured.

3. Standing on the side steps facing backward, place the band around your chest.

4. Step down and place one hand in the middle of the back step as pictured.

5. For balance spread your legs as far apart as possible inside the frame.

6. Perform a one-arm push up, but in this case it will be difficult to maintain a completely stable center of mass. Some trunk rotation toward the supporting arm is to be expected.

7. Perform the desired number of repetitions as determined by the overload phase you are in. Repeat the exercise on the opposite extremity.

Part 3: Upper Extremity Exercises

Figure 27:
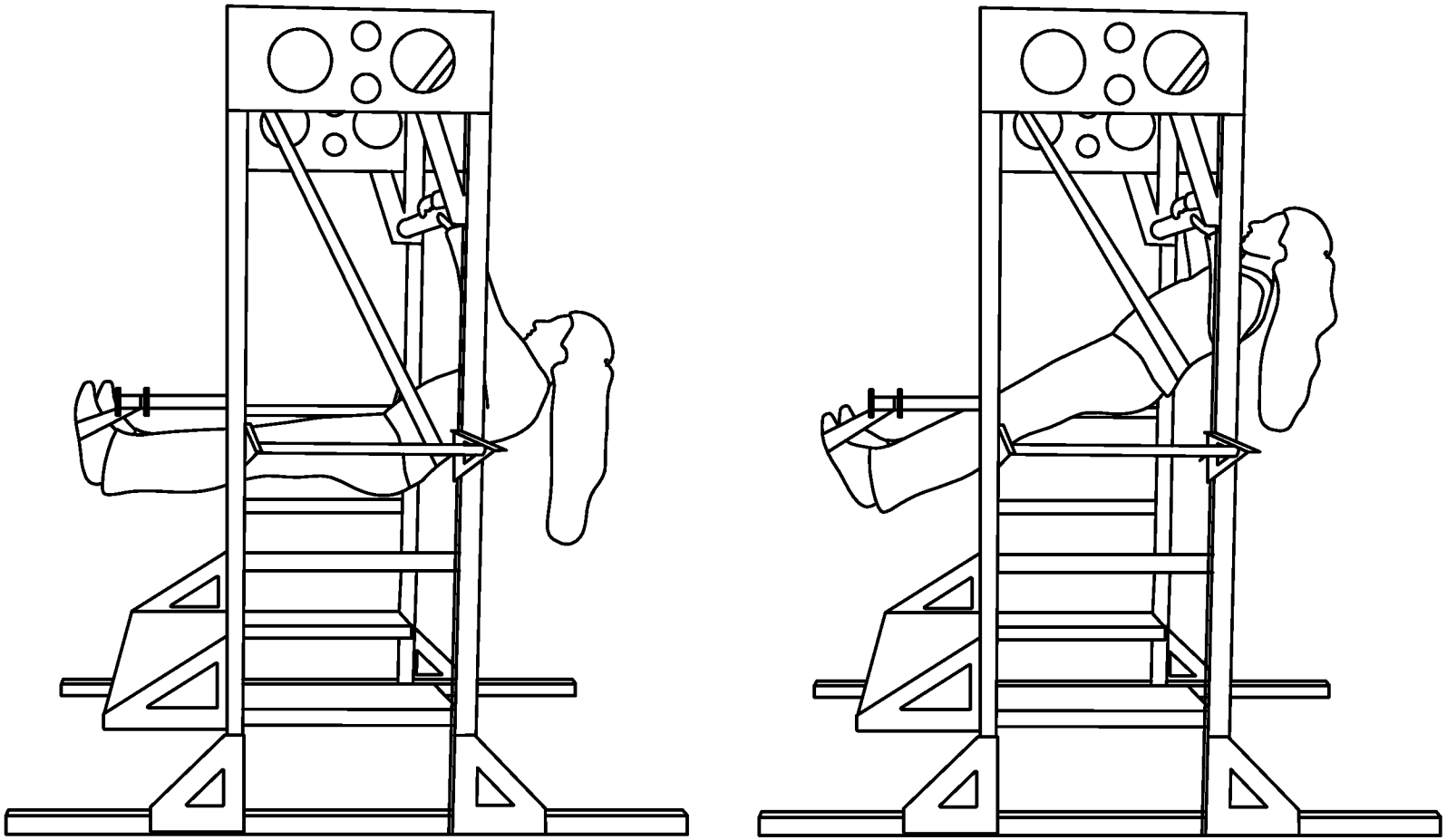

Inverted Row—FIG. 27

The Inverted Row is a great exercise to help strengthen the lower rotator cuff, scapular stabilizers, and forearm musculature.

Assisted Row

1. Place the elongated band holders facing backwards on the back vertical frame as pictured.

2. Attach a heavy strength band between the elongated band holders.

3. Lower the adjustable pull up bar to its lowest position and pin it in place.

4. Hang an assist strength band from the back upper horizontal frame as pictured.

5. Stand on the side steps facing backward, and loop the band around your torso.

6. Step down, grab the pull up bar with our palms facing away from your body and place your feet on the band across the elongated band holders.

7. Your body should be parallel to the floor in the down position as shown.

8. From this position pull your chest to the bar.

9. Perform the desired number of repetitions as determined by the overload phase you are in.

Body Weight Row

1. The set up is the same as for the assisted row but without the use of the overhead assisted strength band.

2. Perform the desired number of repetitions as determined by the overload phase you are in.

Part 3: Upper Extremity Exercises

Figure 28:
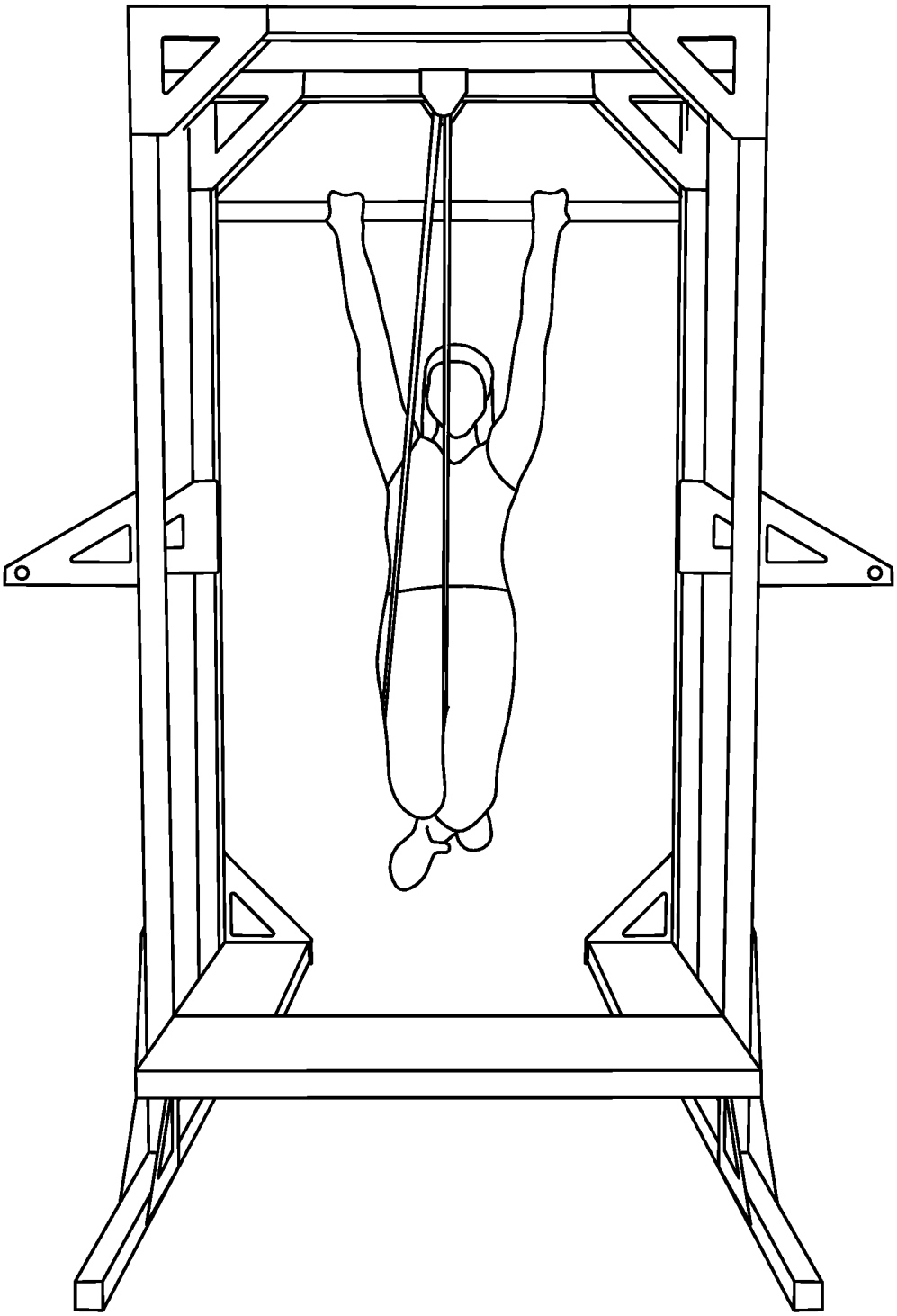

Pull Ups for Taller Users—FIG. 28

The pull up exercise strengthens the latissimus dorsi, trapezius, lower rotator cuff and the biceps. It is an important exercise for those with limited shoulder mobility, as it promotes safe shoulder joint elevation, due to the biomechanical properties associated with this exercise.

Assisted Pull Up for Taller Users

1. Adjust the pull up bar to its highest position.

2. Place a single small band holder in the middle of the front upper horizontal frame as pictured.

3. Hang a strength band from the holder as pictured.

4. Pull the strength band down around your dominant leg by bending your knee and pulling the band around your leg as pictured.

5. Reach up and grab the pull up bar with your palms facing you. Bend the stance leg. Your arms will be holding your weight. Perform the pull up exercise.

6. Perform the desired number of repetitions as determined by the overload phase you are in.

Body Weight Pull Up for Taller Users

1. Adjust the pull up bar to the appropriate height, hold the bar with your hands facing you, bend your knees, and pull up.

2. Perform the desired number of repetitions as determined by the overload phase you are in.

Part 3: Upper Extremity Exercises

Figure 29:
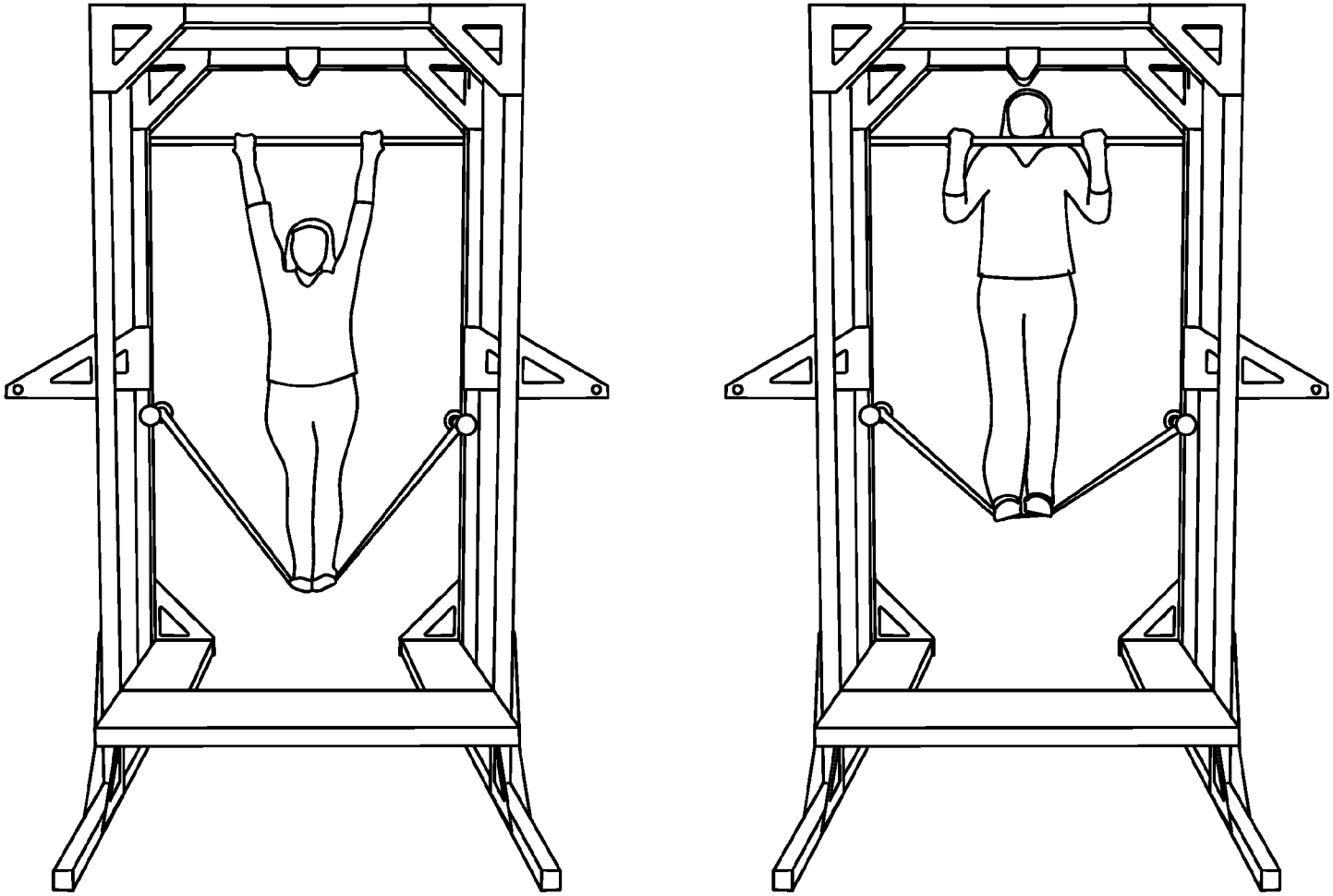

Pull Ups for Shorter Users—FIG. 29

Assisted Pull Ups for Shorter Users

1. Place the elongated band holders facing forward on the front vertical frame as pictured.

2. Adjust the pull up bar to the most upright position.

3. Place a strength band across the long supports as pictured.

4. Step up on the band and reach up for the pull up bar with your hands facing you.

5. Perform the pull up exercise by bending your elbows and pulling your arms to your sides as shown.

6. Perform the desired number of repetitions as determined by the overload phase you are in.

Body Weight Pull Ups for Shorter Users

1. Perform as above but without any assistance band. Adjust the pull up bar to the appropriate height, hold the bar with your hands facing you, bend your knees, and pull up.

2. Perform the desired number of repetitions as determined by the overload phase you are in.

The starting and ending position for the pull up exercise; Notice the chin is pulled up over the bar.

Part 3: Upper Extremity Exercises

Figure 30:
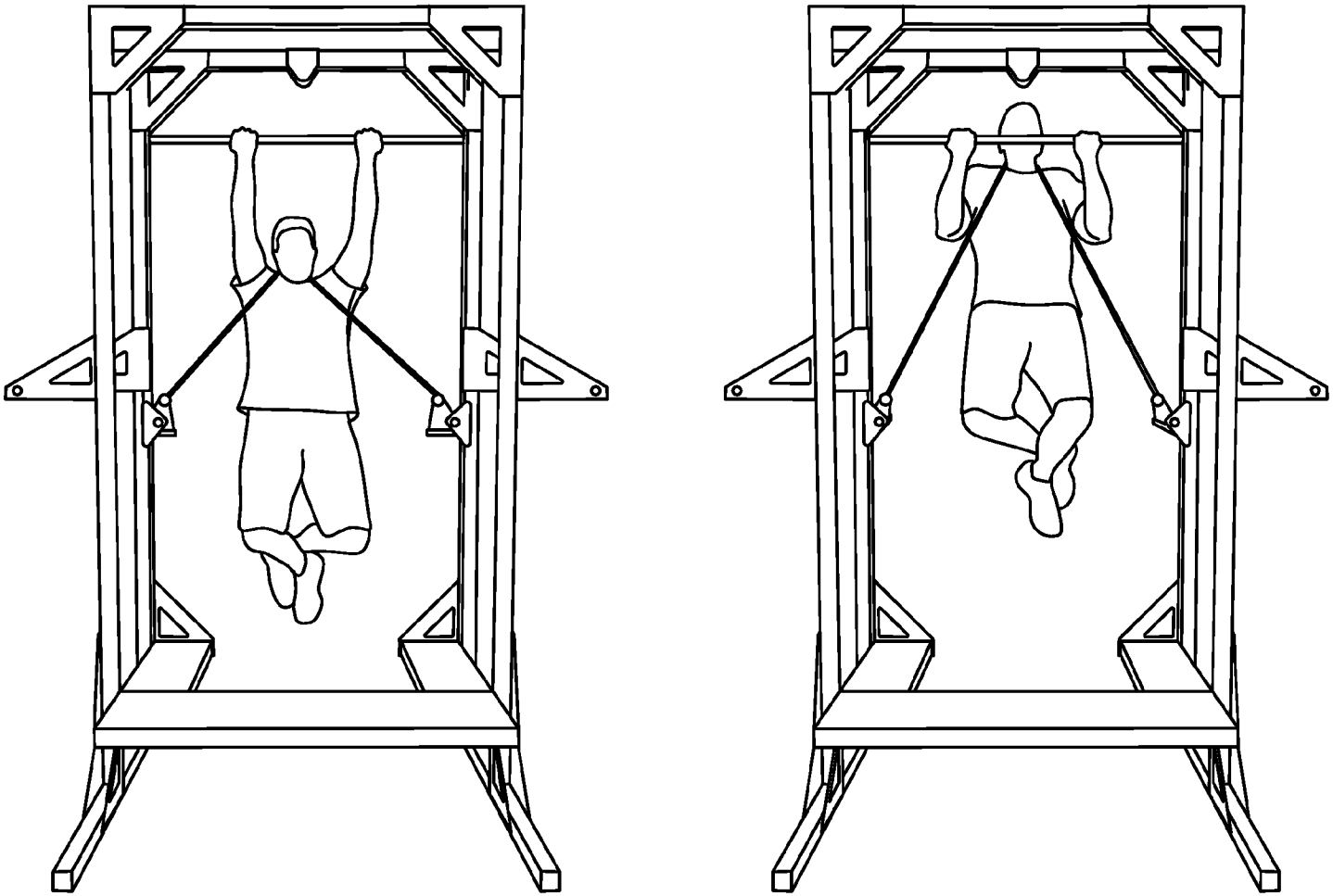

Resisted Pull Ups—FIG. 30

1. Place the small band holders on the front vertical frame at chest height as pictured.

2. Adjust the pull up bar to the appropriate height.

3. Place the band around your neck as pictured. The use of a towel around your neck will make it more comfortable.

4. Reach up for the bar and pull up. The band will provide resistance.

5. Perform the desired number of repetitions as determined by the overload phase you are in.

Part 3: Upper Extremity Exercises

Figure 31:
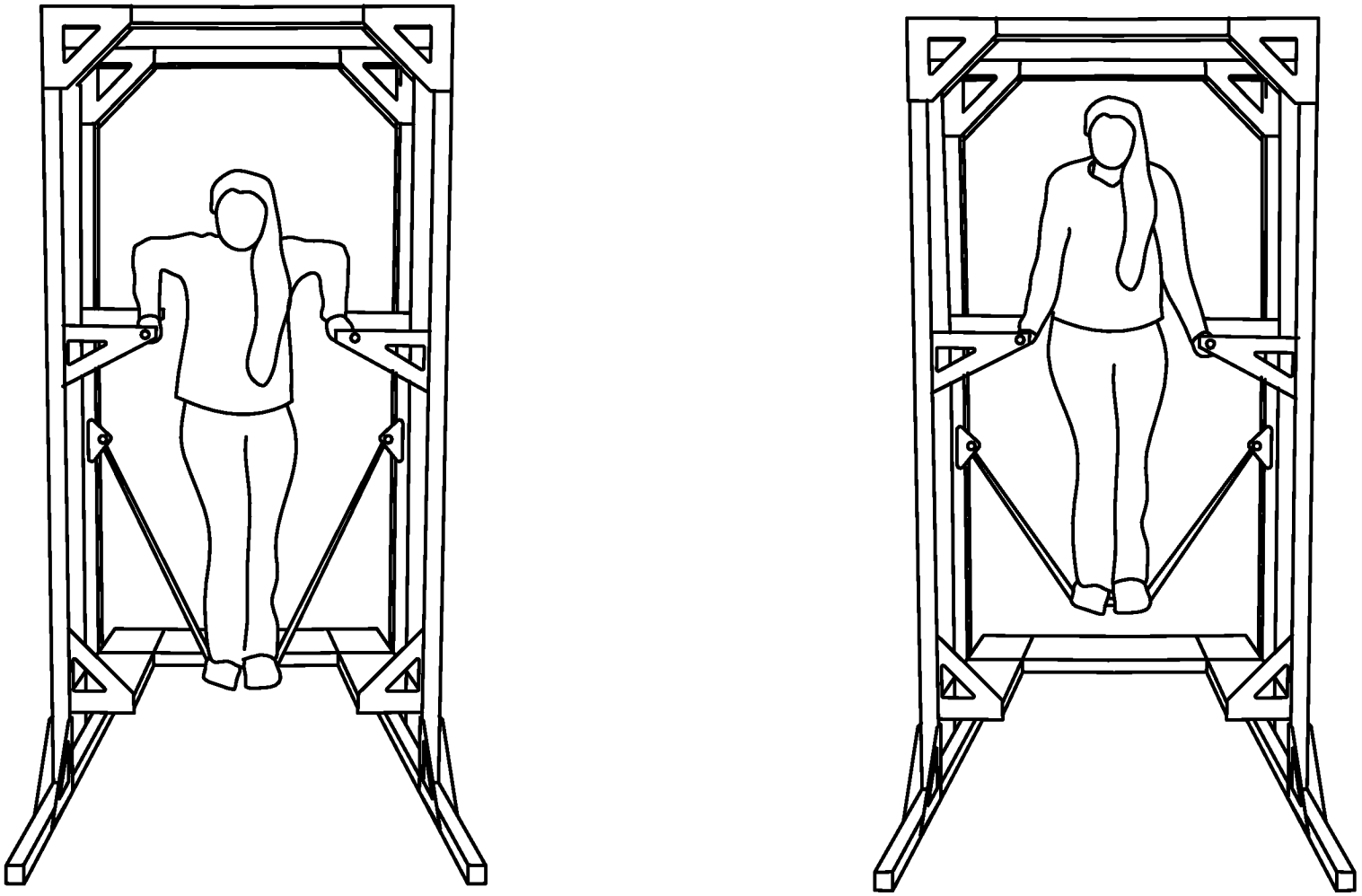

Dips—FIG. 31

The Dips are another great functional exercise to increase the strength of your chest and triceps musculature.

Assisted Dips

1. Pin the left and right parallel arm bars in the full upright in-frame position.

2. Place the small band holders on the middle frame as pictured.

3. Stretch a strength band between the holders.

4. Stand on the back step facing the band. Hold on to the bars as pictured.

5. Step on the band and maintain your body in the upright position.

6. With your core muscles contracted tightly, bend your elbows lowering your feet to the floor. Straighten your arms and return to the upright position. The band will assist.

7. Perform the desired number of repetitions as determined by the overload phase you are in.

Body Weight Dips

1. Set up the machine as above but without the need of the assistance band. Perform the standard dip exercise as pictured.

2. Perform the desired number of repetitions as determined by the overload phase you are in.

Part 3: Upper Extremity Exercises

Figure 32:
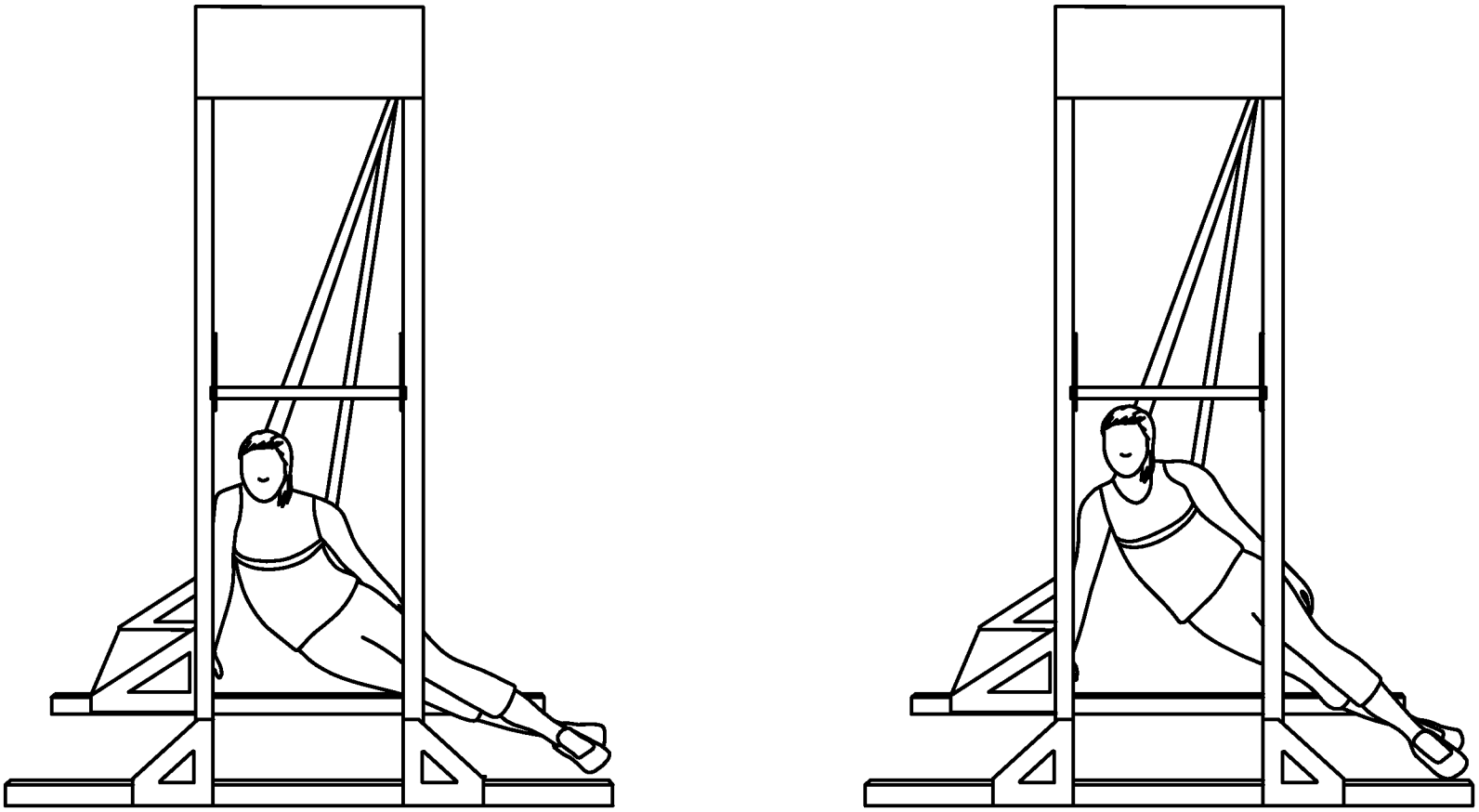

Closed Limited Motion Shoulder Abduction—FIG. 32

This exercise strengthens your deltoid muscle and your erector spinae.

Assisted Shoulder Abduction

1. Place a single small band holder in the middle of the front upper horizontal frame.

2. Hang a strength band from the holder as pictured.

3. Facing the back step, stand on the side steps and place the band around your torso, then step down to the floor.

4. Then place one hand on the back step with your body facing sideways and your legs straight. Keep your hips, ankles, and shoulders in a straight line.

5. Keeping your support arm straight let your hips sink to the floor. As this happens the distance between your arm and your side will decrease.

6. Then push your straight support arm into the step. The arm will not move as it is supporting your weight, but the force will cause your hips to lift up and return to the side up position as described earlier. See picture.

7. Perform the desired number of repetitions as determined by the overload phase you are in. Repeat the exercise on the opposite arm.

Body Weight Shoulder Abduction

1. Same positioning and motion as above but without the use of the assistive strength band.

2. Perform the desired number of repetitions as determined by the overload phase you are in. Repeat the exercise on the opposite arm.

Part 3: Upper Extremity Exercises

Figure 33:
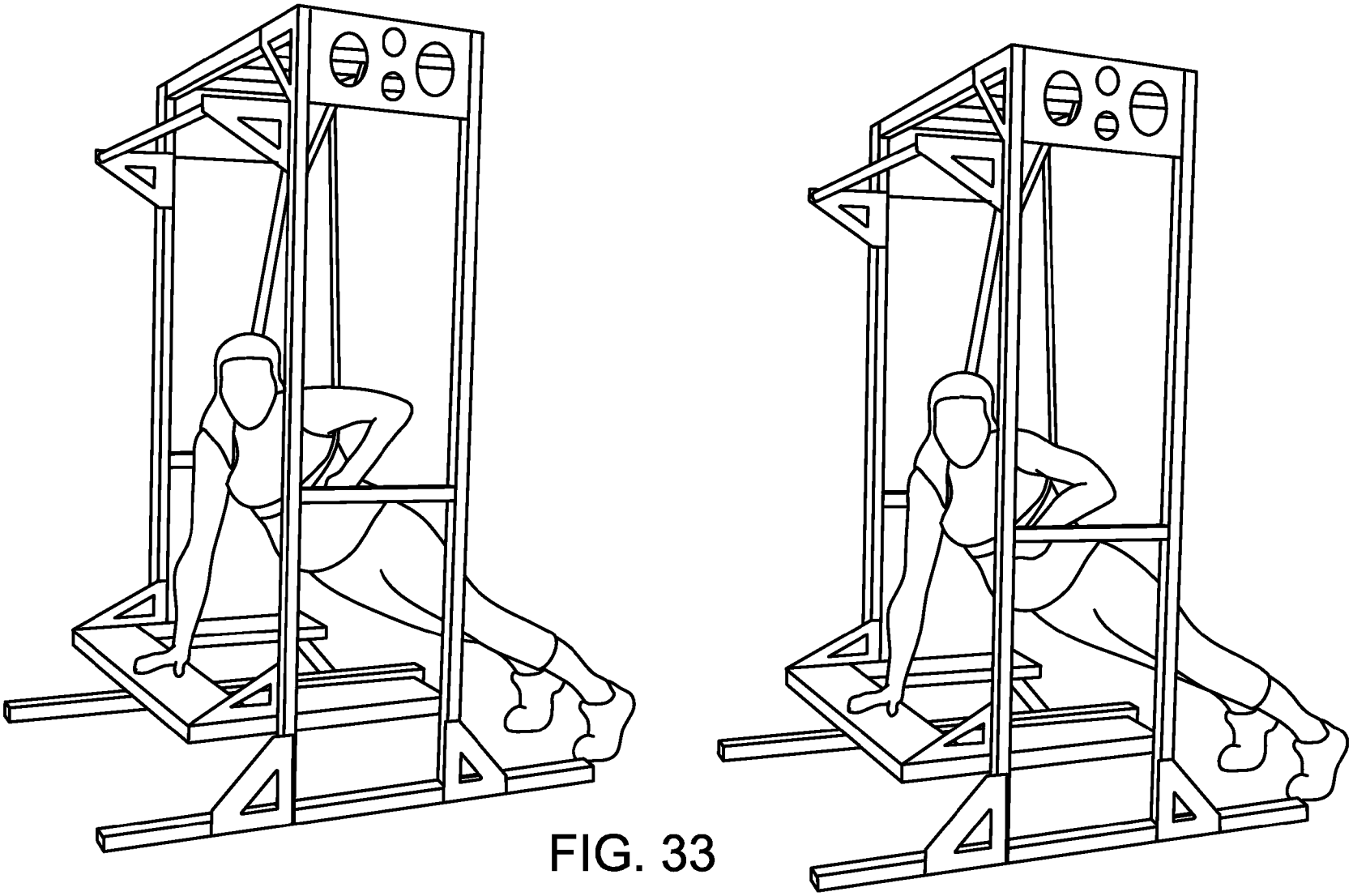

Closed Shoulder/Scapular Horizontal Abduction—FIG. 33

This exercise is for the lower rotator cuff, posterior deltoid, and the scapular stabilizers.

Assisted Closed Shoulder/Scapular Horizontal Abduction

1. Place a single small band holder in the middle of the front upper horizontal frame.
2. Hang a strength band from the holder as pictured.
3. Facing the back step, stand on the side steps and place the band around your torso, then step down to the floor.
4. Place both hands close together on the back step with your feet in a position similar to the one arm push up position as shown.
5. Remove one hand from the step. Place that hand on your side as pictured. You will be supporting your weight with one arm.
6. Push your support hand into the step and rotate your torso over your support hand causing horizontal abduction at the shoulder. See picture.
7. End position of the torso is similar to closed shoulder abduction.
8. Perform the desired number of repetitions as determined by the overload phase you are in. Repeat the exercise on the opposite arm.

Body Weight Closed Shoulder/Scapular Horizontal Abduction

1. Same positioning and motion as above but without the use of the assistive strength band.
2. Perform the desired number of repetitions as determined by the overload phase you are in. Repeat the exercise on the opposite arm.

Part 3: Upper Extremity Exercises

Figure 34:
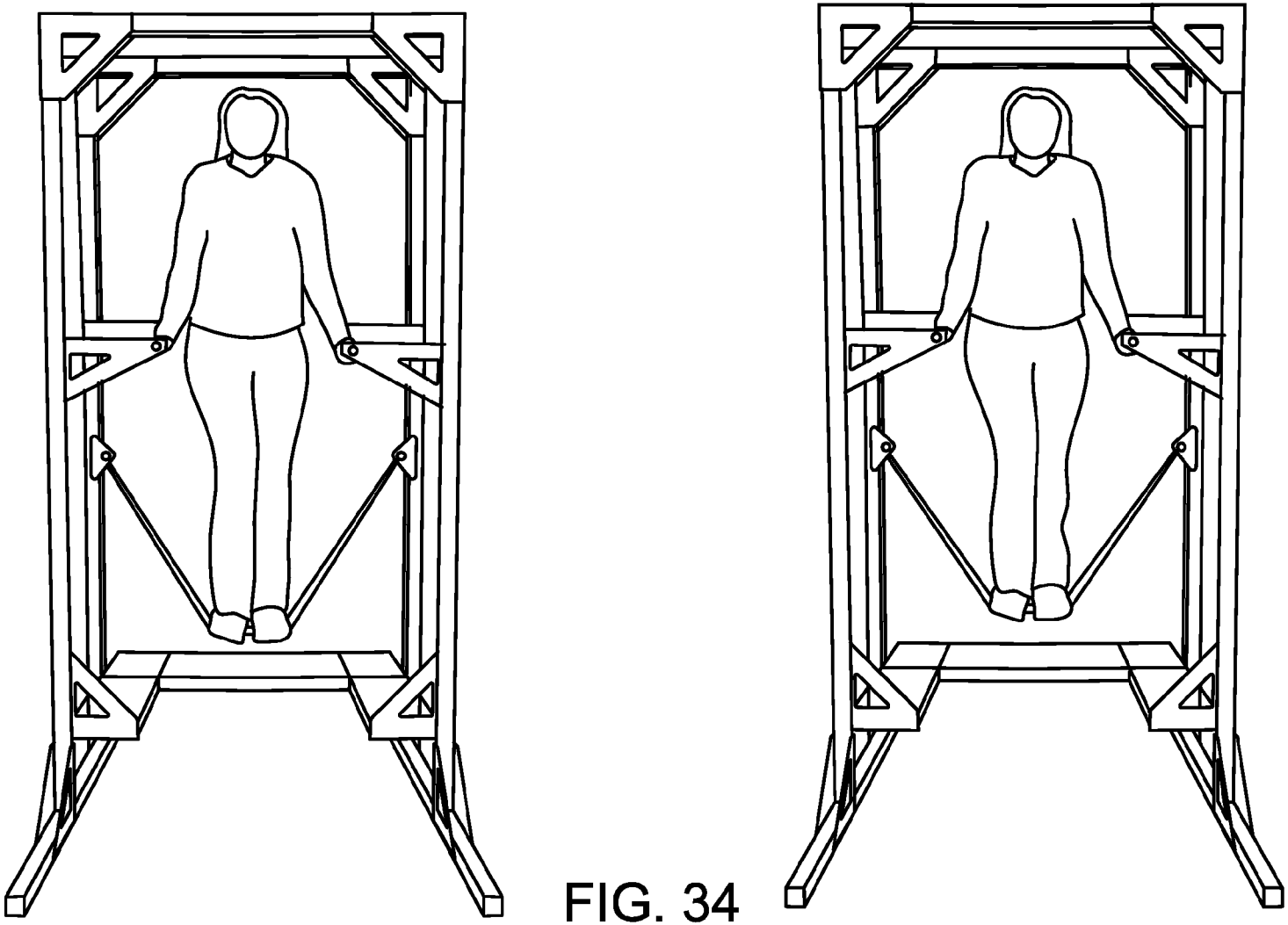

Closed Shoulder Shrugs—FIG. 34

This exercise strengthens the lower trapezius which contributes to upwardly rotating the shoulder blade in overhead motion, helping to prevent rotator cuff impingement.

Notice the elbows are kept straight and the shoulders are shrugged to the ears

Assisted Closed Shoulder Shrugs

1. Pin the left and right arm bars in the full upright in-frame position.
2. Place the small band holders on the middle frame as pictured.
3. Stretch a strength band between the holders.
4. Stand on the back step facing the band. Hold on to the bars as pictured.
5. Step on the band and maintain your body in the upright position.
6. Keeping your elbows straight, shrug your shoulders up and down. This exercise will work the muscles that help rotate your shoulder blades.
7. Perform the desired number of repetitions as determined by the overload phase you are in.

Body Weight Closed Shoulder Shrugs

1. Same positioning and motion as above but without the use of the assistive strength band.

2. Perform the desired number of repetitions as determined by the overload phase you are in.

Part 4: Exercises for the Core

Sit Ups

The sit up exercise strengthens your abdominal musculatures which are important in stabilizing your core during most functional exercise. Doing the exercise with your feet fixed allows your hip flexor muscles to assist in the core bending which decreases the need for the abdominals to contract. For this reason most of the core exercises in this section are done with your feet not fixed.

Assisted and Body Weight Sit Ups

1. Place a single small band holder in the middle of the front upper horizontal frame.

2. Hang a strength band from the holder.

3. Hold the band as you lie on the floor within the frame as shown.

4. Keep your legs straight and unfixed on top of the step.

5. While holding the band with your outstretched arms, exhale and sit up.

6. The band will assist the motion. Do not create momentum with your arms. Just let the band assist the motion. Concentrate on rounding your spine and squeezing your ribs toward your pelvis. To achieve this it is important to exhale as you sit up.

7. If you are able to do this exercise without assistance for your required overload volume you can make the movement more difficult by lengthening your resistance lever arm.

8. To make the exercise more difficult, keep your arms straight and gradually increase the distance they are held away from your core. It is most difficult with your arms outstretched over your head.

9. Perform the desired number of repetitions as determined by the overload phase you are in.

Part 4: Exercises for the Core

Figure 35:
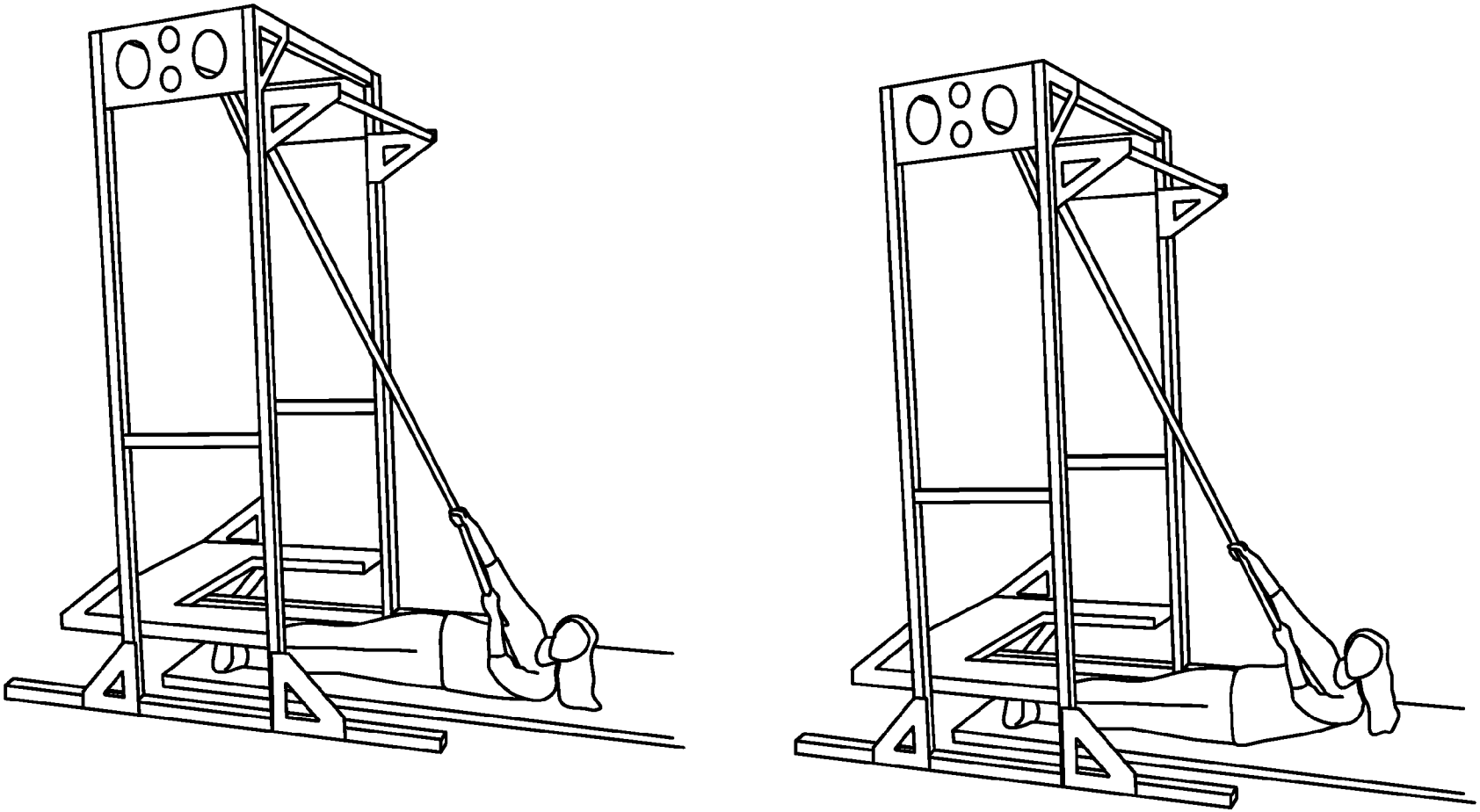

Lateral Crunches Sit Ups—FIG. 35

Assisted and Body Weight Lateral Crunches

1. Place a single small band holder on the front upper horizontal frame.

2. Hang a strength band from the holder as pictured.

3. Hold the band as you lie on your side on the floor within the frame as shown.

4. Drop your top leg behind your bottom leg as pictured.

5. While holding the band exhale and bend your torso.

6. The band will assist the motion. Do not create leverage with your bottom arm. Just let the band assist the motion. Concentrate on rounding your spine and squeezing your ribs toward your pelvis. To achieve this it is important to exhale as you sit up.

7. If you are able to perform the exercise without assistance then do not create leverage with your bottom arm. Concentrate on rounding your spine and squeezing your ribs toward your pelvis. To achieve this it is important to exhale as you sit up.

8. Perform the desired number of repetitions as determined by the overload phase you are in. Repeat the exercise on the opposite side.

Resisted Lateral Crunches (Not Pictured)

1. Place the small band holders on the bottom front frame with the appropriate strength band attached between them. Same as the resisted pushup.

2. Step into the band prior to lying on the floor.

3. Assume the lateral crunch position as if you were doing body weight lateral crunches. Place the band high on your side.

4. The band will provide resistance to the motion.

Figure 36:
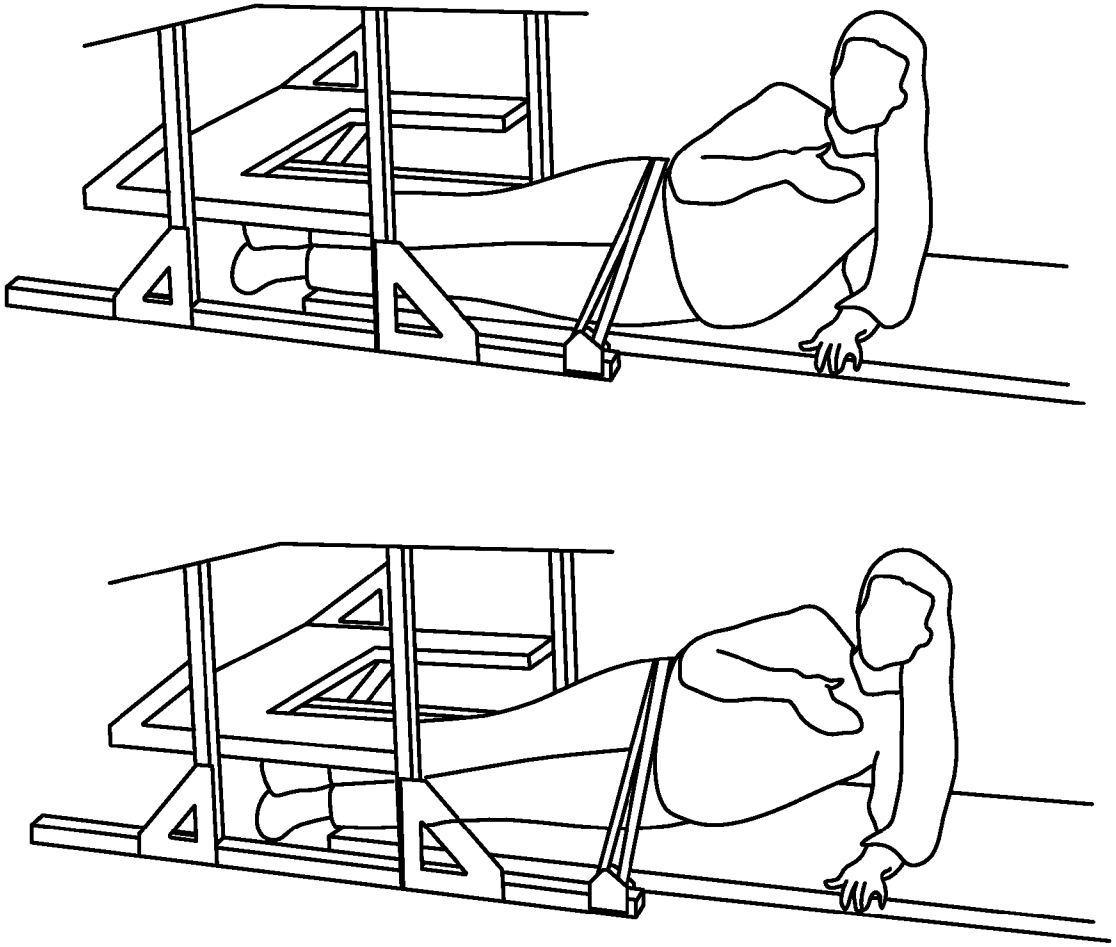

5. Perform the desired number of repetitions as determined by the overload phase you are in. Repeat the exercise on the opposite side Part 4: Exercises for the Core Side Hip Lifts—FIG. 36

This exercise strengths your erector spinae musculature. The muscles being exercised in this motion are the ones on the down or support side Resisted Side Hip Lifts 1. Place the small band holders on the bottom front frame with the appropriate strength band attached as pictured.

2. Lie on your side with the band pulled up and resting on your pelvis.

3. Support your body weight with your bent arm as pictured.

4. From the starting position, lift your hips up off of the floor. Do this until your body is straight as shown.

5. Perform the desired number of repetitions as determined by the overload phase you are in. Repeat the exercise on the opposite side.

Body Weight Side Hip Lifts

1. As above but without the use of the resisted strength band.

2. Perform the desired number of repetitions as determined by the overload phase you are in. Repeat the exercise on the opposite side.

Assisted Side Hip Lifts

1. Place a single small band holder on the front upper horizontal frame.

2. Hang a strength band from the holder as if you were doing lateral crunches.

3. Place the loop around your torso prior to lying on your side.

4. Perform the exercise as per above, except the band will assist the motion.

5. Perform the desired number of repetitions as determined by the overload phase you are in. Repeat the exercise on the opposite side.

Part 4: Exercises for the Core

Figure 37:
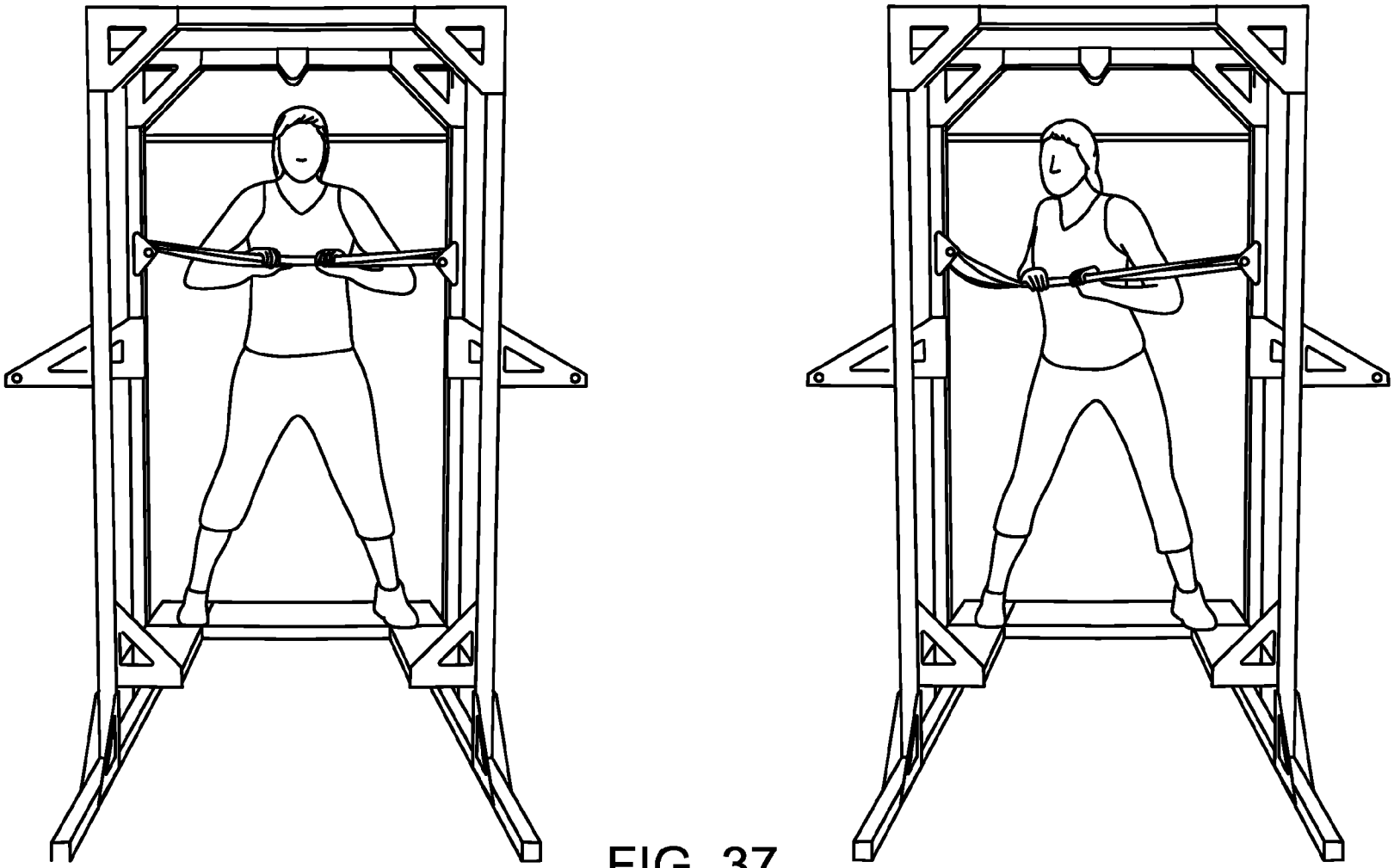

Resisted Core Rotation—FIG. 37

This is a functional exercise to strengthen your abdominal oblique musculature.

1. Place the small band holders on the back vertical frame at chest height as pictured.

2. Stretch a strength band between the holders.

3. Place your feet wide on the side steps as pictured and lean into the band while holding it in your hands as pictured.

4. Rotate your torso to the right and left and keep your legs stationary.

5. Make sure you exhale and focus on tightening your stomach muscles.

6. Perform the desired number of repetitions as determined by the overload phase you are in.

Part 5: Nerve Conduction Speed

Figure 38:
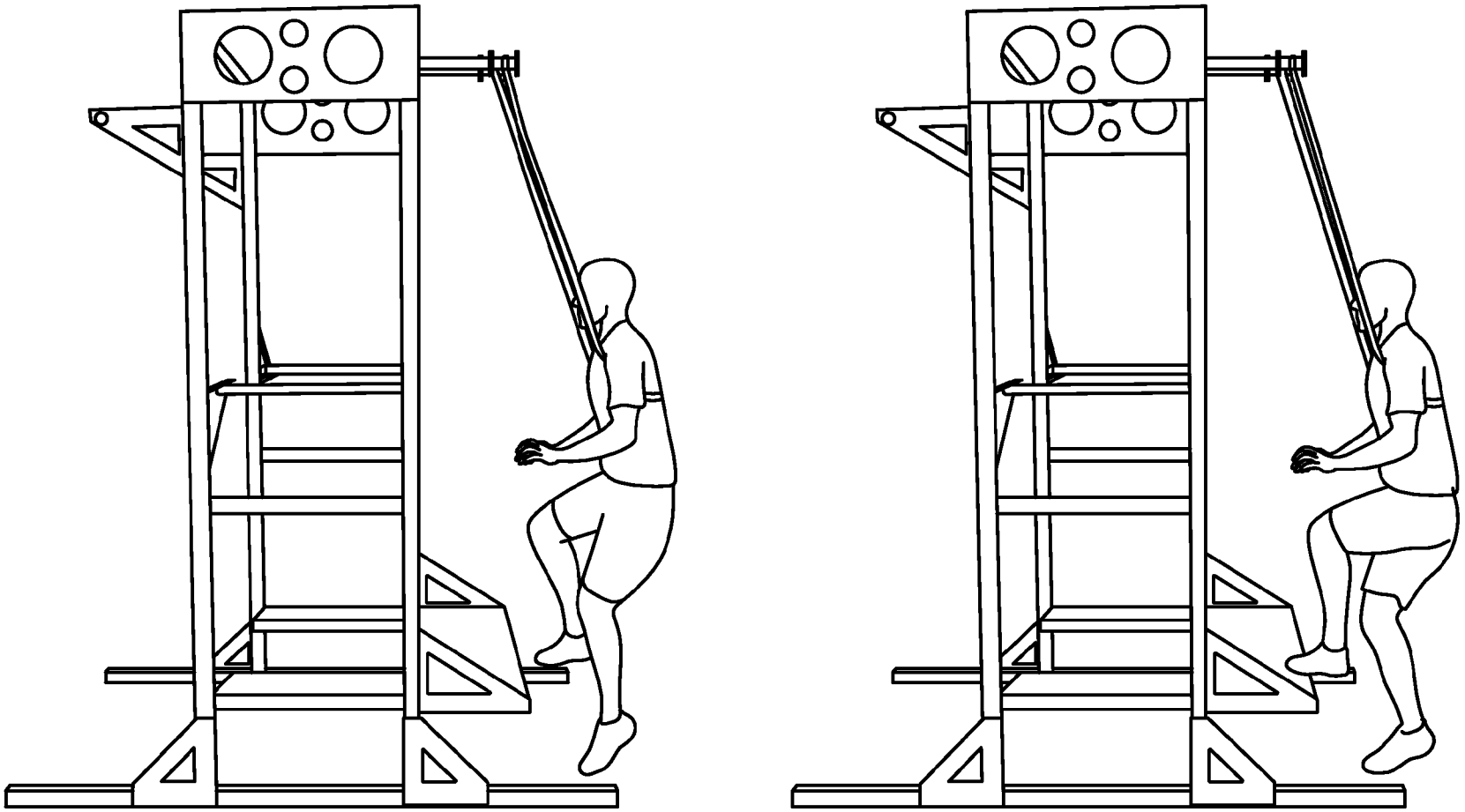

Bilateral and Single Leg Squat Jumps—FIG. 38

Examples of more advanced power development exercises.

1. Place the elongated band holders on the back upper horizontal frame facing backward shoulder width apart.

2. Place an assistive strength band under your arms and around your back as pictured. To make this easier, you may first stand on the step to place the band; then step down.

3. Next, determine the amount of assistance needed, if any, to perform 20 squat jumps to the step by switching bands until you determine the appropriate amount.

4. Establish your best pace with the metronome.

5. Use an assistive strength band that will allow you to do 20 jump squats at about a 5% to 10% faster pace than established in the base line measure.

6. Facing the step, bend your knees and hips in proper squat form and jump up to the step as pictured.

7. Make sure to use your arms to help generate momentum. In the case of a single leg squat jump, it is the opposite arm from the leg that is pushing off.

8. Do not attempt the single leg version until you are capable of doing single leg squats without assistance. Once you are, this speed exercise is a great way to equalize the power development between your lower extremities.

Part 5: Nerve Conduction Speed

Toe Tap To Step—FIG. 38

Alternate Toe Taps to Step

1. First, determine the amount of assistance needed, if any, to perform 20 alternate toe taps to the step.

2. Establish your best pace with the metronome. If assistance is needed set up the frame as described below.

3. Place the elongated band holders on the back upper horizontal frame facing backward, shoulder width apart.

4. Place an assistive strength band under your arms and around your back as pictured. To make this easier, you may first stand on the step to place the band; then step down.

5. Use an assistive strength band that will allow you to do 20 alternate toe taps at about a 5% to 10% faster pace than established in the base line measure.

6. Make sure to use your opposite arm swing with the leg tapping the step to assist in generating momentum.

Part 6: Circuit Training Examples

Sequence of Exercises: Examples for Circuit Training

This device offers many combinations of exercises for you to do in a circuit fashion. It is good to be creative, but keep in mind the main tenets of a properly designed program. The main tenets that should guide anyone in the implementation of an exercise program are specificity, overload, adaptation, rest, frequency, order, and duration.

As mentioned earlier in this disclosure only one exercise session per week should be at maximum intensity. The next exercise session should be done with the same volume, but with a lower load. In the case of assisted exercise, that would mean increasing the amount of assistance when performing an exercise. In the last exercise session for a given week it is a good idea to work on your nerve conduction speed while performing the exercises in the circuit.

Following are some examples of circuits that are appropriate for beginning, intermediate, and advanced users.

Beginner Circuit Example

1. Begin your exercise session with the functional warm up exercises.

2. Wear a heart rate monitor to evaluate your heart rate as you participate in this circuit training program. Goal is to attain 65% of your training heart rate.

3. Begin this program by speed walking outside for 10 minutes. Adjust the speed of your gait to increase or decrease the intensity and bring your heart rate into its training zone. Between the groupings of exercises you will again speed walk for 5 minutes.

| Group 1 Exercises | Group 2 Exercises | Group 3 Exercises |
|---|---|---|
| Push Ups | Pull Ups | Closed Knee Extension |
| Lying Hip Extension | Hip Hikers | Dips |
| Sit Ups | Lateral Crunches | Closed Hip Adduction |

Part 6: Circuit Training Examples

Intermediate Circuit Example

1. Begin your exercise session with the functional warm up exercises.

2. Wear a heart rate monitor to evaluate your heart rate as you participate in this circuit training program. Goal is to attain 75% of your training heart rate.

3. Begin this program by speed walking/jogging outside for 10 minutes. Adjust the speed of your motion to increase or decrease the intensity and bring your heart rate into its training zone. Between the groupings of exercises you will again speed walk/jog for 10 minutes.

| Group 1 Exercises | Group 2 Exercises | Group 3 Exercises |
|---|---|---|
| Push Ups | Inverted Rows | Pull Ups |
| Squats | Closed Hip Extension | Dips |
| Sit Ups | Lateral Crunch | Hip Hiker |

Advanced Circuit Example

1. Begin your exercise session with the functional warm up exercises.

2. Wear a heart rate monitor to evaluate your heart rate as you participate in this circuit training program. Goal is to attain 85% of your training heart.

3. Begin this program by jogging outside for 15 minutes. Adjust the speed of your motion to increase or decrease the intensity and bring your heart rate into its training zone. Between the groupings of exercises you will again speed walk/jog for 10 minutes.

| Group1 | Group2 | Group 3 | Group 4 |
|---|---|---|---|
| Push Up | Closed Hip Ext. | Inverted Row | Dips |
| Single Squat | Pull Ups | Side Hip Lift | Closed Shrugs |
| Sit Up | Lateral Crunch | Closed Shld Abd | Hip hiker |

Part 7: Targeted Training

Sequence of Exercises: Examples for Targeted Training

Similar to the circuit training examples listed previously, device 10 can be set up to allow for exercises to take place in combinations to save you valuable time when resistance training. Targeted training is utilized in exercise programs when the cardiovascular and resistance components are done separately. Targeted training is most appropriate for the advanced user who needs to improve peak functional and/or cardiovascular performance. Users participating in targeted training may have separate upper and lower body progressive resistance exercise days in their weekly schedule.

Easy to Set Up Groupings for Upper Body Exercises

| Group 1 | Group 2 | Group 3 |
|---|---|---|
| Push Ups | Pull Ups | Closed Shld Abduction |
| Inverted Rows | Dips/Closed Shrugs | Closed Shld Hor Abd |

Easy to Set Up Groupings for Lower Body and Core Exercises

| Group 1 | Group 2 | Group 3 | Group 4 |
|---|---|---|---|
| Squats | Closed Hip Ext | Closed Hip Add | Hip Hiker |
| Sit Ups | Closed Knee Ext | Side Hip Lift | Lateral Crunch |

Using the Device 10 to Treat Specific Orthopedic Pathologies

The Lumbar Spine Disc

Low back pain is a common complaint heard by most medical professionals. Understanding the cause of low back pain starts with an understanding of anatomy and what happens to the spine as we age. While it is beyond the scope of this disclosure to describe in detail the anatomical structures that make up the spine, for simplicity sake, let's just say the spine is composed of many bones called vertebra and inter-vertebral discs that occupy the space between these vertebras.

These inter-vertebral discs are composed of an outer fibrous cartilaginous ring called the annulus fibrosis and an inner nuclear pulposes. When we are young this inner nucleus is filled with a gel like substance that is approximately 80% water. The outer annulus is made of a fibrous cartilaginous tissue.

As we age the inner nucleus undergoes changes and becomes more fibrous, losing its fluid content. By the time we reach 60 years of age this vertebral disk segment is filled with a fibrous cartilaginous mass. It becomes difficult to distinguish the outer annulus from the inner nucleus. Understand that this is a normal part of the aging process.

Pathological changes occur to the disc when abnormal forces are applied to it during this transformational process. In a young spine, in which the disc is fully hydrated, the position of the spine plays an important role in the position of the nucleus. When the nucleus is filled with fluid, it is susceptible to pressure changes. Fluid tends to migrate from higher pressure areas to lower pressure areas within the disc. Forces such as prolonged sitting tend to migrate the nucleus backward stressing the posterior annulus. This phenomenon is similar to what you would experience if you would put pressure on the front of a water balloon: the water would obviously move to the back of the balloon.

With incorrect bending of the spine (usually due to poor posture in both exercising and everyday life) the pressure, on the nucleus fluid pushes it to the back of the disc. This increased pressure against the posterior annular ring causes premature disc failure. As the posterior annulus fails, the level of disease can range from a simple disk herniation to a ruptured or sequestered disk fragment around sensitive neural tissue.

Using device 10 can help one cope and manage the pain associated with milder forms of disc disease. Prior to starting any exercise program, it is important to seek the advice of a physical therapist in order to correct structural faults, such as scoliosis, and to treat low back disc pathology.

One of the biggest issues associated with early disc pathology is the amount of time we spend sitting and our inability to bend our hips and knees in an appropriate manner. Decreasing the amount of time you spend sitting and in learning to squat properly will go a long way to protecting your inner vertebral disc. If you do suffer from a mild posterior disk herniation, the techniques described below should help you decrease your low back pain.

Position Yourself for Proper Sleep

Sleep positioning is important when dealing with a disc herniation. In the younger fluid-filled nucleus the everyday forces of gravitational compression cause the fluid of the nucleus to be squeezed into the porous vertebral bone above and below the disc. This is normal and has a purpose. When the fluid is contained in the vertebral bone it receives needed nourishment.

However, when you sleep at night and are in a non-gravitational position for an extended period of time, the fluid returns to the disc. Incidentally, you may not realize that as a result of this you are taller in the morning than you are in the afternoon. However, an issue occurs if there is a distortion of the annulus caused by a herniation. As the disk refills with fluid, it fills into the herniation, and causes significant morning discomfort. It can even be difficult to stand up straight in the morning if the bulge is significant enough. Only after gravity has some time to work on the segment do you start to feel better.

Allowing this cycle to repeat itself over and over again only prolongs the healing time of the stretched outer annulus. How do we prevent this from happening night after night? The use of compression created by sleeping in the proper position can lessen the amount of fluid that fills into the bulge. Our center of mass tends to sink into even the firmest of mattresses, creating problems for those with disc bulges. When we sleep on our back the fluid flows towards the back of the spine due to gravity and the loss of the normal low back curve. If your back pain is mostly centralized and not causing radiating pain down your legs, placing a support under your low back will keep the normal spinal curve and prevent the fluid from filling into the weakened area. This happens because maintaining the normal curvature of your lumbar spine increases posterior pressure, thus not allowing the fluid to fill the herniation.

If you have radiating pain down your leg caused by a bulging disc then you will use lateral compression to prevent the filling of the herniation. For example, if your pain is down the right leg then you would sleep on your left side. By sleeping on your left side your center of mass will sink into the mattress causing right-sided compression. This along with gravity will prevent fluid filling into the right-side herniation. Keep in mind that if you sleep on your right side you will contribute to the problem by making it easier for the fluid to fill to the right.

Accomplish the Squatting Movement Properly

Since this movement is such a mainstay of functional living, many back issues emanate from poor squat form. Most often when you do not squat properly it is your spine that is over-used, causing premature failure in the disc. If you use improper form, the extra stress over time can lead to other spinal pathologies as the disc becomes fibrous too quickly. Teaching and conditioning the body to accomplish correct squatting can help resolve back pain. To do this, follow these steps:

1. Decrease your body mass if needed, since the extra weight makes it more difficult for you to manipulate your center of mass within your base of support. Refer to the section on using the Device 10 for doing squats to learn how to lessen the impact of your body mass in doing exercises.

2. Learn to squat properly according to the instructions in the exercises section. Remember that, bending forward at the spine increases the anterior pressure in the disc and causes the fluid to move to the back of the segment. In time this increased pressure will change the posterior annulus causing a herniation. The forces are magnified if you are squatting with an external load.

Avoid Prolonged Sitting

By avoiding prolonged sitting you avoid the same dynamics mentioned above. If you sit for a long time, particularly without low back support, there will be a tendency for the disc fluid or fibrous material to exert a steady pressure on the back of the disc.

Use Device 10

The following exercises will help relieve the symptoms associated with a disc herniation.

1. Lower Extremity Hang:

Set up the elongated band holders as if you were doing assisted squats. Rotate the arm bars into the frame as shown.

Place a heavy assist band around your torso as pictured. A towel may be needed under your arms to cushion the pressure from a heavy band. Assume the starting triceps dip position as shown. Do not bend your arms. Gently "swing your legs to the left and right" stretching the low back. The band will make it easier to support your body weight during the stretch. Do as much as you can and then rest and repeat. Pictures of the lower extremity hang are shown in the lumbar spine degenerative joint disease section next.

Figure 39:
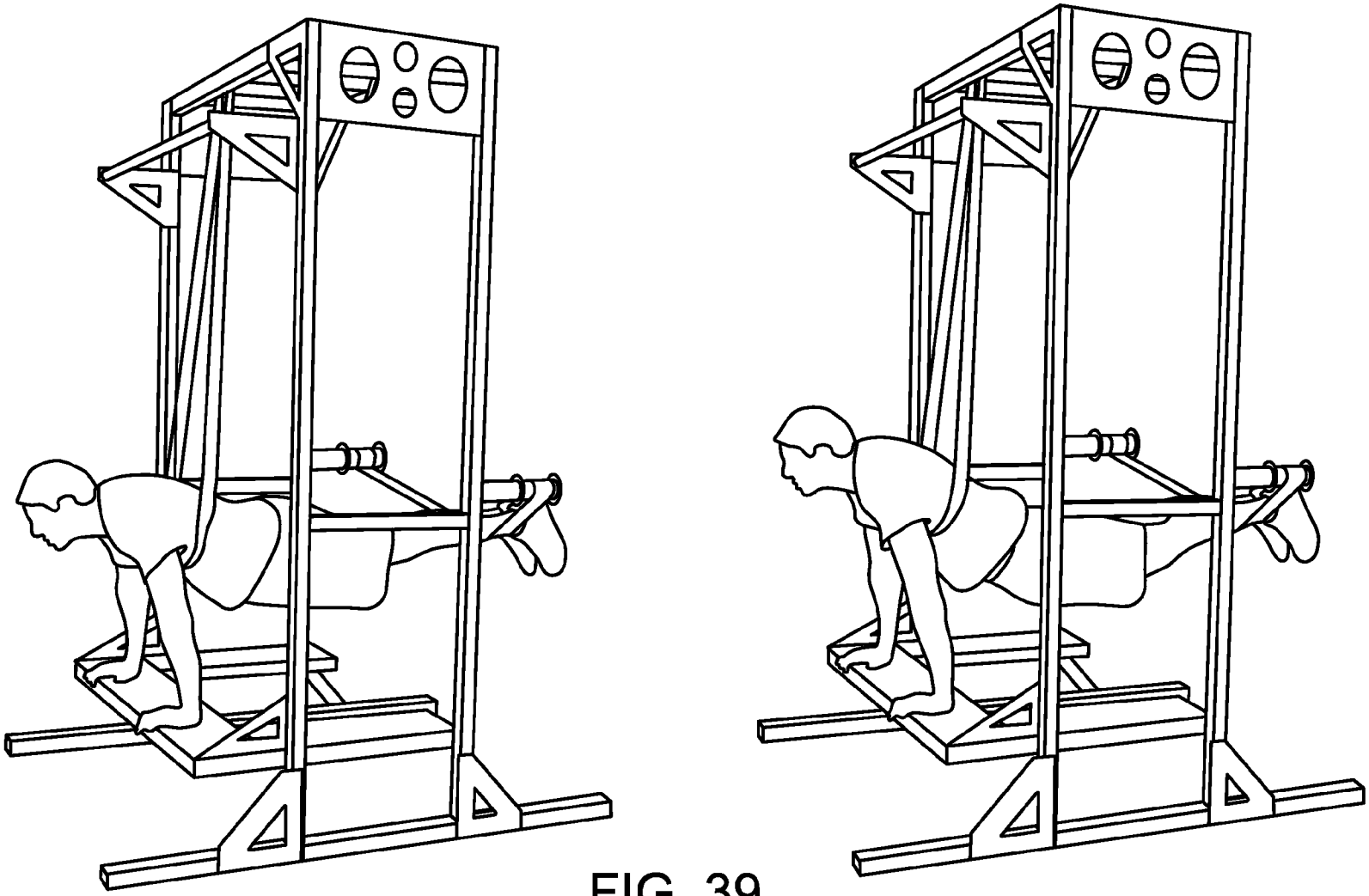

The Lumbar Spine Disc—FIG. 39

2. Relaxed Lumbar Spine Extension

Set up the elongated band holders in the same position as you would for pull ups for shorter users. Attach a heavy assist band between the hangers. Place a small band holder with another heavy assist band on the posterior horizontal frame. Loop the band around your chest as shown. Assume the prone position with your outstretched arms on the back step and your legs on the stretched band as pictured. From this position, attempt to move your belly button towards the floor via a gentle rocking motion, which is caused by low back muscle contraction. You should feel compression in the low back.

Lumbar Spine Degenerative Joint Disease and Stenosis

The normal changes described previously that take place in the lumbar spine as you age contribute to decreased motion. This in turn leads to an increased likelihood of the diseases associated with the aging spine. Diseases such as facet joint arthritis and spinal stenosis are common in the older population. How you handle the aging process has a lot to do with the final outcome.

If you live a life with aberrant motion patterns and sustain a high body mass index you will accelerate the aging process and promote the abnormal anatomical changes that are responsible for many of the diseases associated with the aged spine. Seeking the advice of a physical therapist and correcting structural faults, such as scoliosis, is needed prior to starting any exercise program to treat low back degenerative joint disease. If you suffer from milder forms of spinal joint arthritis and or spinal stenosis, the techniques described below should help you cope with your diagnosis.

1. If your body mass index is high, then work to lower it. The extra gravitational force on your spine promotes disease progression. Seek the help of a registered dietician if this is an issue for you. Your body mass index should be on the low side of normal as you age. A measure of 20 kg/m2 for your body mass index is a desirable goal.

2. At the same time you lower your body mass index, increase your functional strength. Your lower extremity muscles are your body's shock absorbers. They are your first line of defense against the ground reaction forces that are transmitted through your body with every step. This is one reason those with mild spinal stenosis tend to have decreased symptoms when they are moving as compared to when they stand statically. Maximize your genetic potential with regards to your functional strength.

3. Good cushioned shoes help to dissipate the ground reaction forces that are transmitted through your body with every step. Invest in a good cushioned athletic shoe that you will wear most of the time. Replace the shoes every 6 months or sooner if you are on your feet a lot.

4. Along with improving your strength-to-body weight ratio, it is imperative that you learn to move properly. Your spine is not a prime lifter. That job is for your lower extremity musculature. Proper spine position and stabilization has to occur while you are moving your lower extremities against gravity, not lying down on a treatment table. If you have joint problems, have them evaluated by a physical therapist. Correcting these dysfunctions can allow you to move properly. For example, with knee osteoarthritis, shoe wedges may off-load the affected compartment. As you correct this dysfunction, your knee pain will decrease, allowing you to begin to train yourself to move properly.

5. Stretching and core exercises are important components in the treatment of degenerative joint disease of the spine. Use the exercises specifically listed below to manage the disease process.

6. It is important to maintain your strength in the muscles associated with walking. You may use the Device 10 to offset your weight, thus enabling you to walk without discomfort. In order for you to do this you will need to purchase a desk treadmill. Desk treadmills are light and small enough to fit within the Device 10 frame. Rotate the arm bars into the frame to allow for balance assist if needed. Place the elongated band holders facing backwards on the top front horizontal frame, shoulder width apart. Loop an assist strength band from the holders to around your torso; a towel may be needed to cushion a heavy band. The width of the band is determined by how much weight needs to be off-loaded to allow you to walk without lower back or leg pain. You may need to wear a long sleeve shirt to protect your arms from chafing from the band during the exercise. To place the band you may need to stand on the side steps first and then step down onto the treadmill.

Lumbar Spine Degenerative Joint Disease and Stenosis

Figure 40:
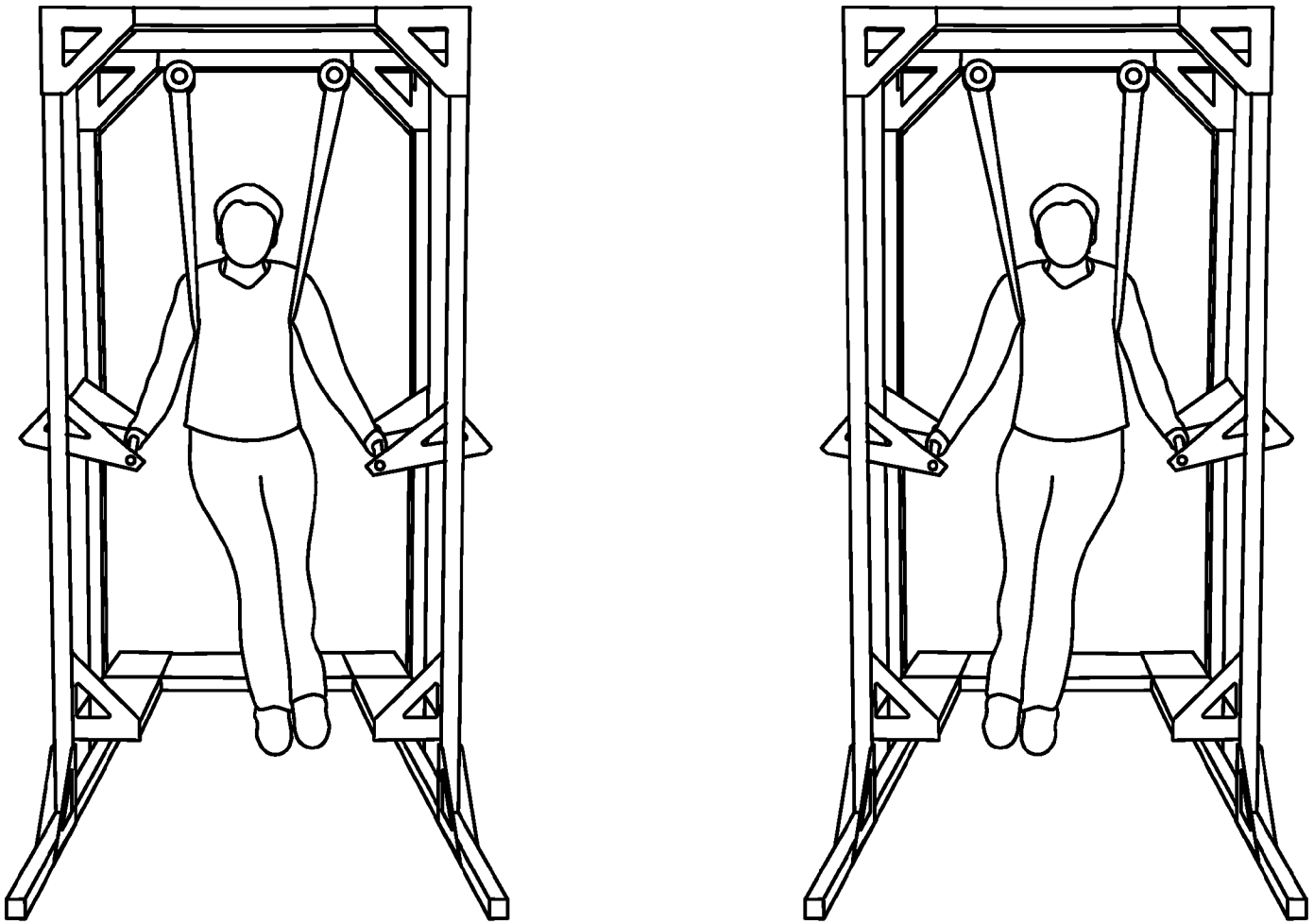

Lower Extremity Hang—FIG. 40

Set up the elongated band holders as if you were doing assisted squats. Rotate the arm bars into the frame as shown. Place a heavy assist band around your torso as pictured. A towel may be needed under your arms to cushion the pressure from a heavy load. Assume the starting triceps dip position as shown. Do not bend your arms. Gently "swing your legs to the left and right" stretching the low back. The band will make it easier to support your body weight during the stretch. Do as much as you can and then rest and repeat.

Rotator Cuff Disease

The Rotator Cuff is a group of muscles that are located on the scapula (shoulder blade) and the humerus (upper arm bone). They are responsible for helping to stabilize the humeral head in the relatively shallow glenoid of the scapula. This dynamic stabilizer is needed in the shoulder joint due to the magnitude of motion that takes place in this joint. The rotator cuff also assists in rotation of the upper arm bone.

Through evolution our species became more and more bipedal (that is, we spent more time on our feet and less time on all fours). As this took place we lost one of the benefits of being on all fours, the gravitational compressive force caused by weight bearing. This loss of gravity, when the arm was moved in open space, placed more stress on the rotator cuff to stabilize an inherently unstable joint.

The human rotator cuff is not designed to repeatedly stabilize full motion at the shoulder joint—especially with any resistance to this motion. In time the tendons simply wear out and break down.

Another aspect of open chain motion is that when the arm is fully overhead, we rarely use the lower cuff and latissimus dorsi muscles in an eccentric manner (contraction while the muscle is lengthening). This unfortunately allows the humerus to ride high in the joint, impinging upon the most frequently injured muscle of the rotator cuff, the supraspinatus.

If you suffer from rotator cuff dysfunction, follow the advice below to treat your rotator cuff disease. While these approaches can help those who have complete ruptures of the rotator cuff tendon, realize that complete normal shoulder function will not happen in a rotator cuff deficient shoulder.

1. Stop bench pressing! Lying on your shoulder blades while you are moving your shoulder complex decreases motion at the scapula thoracic joint and subsequently increases the motion at the glenohumeral joint. The increased motion at this joint increases the stress on the rotator cuff and promotes failure in time. A better way to strengthen the chest, shoulder, and triceps is to do push ups.

2. Decrease the frequency of overhead motion of the arm without proper lower cuff and latissimus dorsi eccentric loading. When you do a pull up your arm goes over your head, but there is a difference between your arms going over your head in open space and the way they do in the pull up. As explained above, the latissimus dorsi apply a downward force on the humerus as it rotates overhead, lessening the impingement on the supraspinatus tendon.

3. Allow the tendon sufficient time to adapt to stress. As mentioned earlier in this manuscript in the section explaining "overload," tendons need more time to adapt to stress than the muscle fibers do. When you have rotator cuff disease a prolonged tendon adaptation phase is required to allow the cuff tendons to heal and strengthen. Remember during this phase to utilize lower loads over a greater frequency to help stimulate collagen strengthening in the tendon with all of your upper extremity exercises.

4. Utilize gravity to assist in shoulder stabilization as you strengthen your upper extremity. Device 10 allows you to utilize gravity in assisting shoulder stabilization for the majority of all upper extremity exercises. Refer to the exercises below to help strengthen your shoulder musculature.

The invention claimed is:

1. An exercise device for functional exercises, the device comprising:

a frame that defines an interior exercise area and an opening that provides a user access to enter and exit the interior exercise area;

a step carried by the frame; the step having a first portion disposed within the interior exercise area and a second portion disposed outside the interior exercise area;

a band holder carried by the frame at a location higher than the step; the location of the band holder being repositionable with respect to the frame to a plurality of locations with a first set of locations being higher than the step and a second set of locations being lower than the step and some locations positioning the band holder within the interior exercise area and some locations positioning the band holder outside the interior exercise area;

an elastic exercise band selectively positionable on the band holder; and the step including a main back step disposed opposite the opening of the frame; the step also including a pair of side steps disposed perpendicular to the main back step to define an overall U-shape to the step.

2. The device of claim 1, wherein each of the side steps has a front end and a rear end; the rear end of each side step being supported directly from the main back step.

3. The device of claim 1, further comprising:

a pull up bar disposed above and forward of the opening defined by the frame; and the pull up bar is carried by a pair of brackets that are each selectively pivotably mounted to the frame to allow the height of the pull up bar to be adjusted with respect to the frame without removing the pull up bar from the frame.

4. The device of claim 1, further comprising a pair of parallel arm bars carried by the frame inside the interior exercise area above the step; each parallel arm bar being carried by a pair of brackets that are selectively pivotably mounted to the frame to allow the position of the parallel arm bar to be adjusted with respect to the frame.

5. An exercise device for functional exercises, the device comprising:

a frame that defines an interior exercise area and an opening that provides a user access to enter and exit the interior exercise area;

a step carried by the frame; the step having a first portion disposed within the interior exercise area and a second portion disposed outside the interior exercise area;

a band holder carried by the frame at a location higher than the step; the location of the band holder being repositionable with respect to the frame to a plurality of locations with a first set of locations being higher than the step and a second set of locations being lower than the step and some locations positioning the band holder within the interior exercise area and some locations positioning the band holder outside the interior exercise area;

an elastic exercise band selectively positionable on the band holder;

a pair of parallel arm bars carried by the frame inside the interior exercise area above the step; and each parallel arm bar being carried by a pair of brackets that are selectively pivotably mounted to the frame to allow the position of the parallel arm bar to be adjusted with respect to the frame.

6. The device of claim 5, wherein each parallel arm bar may to rotated from a position inside the interior exercise area to a location outside the interior exercise area where the parallel arm bar may be used in a side exercise area.

7. An exercise device for functional exercises, the device comprising:

a frame that defines an interior exercise area and an opening that provides a user access to enter and exit the interior exercise area;

a step carried by the frame; the step having a first portion disposed within the interior exercise area and a second portion disposed outside the interior exercise area;

a band holder carried by the frame at a location higher than the step; the location of the band holder being repositionable with respect to the frame to a plurality of locations with a first set of locations being higher than the step and a second set of locations being lower than the step and some locations positioning the band holder within the interior exercise area and some locations positioning the band holder outside the interior exercise area;

an elastic exercise band selectively positionable on the band holder;

the frame including a base having a right base and a left base; the frame further including four main uprights extending up from the base to define the interior exercise area of the device; and the right and left bases extending beyond the four main uprights to define front and rear exercise areas;

an elongated band holder that is positionable on the frame above a portion of the step in the rear exercise area;

the elongated band holder including a bar having a first end and a second end that carries a pair of spaced flanges that define a circumferential slot between the flanges adapted to receive a portion of an elastic band.

8. An exercise device for functional exercises, the device comprising:

a frame that defines an interior exercise area and an opening that provides a user access to enter and exit the interior exercise area;

a pair of parallel arm bars carried by the frame;

each parallel arm bar being carried by a pair of brackets that are selectively pivotably mounted to the frame to allow the position of the parallel arm bar to be adjusted with respect to the frame;

each parallel arm bar being rotatable from a position inside the interior exercise area to a location outside the interior exercise area where the parallel arm bar may be used in a side exercise area;

a band holder carried by the frame; the location of the band holder being repositionable with respect to the frame; and an elastic exercise band selectively positionable on the band holder.

9. The device of claim 8, further comprising a step carried by the frame; the step having a first portion disposed within the interior exercise area and a second portion disposed outside the interior exercise area; and the step being disposed below the parallel arm bars.

10. The device of claim 9, wherein the step includes a main back step disposed opposite the opening of the frame; the step also including a pair of side steps disposed perpendicular to the main back step to define an overall U-shape to the step.

11. The device of claim 10, further comprising an elongated band holder that is positionable on the frame above a portion of the step in the interior exercise area.

12. The device of claim 11, wherein the elongated band holder includes a bar having a first end and a second end that carries a pair of spaced flanges that define a circumferential slot between the flanges adapted to receive a portion of an elastic band.

13. An exercise device for functional exercises, the device comprising:

a frame that defines an interior exercise area and an opening that provides a user access to enter and exit the interior exercise area;

an elongated band holder that is selectively positionable on the frame in a plurality of first positions wherein the elongated band holder is disposed within the interior exercise area and a plurality of second positions wherein the elongated band holder is disposed outside the interior exercise area;

the elongated band holder including a bar having a first end and a second end that carries a pair of spaced flanges that define a circumferential slot between the flanges adapted to receive a portion of an elastic band; and an elastic exercise band selectively positionable on the elongated band holder.

14. The device of claim 13, wherein the frame includes a plurality of frame members that each defines a plurality of through holes; the elongated band holder including a pair of spaced bases that sandwich a portion of the frame; and a pair of connectors extending through each base and the frame to secure the elongated band holder to the frame.

15. The device of claim 13, further comprising a step carried by the frame; the step including a main back step disposed opposite the opening of the frame; the step also including a pair of side steps disposed perpendicular to the main back step to define an overall U-shape to the step; and a pair of parallel arm bars carried by the frame; each parallel arm bar being carried by a pair of brackets that are selectively pivotably mounted to the frame to allow the position of the parallel arm bar to be adjusted with respect to the frame;

each parallel arm bar being rotatable from a position inside the interior exercise area to a location outside the interior exercise area where the parallel arm bar may be used in a side exercise area.

16. The device of claim 15, further comprising a pull up bar disposed above and forward of the opening defined by the frame; the pull up bar being carried by a pair of brackets that are each selectively pivotably mounted to the frame to allow the position of the pull up bar to be adjusted with respect to the frame.

17. An exercise device for functional exercises, the device comprising:

a frame that defines an interior exercise area and an opening that provides a user access to enter and exit the interior exercise area;

the frame also defining a front exercise area and a rear exercise area;

the frame including two front vertical main uprights and two rear vertical main uprights;

one front vertical main upright and one rear main upright being connected to a left base frame member;

one front vertical main upright and one rear main upright being connected to a right base frame member;

the left and right base frame members extending forward of the front vertical main uprights to define the front exercise area;

the left and right base frame members extending rearward of the rear vertical main uprights to define the rear exercise area;

each of the vertical main uprights and the base frame members being square metal tubing that defines a plurality of spaced through holes;

a band holder having first and second mounts and a bar extending between the first and second mounts; each of the first and second mounts defining openings spaced to align with the spaced through holes of the square metal tubing;

the bar being spaced from the frame when the first and second mounts of the band holder are connected to the frame; the bar being adapted to receive an elastic exercise band;

the location of the band holder being selectively repositionable with respect to the frame to a plurality of locations; and a step carried by the frame; the step having a first portion disposed within the interior exercise area and a second portion disposed outside the interior exercise area; the step including a main back step disposed opposite the opening of the frame; the step also including a pair of side steps disposed perpendicular to the main back step to define an overall U-shape to the step.

18. An exercise device for functional exercises, the device comprising:

a frame that defines an interior exercise area and an opening that provides a user access to enter and exit the interior exercise area;

the frame also defining a front exercise area and a rear exercise area;

the frame including two front vertical main uprights and two rear vertical main uprights;

one front vertical main upright and one rear main upright being connected to a left base frame member;

one front vertical main upright and one rear main upright being connected to a right base frame member;

the left and right base frame members extending forward of the front vertical main uprights to define the front exercise area;

the left and right base frame members extending rearward of the rear vertical main uprights to define the rear exercise area;

each of the vertical main uprights and the base frame members being square metal tubing that defines a plurality of spaced through holes;

a band holder having first and second mounts and a bar extending between the first and second mounts; each of the first and second mounts defining openings spaced to align with the spaced through holes of the square metal tubing;

the bar being spaced from the frame when the first and second mounts of the band holder are connected to the frame; the bar being adapted to receive an elastic exercise band;

the location of the band holder being selectively repositionable with respect to the frame to a plurality of locations;

a pair of parallel arm bars carried by the frame;

each parallel arm bar being carried by a pair of brackets that are selectively pivotably mounted to the frame to allow the position of the parallel arm bar to be adjusted with respect to the frame; and each parallel arm bar being rotatable from a position inside the interior exercise area to a location outside the interior exercise area where the parallel arm bar may be used in a side exercise area.

19. The device of claim 18, further comprising:

a pull up bar disposed above and forward of the opening defined by the frame; and the pull up bar is carried by a pair of brackets that are each selectively pivotably mounted to the frame to allow the height of the pull up bar to be adjusted with respect to the frame without removing the pull up bar from the frame.

* * * * *